US010329796B2

(12) United States Patent
Morales, Jr.

(10) Patent No.: US 10,329,796 B2
(45) Date of Patent: Jun. 25, 2019

(54) METHOD AND APPARATUS FOR INSTALLING ALARM SYSTEMS AND DOOR LOCKS

(71) Applicant: Punch Point Tools, LLC., Houma, LA (US)

(72) Inventor: Richard J. Morales, Jr., Houma, LA (US)

(73) Assignee: PUNCH POINT TOOLS, L.L.C., Houma, LA (US)

( * ) Notice: Subject to any disclaimer, the term of this patent is extended or adjusted under 35 U.S.C. 154(b) by 311 days.

(21) Appl. No.: 15/278,178

(22) Filed: Sep. 28, 2016

(65) Prior Publication Data

US 2017/0081876 A1 Mar. 23, 2017

Related U.S. Application Data

(63) Continuation of application No. PCT/US2015/023310, filed on Mar. 30, 2015.

(60) Provisional application No. 62/121,889, filed on Feb. 27, 2015.

(51) Int. Cl.

| | |
|---|---|
| ***E05B 17/06*** | (2006.01) |
| ***B25H 7/00*** | (2006.01) |
| ***B25H 7/04*** | (2006.01) |

(52) U.S. Cl.

CPC ..... *E05B 17/06* (2013.01); *B25H 7/00* (2013.01); *B25H 7/04* (2013.01)

(58) Field of Classification Search

CPC ..... E05B 17/06; B25H 7/04; B25H 7/00

See application file for complete search history.

(56) References Cited

U.S. PATENT DOCUMENTS

| | | | |
|---|---|---|---|
| 877,879 | A | 1/1908 | Ash |
| 912,052 | A | 2/1909 | Albertson |
| 948,598 | A | 2/1910 | Stuart |
| 1,314,336 | A | 8/1919 | Kemp |
| 1,315,716 | A | 9/1919 | Forester |
| 1,377,458 | A | 5/1921 | Block |
| 1,599,256 | A | 9/1926 | Viehweger |

(Continued)

FOREIGN PATENT DOCUMENTS

| | | |
|---|---|---|
| EA | 12233 | 8/2009 |
| SU | 2434 | 2/1927 |
| WO | WO2015149060 | 10/2015 |

OTHER PUBLICATIONS

Brinks; Hampton Products International Corp.; 2007; https://images.homedepot-static.com/catalog/pdfImages/30/304dff53-088b-45a7-8402-f39dc7c817b1.pdf.*

*Primary Examiner* — Ryan J. Walters
(74) *Attorney, Agent, or Firm* — Brett A. North

(57) ABSTRACT

A method and apparatus for marking positions for burglar alarm sensor elements on a door, the door attached to a frame having a header including comprising the steps of providing a positioning member with a longitudinal, and punch point attached to the positioning member, the punch point being aligned with the longitudinal centerline of the positioning member; at least partially opening the door; placing the positioning member in a hole in the header and closing the door; while the door is closed causing the positioning member to make a mark on the top of the door; and opening the door and removing the positioning member from the hole in the header; and causing an opening to be made in the door at the location of the mark.

8 Claims, 54 Drawing Sheets

(56) References Cited

U.S. PATENT DOCUMENTS 1,853,456 A 4/1932 Ross
2,041,625 A 5/1936 Schmidt
2,272,241 A 2/1942 Fendring
2,412,517 A * 12/1946 Klein ..... F16B 15/06 411/452
2,572,999 A 10/1951 Elliot
2,581,534 A 1/1952 Hungerford
2,841,879 A 7/1958 Lanski
2,964,346 A 12/1960 Check
3,095,021 A 6/1963 Schlage et al.
3,107,934 A 10/1963 Lee
3,171,518 A 3/1965 Bergmann
3,330,525 A 7/1967 Weinstein
3,516,165 A 6/1970 Pfeffer
3,560,690 A 2/1971 Luce et al.
3,764,173 A 10/1973 Griffith
3,815,945 A 6/1974 Lamphere
4,005,890 A 2/1977 Murch
4,033,044 A 7/1977 Michaels
4,060,905 A 12/1977 Light
4,065,162 A 12/1977 Schlage
4,074,484 A 2/1978 Queren
4,174,862 A 11/1979 Shane
4,186,954 A 2/1980 Detlefs
4,211,442 A 7/1980 Hansen
4,363,173 A 12/1982 Caldera
4,369,994 A 1/1983 Vorves
4,382,337 A 5/1983 Bendick
4,389,790 A 6/1983 Dunlap
4,416,087 A 11/1983 Ghatak
4,453,751 A 6/1984 Hamilton
4,473,957 A 10/1984 Faulkner
4,499,666 A 2/1985 Smith
4,520,571 A 6/1985 Harding
4,527,337 A 7/1985 Dreiling
4,547,009 A 10/1985 Allen
4,550,939 A 11/1985 Babb, Jr. et al.
4,649,652 A 3/1987 Dickinson et al.
4,684,160 A 8/1987 Nelson
4,687,165 A 8/1987 Blackburn
4,690,445 A 9/1987 Hartley
4,791,731 A 12/1988 Dickinson et al.
4,802,701 A 2/1989 Mazie
4,872,717 A 10/1989 McEvoy et al.
4,893,776 A 1/1990 Floyd
4,903,010 A 2/1990 Greene
4,969,273 A * 11/1990 Richards ..... A47G 1/205 33/197
4,993,168 A 2/1991 Acuna
5,004,879 A 4/1991 Bernhardt et al.
5,008,648 A 4/1991 Conemac
5,088,682 A 2/1992 Gibbs
5,088,780 A 2/1992 Doherty
5,109,611 A 5/1992 Houck
5,129,154 A 7/1992 Aydelott
5,375,339 A 12/1994 Noel, Jr.
5,476,020 A 12/1995 Garvey et al.
5,544,536 A 8/1996 Kim
5,570,917 A 11/1996 Cutrer
D376,094 S 12/1996 Hubbard
5,593,194 A 1/1997 Liau
5,671,538 A 9/1997 Lautenschlagar
5,769,473 A 6/1998 Sovis
5,772,380 A 6/1998 Cloud et al.
5,906,404 A 5/1999 McGhee
5,937,613 A 8/1999 Vess, Sr.
6,021,578 A 2/2000 DeVingo
6,077,000 A 6/2000 Gibbons et al.
6,185,831 B1 2/2001 Pluciennik
6,286,803 B1 9/2001 Pellino et al.
6,508,011 B1 1/2003 Lee
6,612,629 B2 9/2003 O'Hanlon
6,719,260 B1 4/2004 Hart
6,837,527 B1 1/2005 Laurenzana
6,871,566 B2 3/2005 Niwayama et al.
6,907,675 B1 6/2005 Hutchings
6,971,184 B2 12/2005 Prevost
7,021,597 B2 4/2006 Vogt
7,040,034 B2 5/2006 Nielson et al.
7,095,320 B2 8/2006 Wang
7,234,245 B2 6/2007 Tatum
7,293,925 B1 11/2007 Sanseviero
7,316,078 B2 1/2008 Hagman
D571,171 S 6/2008 Albritton et al.
7,396,055 B2 7/2008 Arneson et al.
8,684,426 B2 4/2014 Morales, Jr.
2004/0177527 A1 9/2004 Prevost
2006/0096111 A1 5/2006 Dolenz et al.
2007/0126576 A1 6/2007 Script et al.
2012/0011694 A1* 1/2012 Morales, Jr. ..... E05B 17/06 29/428
2013/0057404 A1 3/2013 Thibault

* cited by examiner

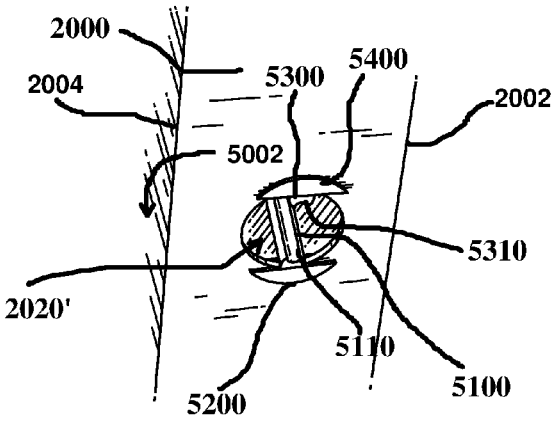
FIG. 69
FIG. 68
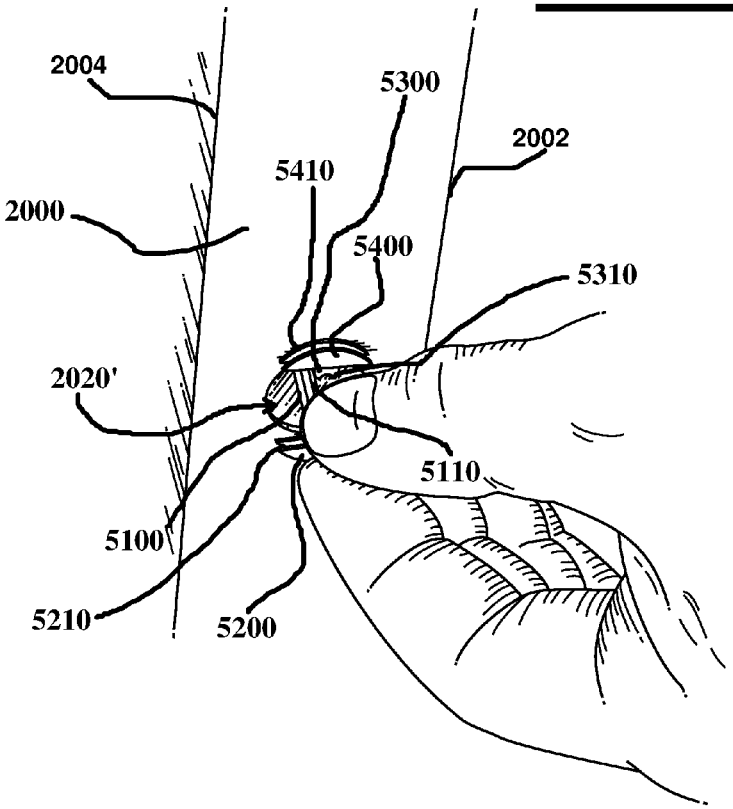

METHOD AND APPARATUS FOR INSTALLING ALARM SYSTEMS AND DOOR LOCKS

CROSS-REFERENCE TO RELATED APPLICATIONS

This is a continuation of Patent Cooperation Treaty application no. PCT/US2015/23310, with international filing date Mar. 30, 2015, which application claims the benefit of U.S. Provisional Patent Application Ser. No. 62/121,889, filed Feb. 27, 2015, and each of these applications is incorporated herein by reference. Priority of/to each of these applications is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND

The present invention relates to installation of burglar alarms and installation of door latches, and/or locks, and/or lock hardware.

Most manufacturers have pre-drilled the majority of doors for doorknobs (with cross bores and latch bores), and their measurements will be standard. One challenge with installing doors is to properly position the latch bore and/or the strike plate on the door frame. This is currently done with the installer approximating the aligned position of the strike plate.

There is a need to provide a quick and convenient method for marking holes to be drilled for installing burglar alarm sensor components, along with a method and apparatus for marking for door latches, and/or strike plates, and/or lock hardware.

While certain novel features of this invention shown and described below are pointed out in the annexed claims, the invention is not intended to be limited to the details specified, since a person of ordinary skill in the relevant art will understand that various omissions, modifications, substitutions and changes in the forms and details of the device illustrated and in its operation may be made without departing in any way from the spirit of the present invention. No feature of the invention is critical or essential unless it is expressly stated as being "critical" or "essential."

BRIEF SUMMARY

One embodiment provides a method and apparatus for marking positions for burglar alarm sensor elements on a door, the door attached to a frame having a header comprising the steps of:

providing a marking apparatus, the positioning member having a longitudinal centerline and a marking point, the marking point being aligned with the longitudinal centerline of the positioning member;

at least partially opening the door;

placing the positioning member in a hole in the header and closing the door; while the door is closed causing the marking point of the positioning member to form a positioning mark;

opening the door and removing the positioning member from the hole in the header; and causing an opening to be made in the door at the location of the positioning mark.

In one embodiment the positioning member has a groove and a contact wire is hanging from the hole in the header and the contact wire is placed in the groove.

In one embodiment the arm has first and second opposing sides, and the positioning member is located on the first side and the marking tip is located on the second side.

In one embodiment the arm of the positioning member is held in a substantially horizontal position during marking.

In one embodiment the marking tip is integral with the positioning member.

In one embodiment the arm has first and second opposing sides, and the marking tip is located a distance from the second side and such distance is adjustable related to the second side.

In one embodiment the positioning member has a rounded tip.

In one embodiment the positioning member is bullet shaped, conically shaped, and/or cylindrically shaped.

In one embodiment the positioning member is frustoconically shaped.

In one embodiment the positioning member has a positioning surface which is cylindrically shaped and has an outer diameter which is slightly smaller than the hole in the header.

In one embodiment the marking tip is integral with the positioning member.

In one embodiment the positioning member has a rounded tip.

In one embodiment the positioning member is bullet shaped, conically shaped, and/or cylindrically shaped.

In one embodiment the positioning member is frustoconically shaped.

In one embodiment the positioning member has a positioning surface which is cylindrically shaped and has an outer diameter which is slightly smaller than the cross bore in the door.

One embodiment provides a method and apparatus for marking positions for burglar alarm sensor elements on a door, the door being attached to a frame comprising the steps of:

providing a positioning member, the positioning member having a longitudinal centerline and a marking point, the marking point being aligned with the longitudinal centerline of the positioning member;

at least partially opening the door;

placing the positioning member in a hole in the frame;

closing the door in the door frame;

causing the marking point to make a mark on the door;

opening the door and removing the positioning member from the hole in the frame; and causing an opening to be made in the door at the location of the positioning mark.

In one embodiment the positioning member includes a frictional element. In one embodiment the frictional element includes is flexible and includes first and second ends.

In one embodiment the force application member is a rope, wire, chain, cord, or string. In one embodiment the wire is can be at least 20, 18, 16, 12, 10, 8, 6, and 4 gauge in thickness. In various embodiments the wire can be between any two of the specified gauges.

In one embodiment the positioning member includes a plurality of grooves which are substantially parallel to the longitudinal centerline of the positioning member and the frictional element at least partially occupies one of the grooves.

In one embodiment the positioning member includes a bore which is substantially perpendicular to the longitudinal centerline of the positioning member and the frictional element is threaded through the bore.

One embodiment provides a method and apparatus for marking positions for receiving or strike plates on door frame, the door being attached to a frame comprising the steps of:

providing a first marking apparatus the first marking apparatus including a first marking point, placing the first marking apparatus in a first screw hole opening for a strike plate, deadbolt receiving plate, or electric strike for receiving a door locking member when the door is closed in the door frame;

closing the door with the first marking apparatus in the first screw hole opening;

while the door is closed causing the first marking apparatus to make a first positioning mark on the door frame;

opening the door and removing the first marking apparatus from the door; and using the first positioning mark to install a strike plate, deadbolt receiving plate, or electric strike for receiving a door locking member when the door is closed in the door frame.

One embodiment includes the further steps of:

after making the first positioning mark on the door frame, placing the first marking apparatus in a second screw hole opening for a door locking member and placing the door in a closed state in the frame, and while the door is closed causing the first marking apparatus to make a second positioning mark on the door frame; opening the door and removing the first marking apparatus from the door; and using the first and second positioning marks to install a strike plate, deadbolt receiving plate, or electric strike for receiving a door locking member when the door is closed in the door frame. In one embodiment a second marking apparatus can be used for the steps with the second screw hole.

One embodiment provides a method and apparatus for marking positions for receiving a strike plate, deadbolt receiving plate, or electric strike for receiving a door locking member when the door is closed in the door frame, the door being attached to a frame comprising the steps of:

providing first and second marking apparatuses the first and second marking apparatuses including first and second marking points, placing the first and second marking apparatuses in first and second screw hole openings for a latch or deadbolt mechanism for the door;

while the door is closed causing the first and second marking apparatuses to make first and second positioning marks on the door frame;

opening the door and removing the first and second marking apparatuses from the door; and using the first and second positioning marks to install a strike plate, deadbolt receiving plate, or electric strike for receiving a door locking member when the door is closed in the door frame.

In any of the above embodiments a pre-labeled positioning template having transposing indicia can be used with either the first or second positioning marks to install the strike plate, deadbolt receiving plate, or electric strike for receiving a door locking member when the door is closed in the door frame.

One embodiment provides a method and apparatus for marking positions for receiving a strike plate, deadbolt receiving plate, or electric strike for receiving a door locking member when the door is closed in the door frame, the door being attached to the frame comprising the steps of: providing a first marking apparatus the first marking apparatus including a first marking point, placing the first marking apparatus in a first screw hole opening for a strike plate, deadbolt receiving plate, or electric strike for receiving a door locking member when the door is closed in the door frame; while the door is closed causing the first marking apparatus to make a first positioning mark on the door frame; opening the door and removing the first marking apparatus from the door; and using the first positioning mark to install a strike plate, deadbolt receiving plate, or electric strike for receiving a door locking member when the door is closed in the door frame.

One embodiment includes the further steps of: after making the first positioning mark on the door frame, placing the first marking apparatus in a second screw hole opening for a strike plate, deadbolt receiving plate, or electric strike for receiving a door locking member when the door is closed in the door frame, and placing the door in a closed state, and while the door is closed causing the first marking apparatus to make a second positioning mark on the door frame; opening the door and removing the first marking apparatus from the door; and using the first and second positioning marks to install a strike plate, deadbolt receiving plate, or electric strike for receiving a door locking member when the door is closed in the door frame.

One embodiment provides a method and apparatus for marking positions for receiving a strike plate, deadbolt receiving plate, or electric strike for receiving a door locking member when the door is closed in the door frame, the door being attached to the frame comprising the steps of: providing first and second marking apparatus the first and second marking apparatuses including first and second marking points, placing the first and second marking apparatuses in first and second screw hole openings of a door locking member; while the door is closed causing the first and second marking apparatuses to make first and second positioning marks on the door frame; opening the door and removing the first and second marking apparatuses from the door; and using the first and second positioning marks to install a strike plate, deadbolt receiving plate, or electric strike for receiving a door locking member when the door is closed in the door frame.

In any of the above embodiments a pre-labeled positioning template having transposing indicia can be used with either the first or second positioning marks to install the a strike plate, deadbolt receiving plate, or electric strike for receiving a door locking member when the door is closed in the door frame.

The drawings constitute a part of this specification and include exemplary embodiments to the invention, which may be embodied in various forms.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein:

FIG. 53 shows a cutaway lower perspective view of the positioning member of FIG. 45 before a user pulls on the pull cord.

FIG. 54 shows another perspective view of the positioning member of FIG. 54 with a user pulling on the pull cord.

FIG. 68 shows a perspective view of the adapter member of FIG. 68 being inserted into an opening of a door frame.

FIG. 69 shows a perspective view of the adapter member of FIG. 66 now inserted into an opening of a door frame.

DETAILED DESCRIPTION

Detailed descriptions of one or more preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in any appropriate system, structure or manner.

Figure 14:
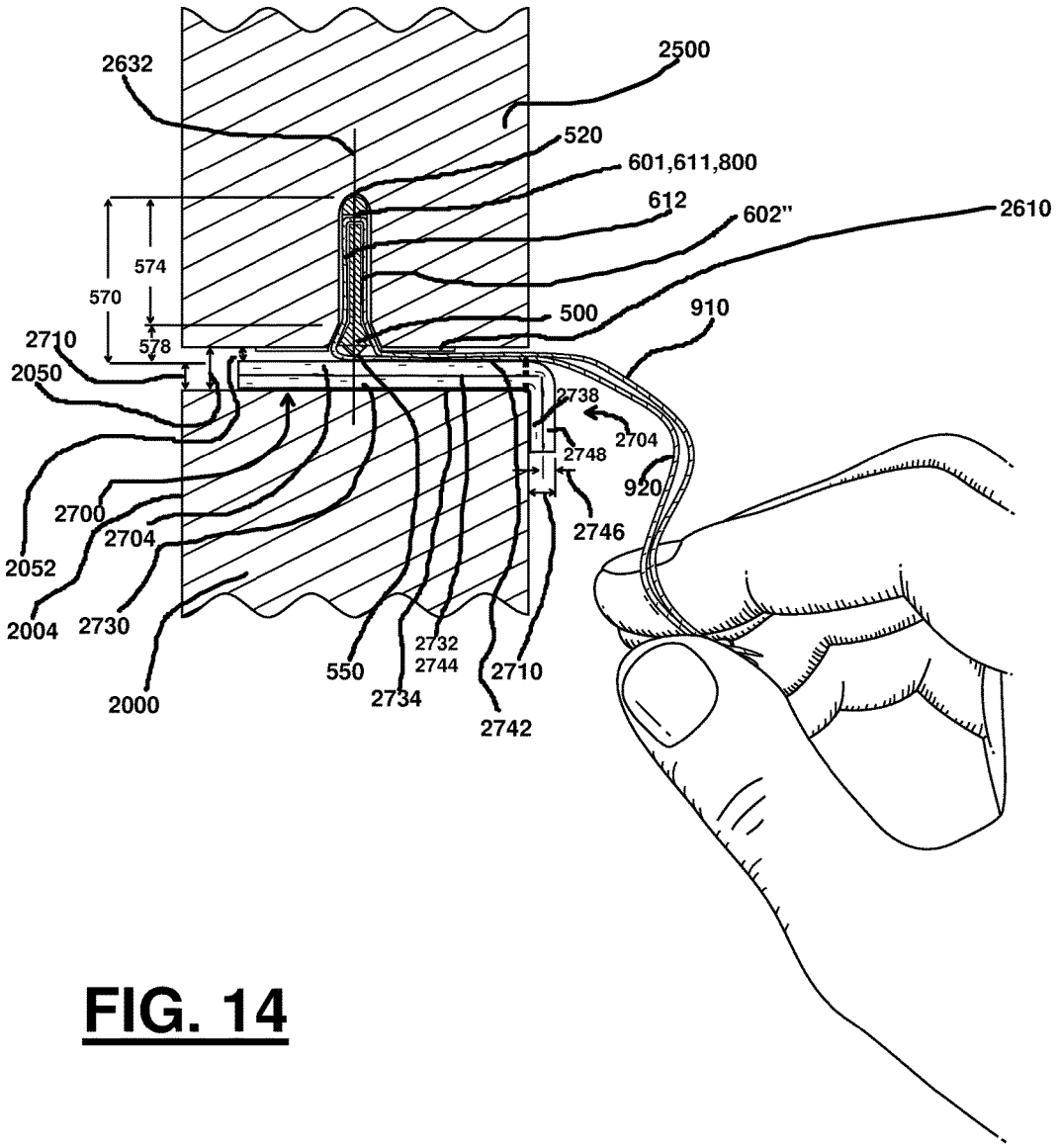
FIG. 14 is a sectional view taken from the lines 15-15 of FIG. 13 before any significant force is put on the pull cord so that the positioning member is still recessed in the opening.
Figure 15:
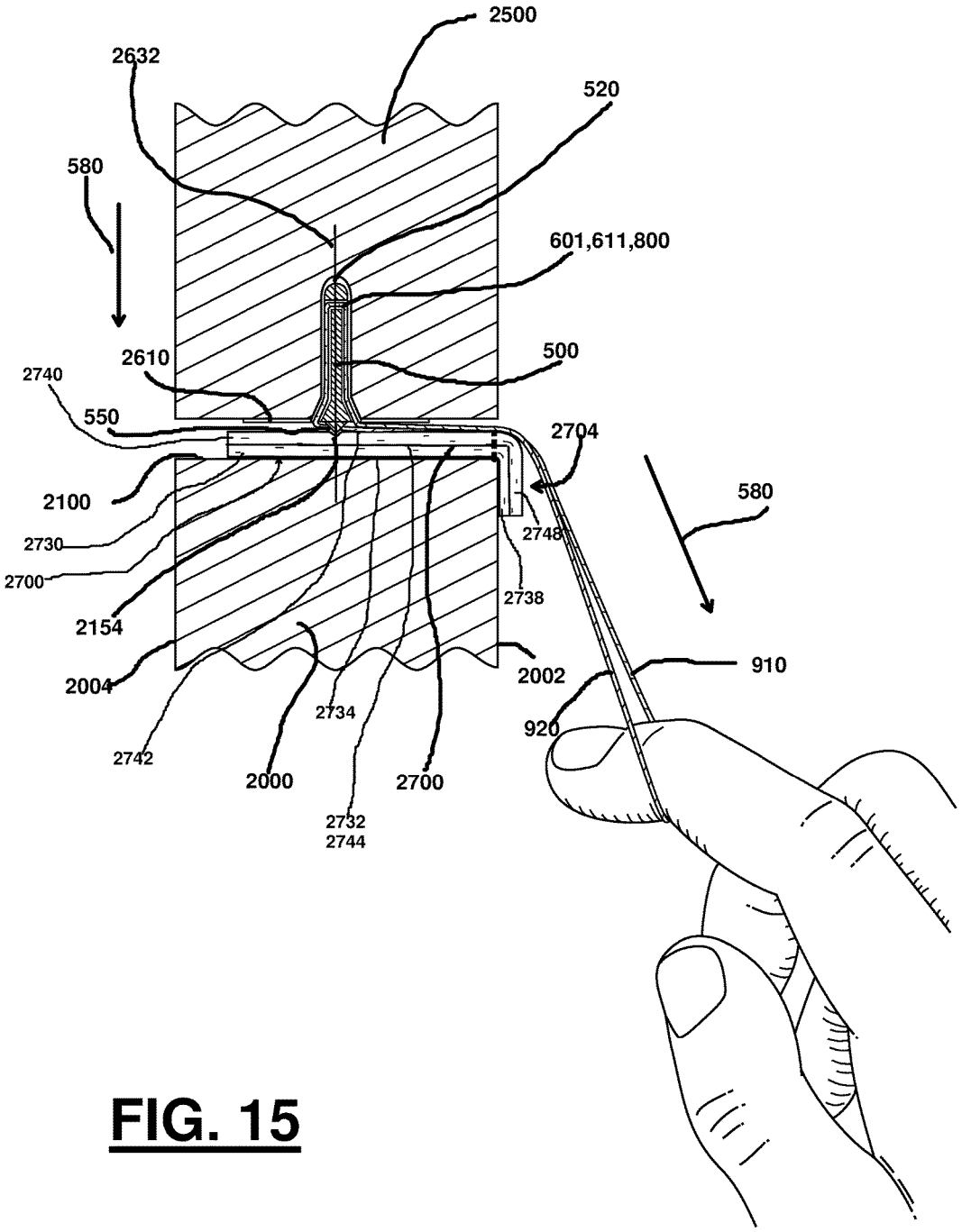
FIG. 15 is a sectional view taken from the lines 15-15 of FIG. 13 after significant force is put on the pull cord so that the positioning member extends from the opening and makes a mark on the marking material.
Figure 16:
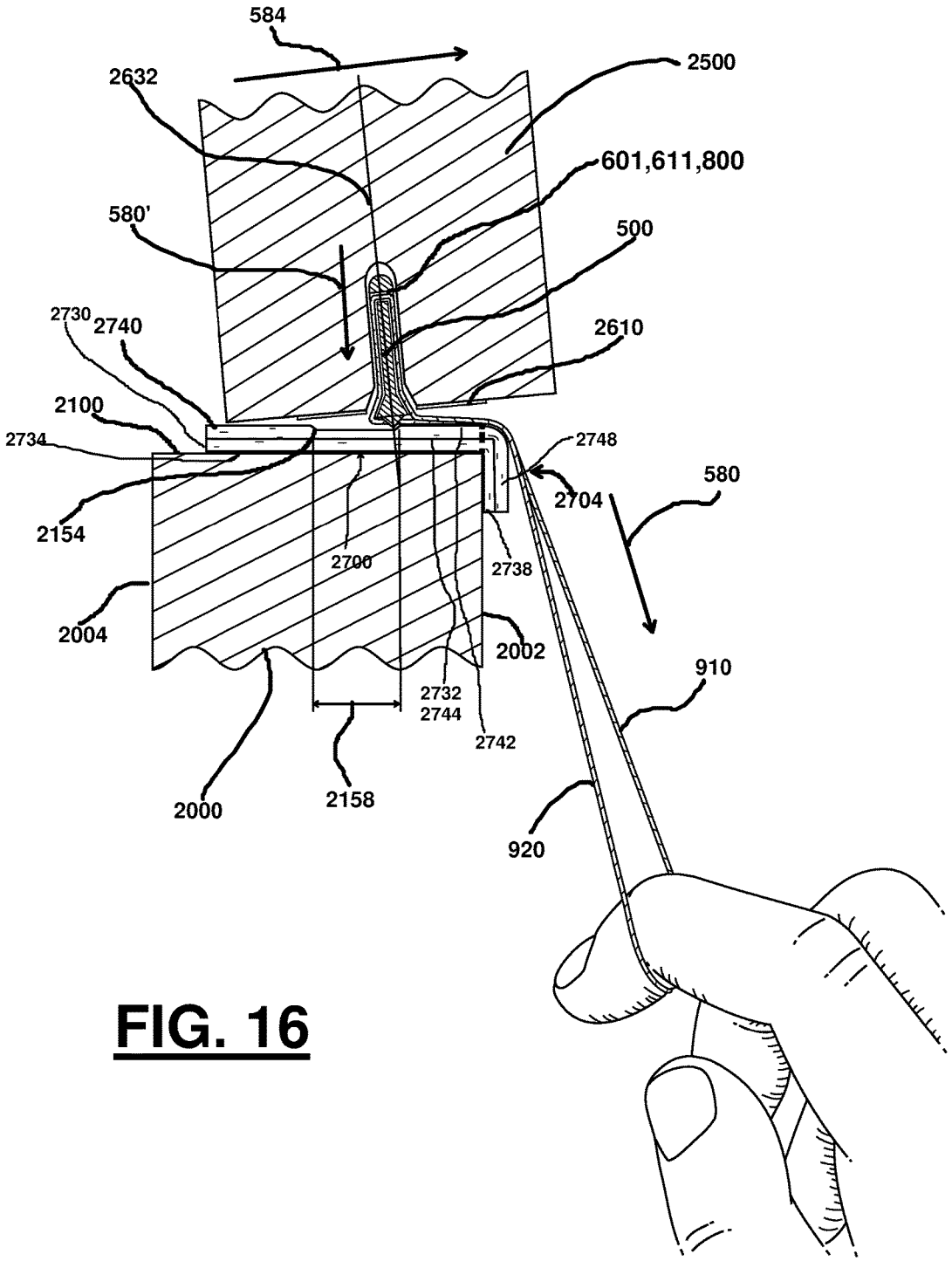
FIG. 16 is a sectional view taken from the lines 15-15 of FIG. 13 after significant force is put on the pull cord so that the positioning member extends from the opening and makes a mark on the marking material, but after the door has been partially opened while maintaining significant force on the pull cord which causes the positioning member to make an extended mark or scratch on the marking material.

FIGS. 1 through 6 show views of one embodiment of positioning member 500 having a small diameter base 530 with length 546, along with an enlarged frustoconical area 560 for the marking tip 550, and with an intermediate sized frustoconical area 590. Length 546 is preferably at least ½ of an inch (1.27 cm) long. In various embodiments length 546 can be at least 0.5, 0.6, 0.7, 0.8, 0.9, 1.0, 1.1, 1.2, 1.25, 1.3, 1.4, 1.5, 1.6, 1.7, 1.8, 1.9, and 2.0 inches (1, 1.25, 1.5, 1.75, 2, 2.25, 2.5, 2.75, 3, 3.25, 3.5, 3.75, 4, 4.25, 4.5, 4.75, and 5 cm). In various embodiments length 546 can be between any to of the above referenced lengths. It has been determined that the longer the length 546 the more accurate the location of the positioning mark made by positioning member 500 as compared to location of longitudinal centerline of the screw hole in which positioning member 500 is inserted when door 2500 is fully closed in frame 2000. Another possible advantage of a longer length 546 is that the longer length 546 can make up the difference for any gap existing between door 2500 and frame 2000 when door 2500 is closed (in this case positioning member 500 can "stick out" slightly to reduce the distance to be spanned for the gap of the screw hole in which positioning member 500 is inserted). Horizontal opening As schematically shown in FIGS. 14-16, in various embodiments, horizontal opening 800 can be located at the ends 601 and 602 of longitudinal grooves 600 and 610—near or adjacent to second end 520 (which second 520 end can be rounded). In these embodiments the rounded portion of second end 520 can push away any shavings or debris as marking member 500 is inserted into a screw hole of door 2500 (which shavings or debris) may be found in screw openings in the door 2500 thereby reducing the risk that such shavings and/or debris will accumulate in grooves 600 and 610 causing marking member 500 to become stuck or lodged in the screw openings (e.g., cannot easily slide longitudinally relative to openings 2620 or 2630) during insertion and/or during a pull. In various embodiments the length 545 to horizontal opening 800 can be less than 50 percent of the length 546. In various embodiments the length 545 can be less than about 45, 40, 35, 30, 25, 20, 15, 12, 10, 8, 6, 5, 4, 3, 2, and 1 percent of the length 546. In various embodiments length 545 can be between any two of the above referenced percentages of the length 546.

In a preferred embodiment, positioning member 500 with enlarged area 560 is symmetrically shaped with pointed area 550 being located on the longitudinal center line 555.

Figure 1:
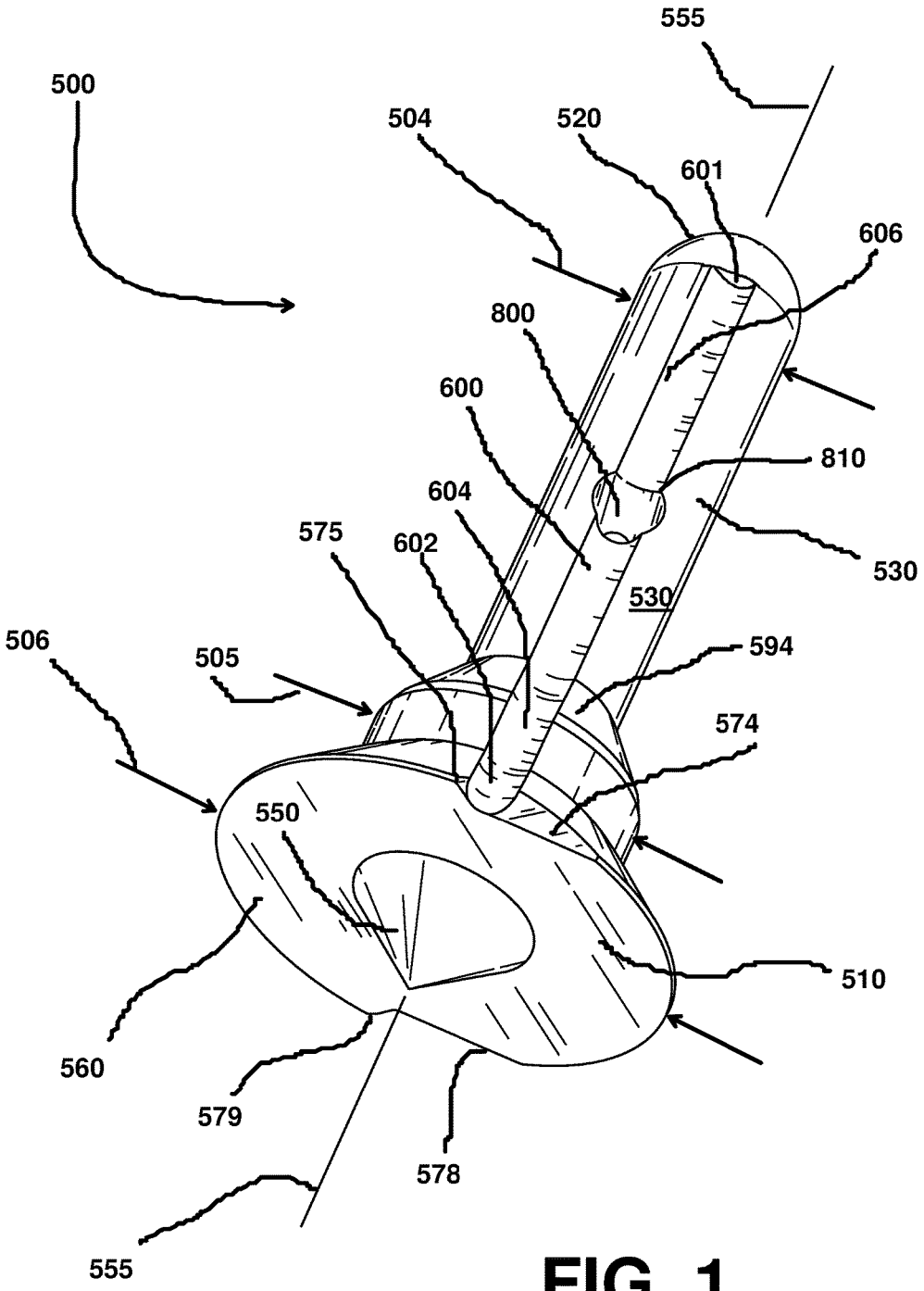
FIG. 1 shows an upper perspective view of a positioning member with a small diameter base, intermediate frusto-conical ear, and enlarged frusto-conical area for the marking tip. This positioning member includes a small diameter positioning surface and an enlarged area for the marking tip.
Figure 2:
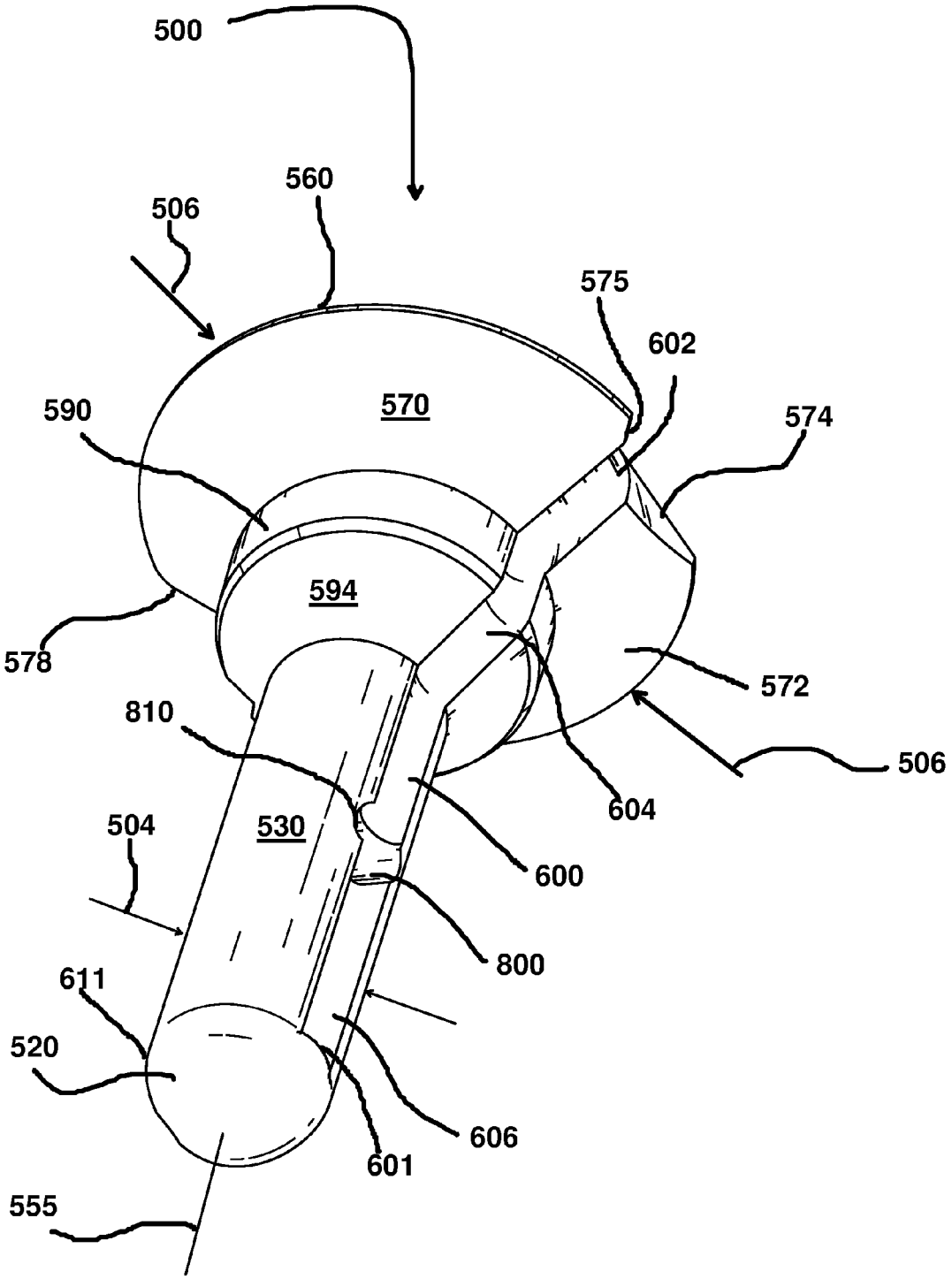
FIG. 2 shows a lower perspective view of the positioning member of FIG. 1.
Figure 3:
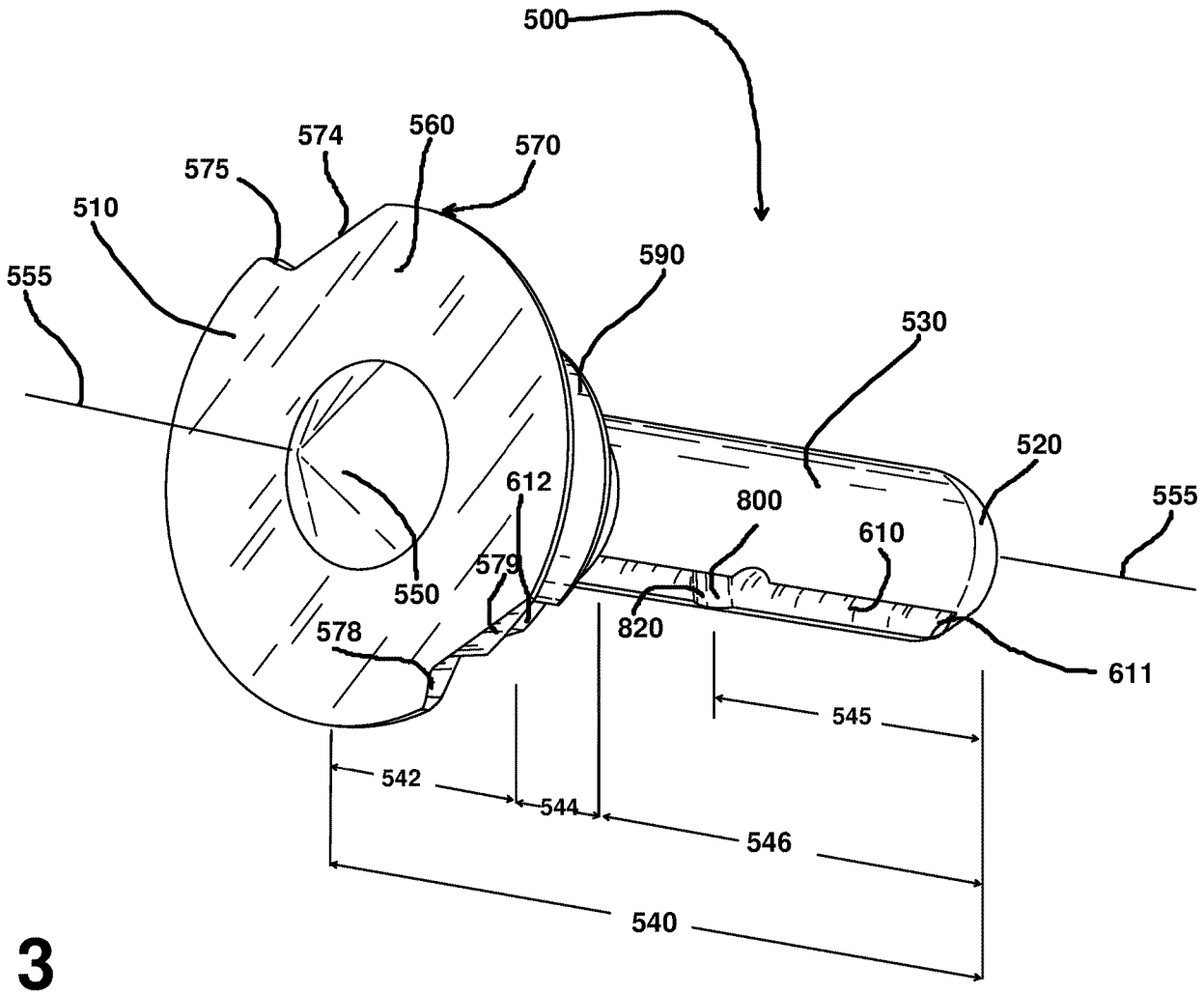
FIG. 3 shows a side perspective view of a positioning member of FIG. 1.
Figure 4:
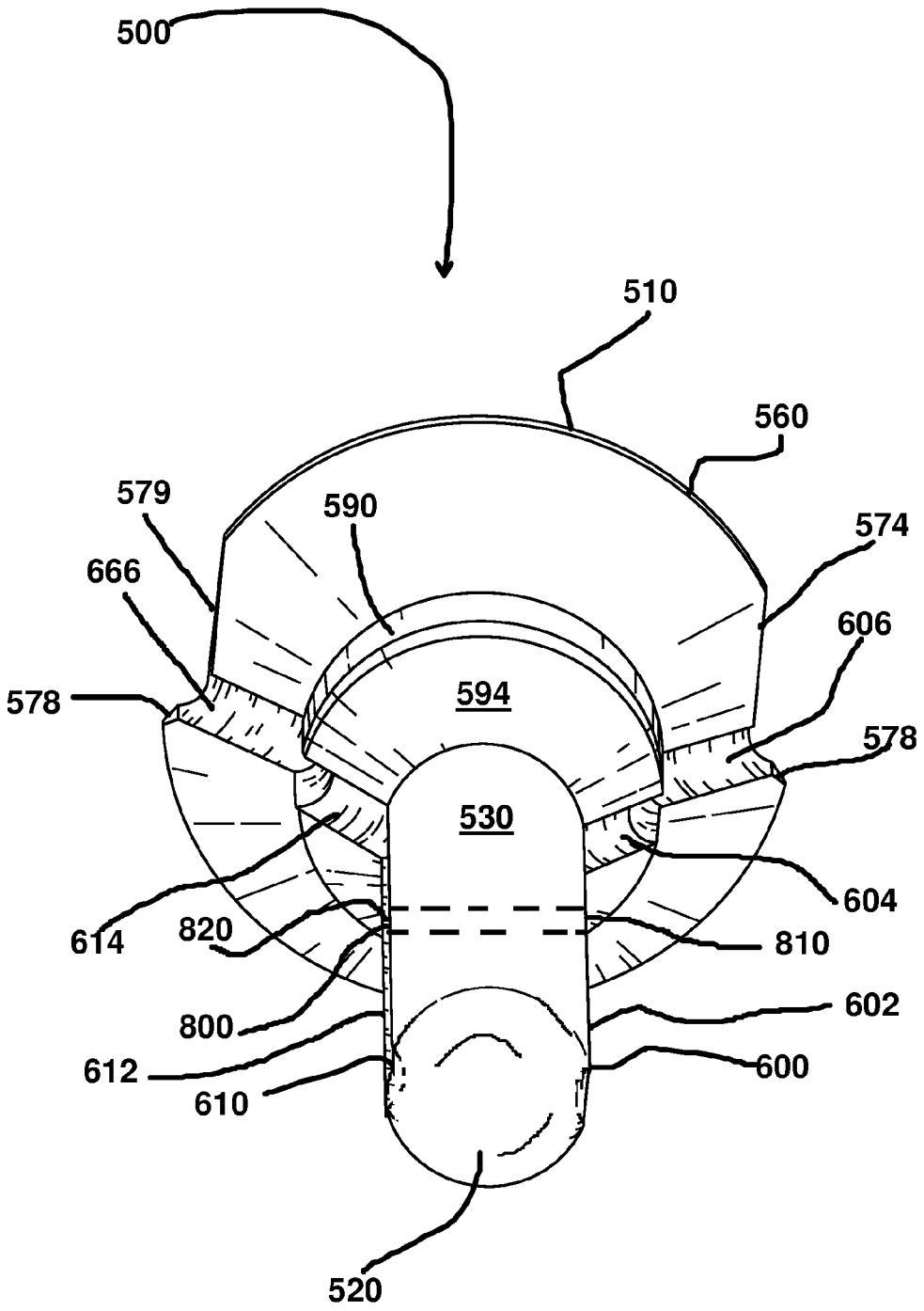
FIG. 4 shows a lower perspective view of a positioning member of FIG. 1.
Figure 5:
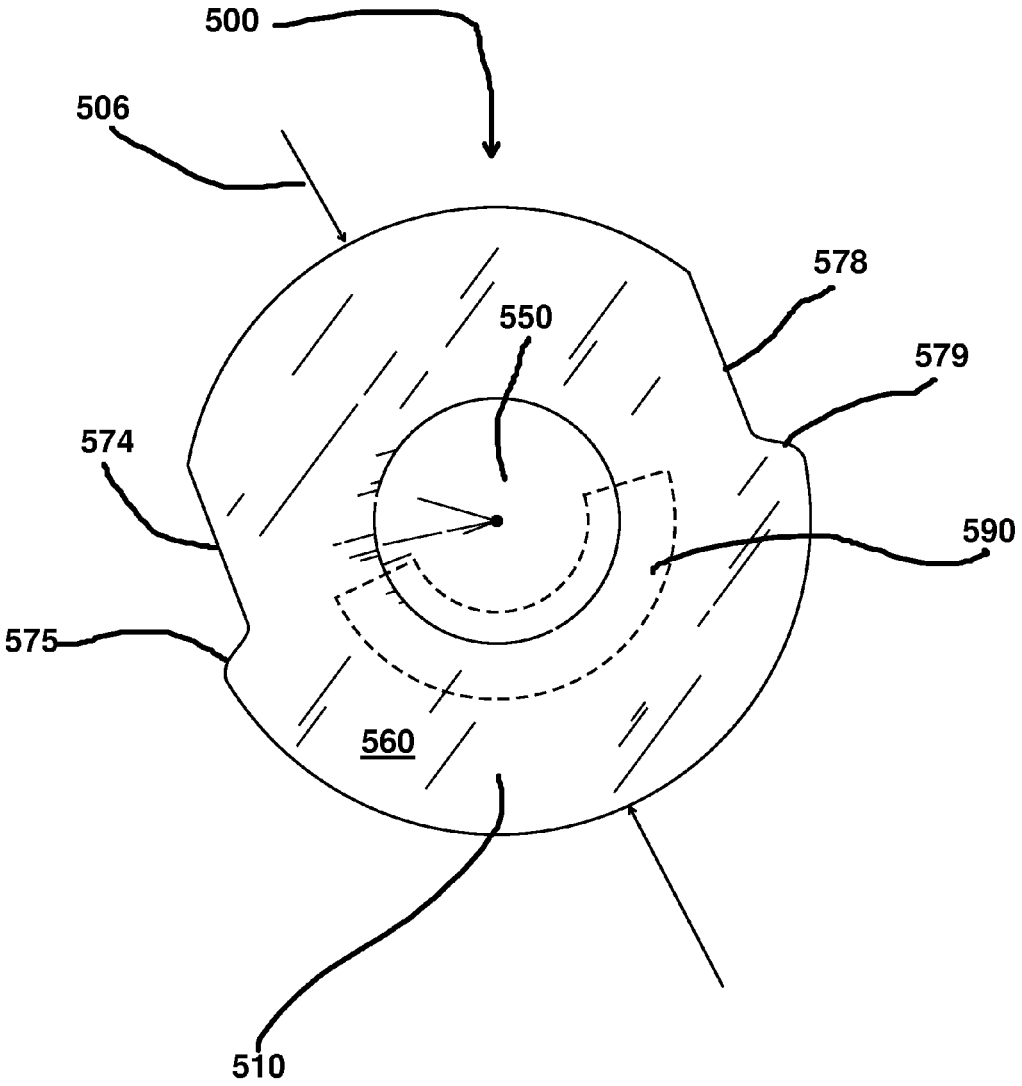
FIG. 5 shows a top view of the positioning member of FIG. 1.

FIG. 1 shows a lower perspective view of a positioning member 500 with a small diameter base 530 and enlarged frusto-conical area 570 for the marking tip 550. This positioning member 550 includes a small diameter (diameter 504) positioning surface 530 and an enlarged area 570 for the marking tip 550 with pull cord 900 being placed in a screw hole at the side of door (such as the screw hole for a deadbolt—with screw removed). FIG. 2 shows an upper perspective view of a positioning member 500 with a small diameter base 530 and enlarged frusto-conical area 570 for the marking tip 550. FIG. 3 shows a side perspective view of a positioning member with a small diameter base and enlarged frusto-conical area for the marking tip. FIG. 4 shows a lower perspective view of a positioning member 500 with a small diameter base 530 and enlarged frusto-conical area 570 for the marking tip 550, rotated thirty degrees from that shown in FIG. 1.

Positioning member 500 can include first end 510, second end 520, and have an overall length 540. In a preferred embodiment second end 520 can be rounded, hemispherically shaped, curved, and/or pointed to allow for easy insertion into an opening. First end 510 can include a pointed area 550 which can act as a marking punch.

Figure 11:
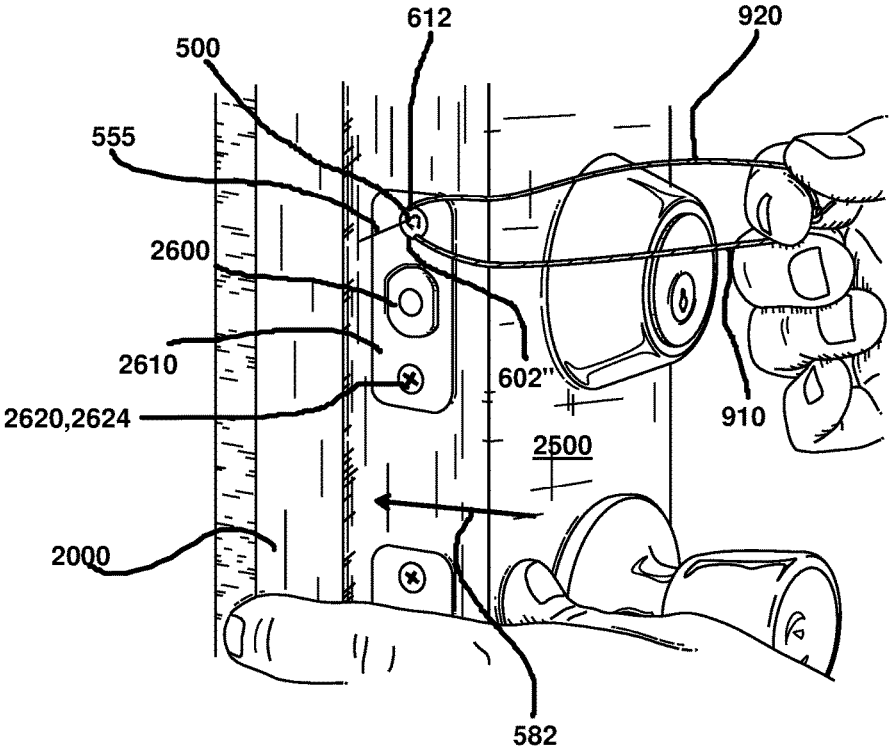
FIG. 11 is a perspective view schematically showing the door being closed while the positioning member is located in the opening from the removed screw of FIG. 8.

In various embodiments positioning member 500 can have enlarged portion 560 with frustoconical section 570 with length 542. A benefit of enlarged frustonical portion 560, as best shown in FIG. 11, is to space apart lines 910 and 920 of flexible member 900 from pointed area 550. Sectional views of 14, 15, and 16 were purposely drawn to show a single section though positioning member 550 including both longitudinal grooves 600 and 610 along with bore 800 and flexible member 900 going through such items. However, this type of sectional view required showing lines 910 and 920 of flexible member 900 as passing close to marking point 550 of positioning member 500. Such would not be a preferred location of positioning member 500 and flexible member 900 as this could have the tendency of either line 910 and/or 920 to impair with marking point 550 making its mark. Instead, the orientation shown in FIG. 11 is preferred where longitudinal grooves 600 and 610 are substantially perpendicular to the pull being made on flexible member 900 (the pull be schematically indicated by arrow 580). Being substantially perpendicular to the direction of pull, will allow the spaced apart grooves 600/602/604/606 and 610/612/614/616 to space apart lines 910 and 920 of flexible member 900 compared to marking point 550 so that both lines 910 and 920 will not interfere with any mark that is being made.

Additionally, positioning member 550 with enlarged frustoconical portion 560 is believed to provide added stability during the process of pulling on flexible member 900 to make a mark. As best shown in FIG. 14 enlarged frustoconical portion 560 allows positioning member 550 to be recessed in a selected one opening (e.g., 2620,2630) of plate 2610 along with providing stability against the tendency of longitudinal centerline 555 to become skewed in related to the particular longitudinal centerline (e.g., 2622,2632) of the opening thereby providing an accurate location for the positioning mark.

In various embodiments enlarged portion 560 can have first 574 and second 578 removed portions. In various embodiments first removed section 574 can include taper portion 575. In various embodiments second removed section 578 can include taper portion 579. First 574 and second 578 removed portions from enlarged portion 560 can resist the sticking of cord 900 and a particular opening where positioning member 500 is being inserted before a positioning mark is made.

Without removed areas 574 and 578, pull cord portions may have the tendency, during a pull (schematically shown in FIGS. 12-16), cord pieces 910 and 920 can tend to get hung-up between enlarged portion 560 of positioning member 500 and wall of plate 2610. Removed sections 574 and 578 have been added to enlarged portion to create gaps between enlarged portion 560 and wall of plate 2610 thereby reducing any tendency of the cord or string pieces 910, 920 from getting hung up during a pull. Such gap areas allow the pulling on cord or string pieces 910, 920 in the direction of arrow 580 to easily cause positioning member 500 to slide in the direction of arrow 580 without any hanging up problems, and making the positioning mark.

In various embodiments positioning member 500 can have intermediate frustoconical section 590 with length 544. In one embodiment intermediate frustoconical section 590 can have tapered portion 594, along with an upper cylindrical portion. In these embodiments intermediate section 590 can include an enlarged area having a "stepped" taper for the enlargement area. This "stepped" taper provides the tool 500 more stability by allowing it 500 to recess further into the mounting screw holes in the door, thereby minimizing skewing or angling of the positioning member 500 (and its centerline 555) when it is pulled out of the screw hole to make the positioning mark in the door frame and facilitating a more accurate position for the location of the positioning mark. The lower stepped taper 594 will resist lateral movement (side to side movement) of positioning member 500 compared to the smallest cross sectional area (i.e., diameter 504). Also, this stepped taper more closely resembles the actual dimension seen in mounting screw holes in which positioning member 500 is inserted. Even though these mounting screw holes are "counter sunk" the countersinking does not exactly match a frusto-conical shape (i.e., part of an ice cream cone shape), but in reality matched a "stepped" frusto-conical shape. Additionally, this stepped taper also increasing resistance to breaking between enlarged area 560 and positioning surface 530 during a pull.

In various embodiments positioning member 500 can have a small diameter base 530 with length 546.

In various embodiments positioning member 500 can include one or more longitudinal grooves 600 and/or 610 which are symmetrically spaced apart 180 degrees from each other. Although not shown in the drawings, in one embodiment three grooves 600, 610, and 620 are provided which are symmetrically spaced apart 120 degrees from each other. In various embodiments longitudinal groove 600 can comprise sub-grooves 602, 604, and 606. In various embodiments longitudinal groove 610 can comprise sub-grooves 612, 614, and 616.

In various embodiments positioning member 500 can include horizontal opening 800, and opening 800 can include first end 810 and second end 820. In various embodiments opening 800 can connect grooves 600 and 610.

Figure 6:
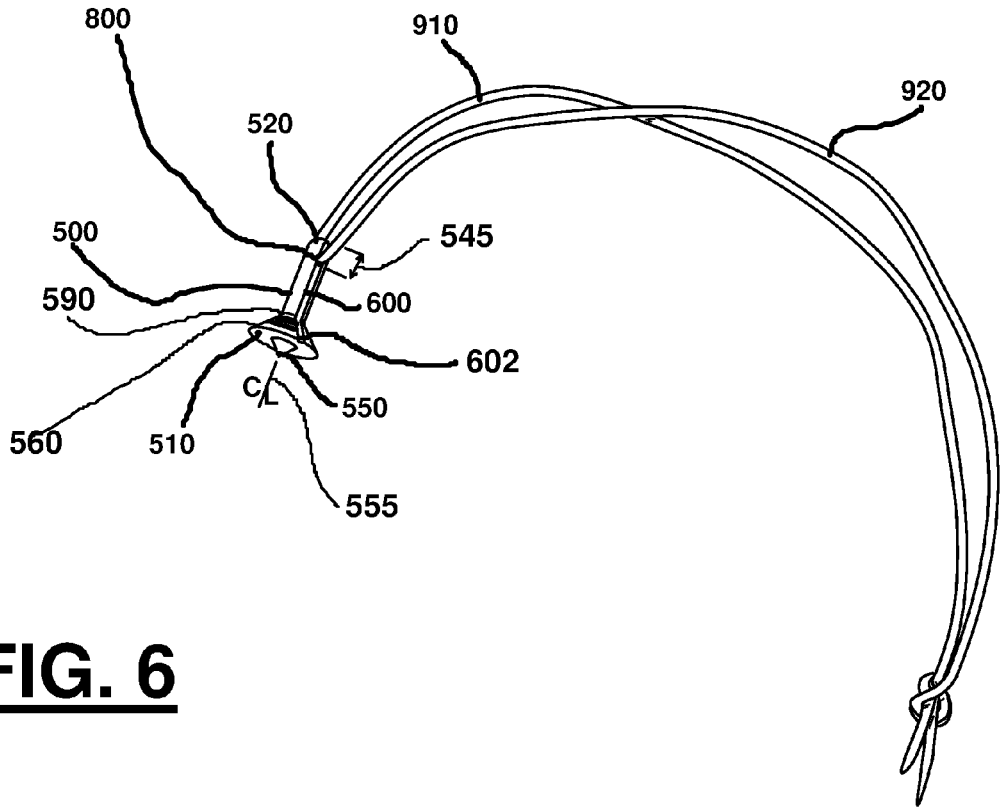
FIG. 6 shows a perspective view of the positioning member of FIGS. 1 through 5 with pull cord.

FIG. 6 shows a perspective view of the positioning member 500 of FIGS. 1 through 4 with pull cord 900.

Method of Marking

FIGS. 8 through 17 show the steps of using a small diameter positioning member 500 with marking tip 550 with flexible member 900 placed in dead bolt 2600 screw hole 2620 at side of door 2500 (with screw for dead bolt 2600 removed) to make a positioning mark.

Increasing the length 546 of marking member 500, reduces the need to decrease the amount of gap between door 2500 and frame 2000 to maintain accuracy in the positioning marks made. In various embodiments the longitudinal depth of existing screw holes 2620 and 2630 for door 2500 supplied by a door manufacturer can be increased, compared to the existing depth provided by the door manufacturer. In various embodiments the method includes the step of increasing the longitudinal depth compared to the manufactured depth by screwing in a screw of longer length than the length of the screws provided by the door manufacturer. In various embodiments this increased depth can be at least 0.1, 0.2, 0.25, 0.3, 0.4, 0.5, 0.6, 0.7, 0.75, 0.8, 0.9 and 1 inches (0.25, 0.5, 0.75, 1, 1.25, 1.5, 1.75, 2, 2.25, 2.5 cm). In various embodiments this length increase can be between any two of the above referenced lengths.

Figure 8:
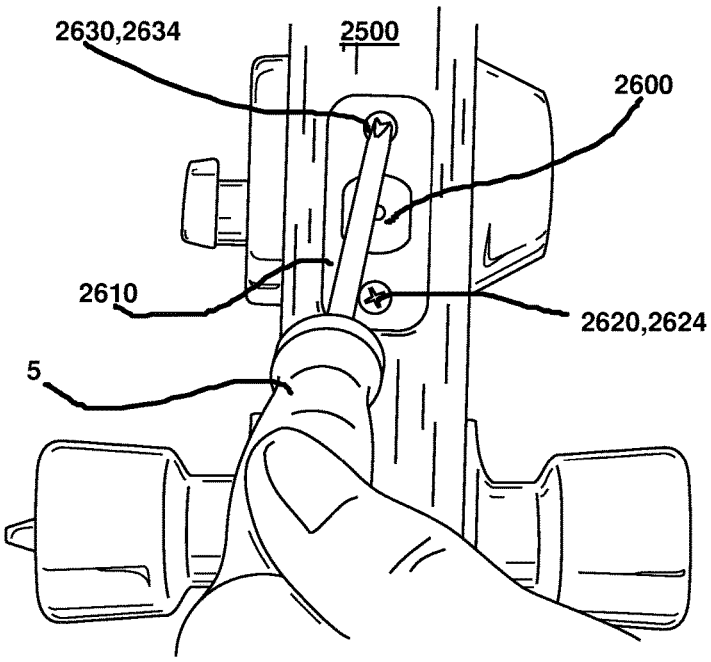
FIG. 8 shows a perspective view of a user removing a screw to provide an opening to insert the positioning member of FIG. 1.
Figure 7:
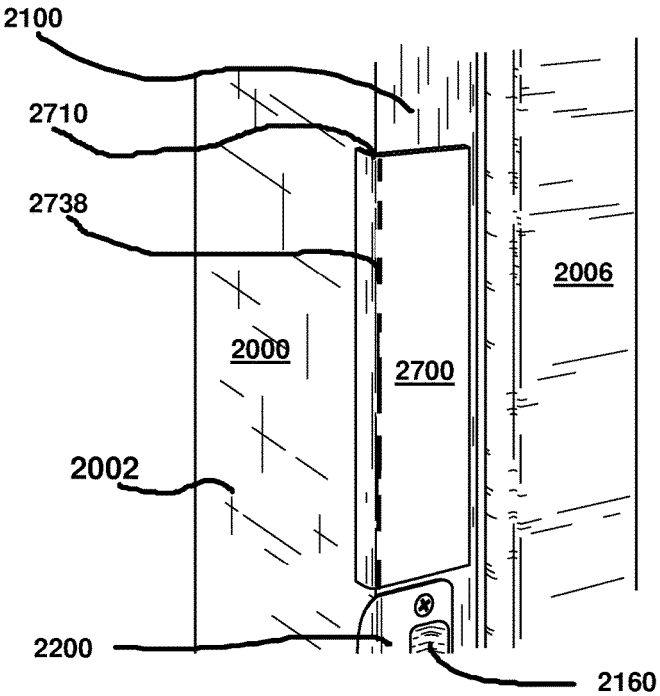
FIG. 7 shows a perspective view of a door frame are with removable marking material placed around the area on which marks are to be made by the positioning member of FIG. 5, and a portion of this removable marking material which can be omitted and/or not used.
Figure 9:
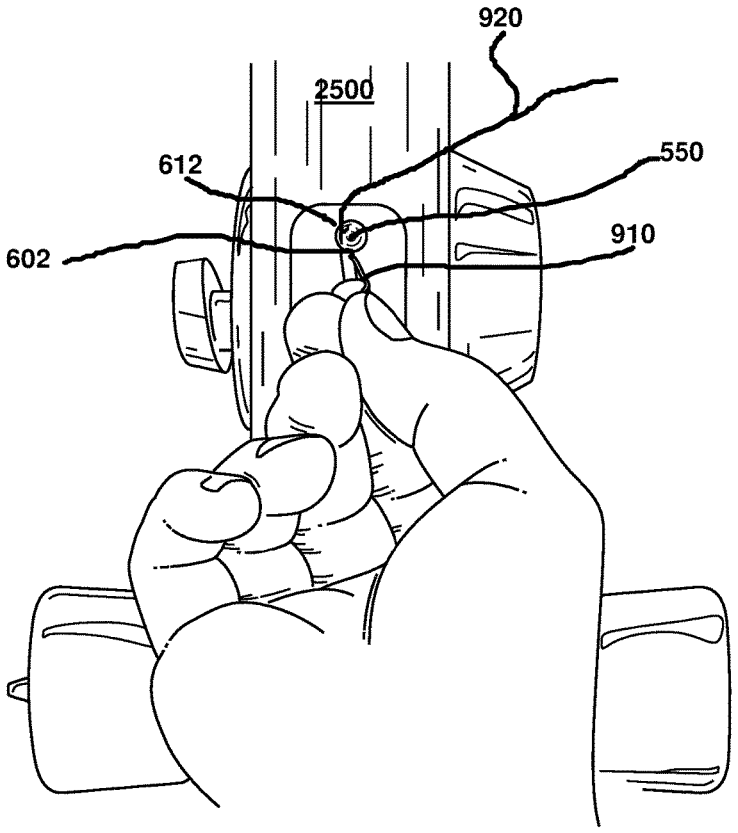
FIG. 9 shows a perspective view of the positioning member of FIG. 1 now inserted in the opening from the removed screw of FIG. 8.
Figure 10:
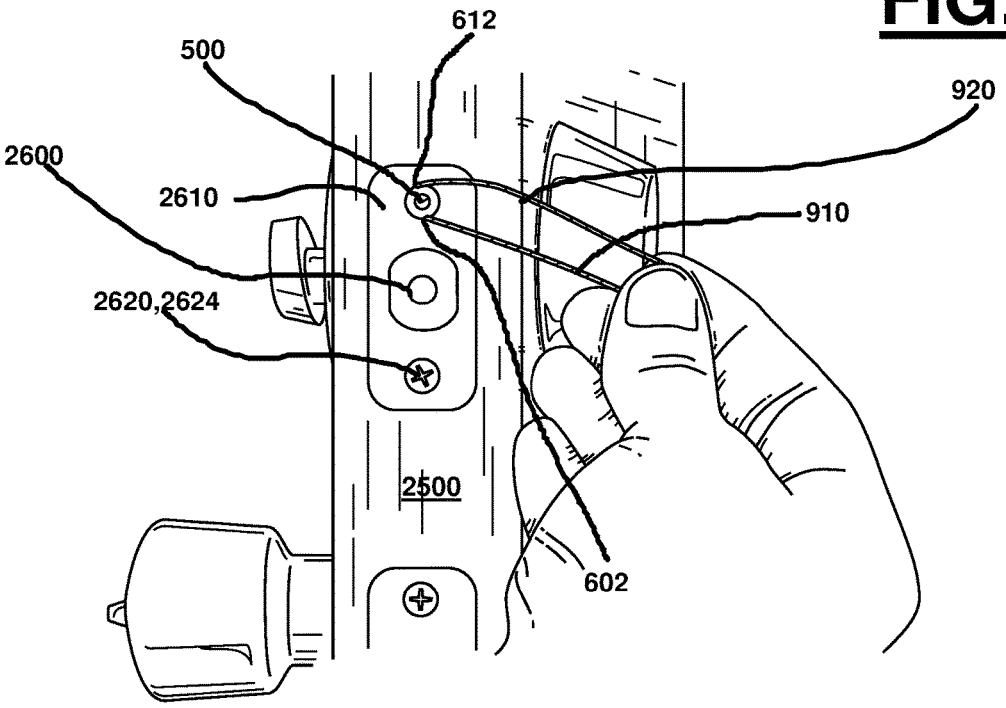
FIG. 10 shows a perspective view of the positioning member of FIG. 1 and door with the pull cord being moved to the side to allow the door to be closed in the door frame.

FIG. 8 shows a perspective view of a user removing a screw 2634 to provide an opening 2630 to insert the positioning member 500. FIG. 9 shows a perspective view of the positioning member 500 with pull cord 900 now inserted in the opening 2630 from the removed screw 2634. FIG. 10 shows a perspective view of the positioning member 500 with the pull cord 900 being moved to the side to allow the door 2500 to be closed in the door frame 2000. FIG. 11 is a perspective view schematically showing the door 2500 being closed (schematically indicated by arrow 582) while the positioning member 500 is located in the opening 2630 from the removed screw 2634.

Figure 12:
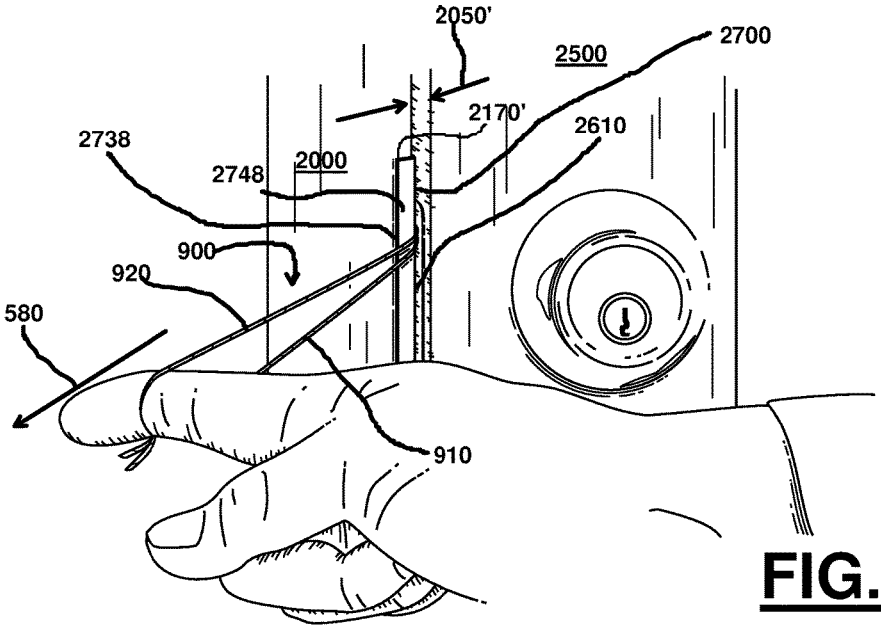
FIG. 12 is a perspective view schematically showing the door now fully and the pull cord being pulled to cause the positioning member to make a positioning mark—showing a relatively small gap between the door and the door frame so that the mark made by the positioning member will generally be at the longitudinal centerline of the opening from the removed screw of FIG. 8.
Figure 13:
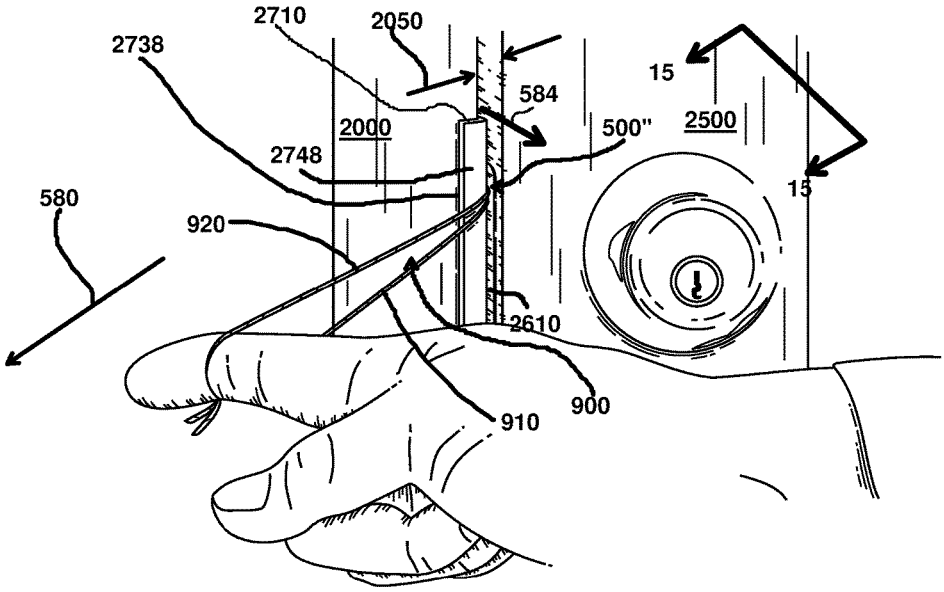
FIG. 13 is a perspective view schematically showing the door now fully and the pull cord being pulled to cause the positioning member to make a positioning mark—showing a relatively large gap between the door and the door frame which gap is reduced by a relatively thick marking material so that the mark made by the positioning member on the thick marking material will generally be at the longitudinal centerline of the opening from the removed screw of FIG. 8.

FIG. 12 is a perspective view schematically showing the door 2500 now fully closed and the pull cord 900 being pulled (schematically indicated by arrow 580) to cause the positioning member 500 to make a positioning mark—showing a relatively small gap 2050 between the door 2500 and the door frame 2000 so that the mark made by the positioning member 500 will generally be at the longitudinal centerline of the opening 2630 from the removed screw 2634. FIG. 13 is a perspective view schematically showing the door 2500 now fully closed and the pull cord 900 being pulled (schematically indicated by arrow 580) to cause the positioning member 500 to make a positioning mark—showing a relatively large gap 2050 between the door 2500 and the door frame 2000 which gap 2050 is reduced by a relatively thick marking tape 2700 so that the mark made by the positioning member 500 on the thick marking tape 2700 will generally be at the longitudinal centerline of the opening 2630 from the removed screw 2634.

In various embodiments the gap between door 2500 and frame 2000 is small enough so that marking tape 2700 does not need to be relatively thick to reduce the gap. In various embodiments a separate gap reducer 2704 can be used in combination with marking tape 2700.

FIG. 14 is a sectional view taken from the lines 15-15 of FIG. 13 before any significant force is put on the pull cord so that the positioning member 500 is still recessed in the opening 2630. In this sectional view it can be seen that removable marking tape 2700 can obtain a relatively large thickness by being formed from a plurality of sections or layers of marking material, such as first section 2730 and second section 2740. First section 2730 can have first side 2732 and second side 2734. Second section 2740 can have first side 2742 and second side 2744. First side 2742 of second section 2740 (and first side 2732 of first section 2730) can be formed of a carbonless type marking surface which is conventionally available, such as that available for conventional duplicate check books. The body of the sections can be of a relatively stiff material such as cardboard, styrofoam, or other relatively stiff materials that still are relatively flexible, and the second sides can include conventionally available adhesives. The carbonless type marking surface shows a clearly demarcated mark when pressure is applied on the surface—and pulling on positioning member 500 with a downward force will create the pressure to cause a clearly demarcated mark to be formed on the surfaces. Alternatively, a relative thin marking tape 2700 can be used with one or more layers of gap reducer 2704 material.

Although FIGS. 14-16 show a recessed/gouged out area in second section 2740, carbonless paper surface will reduce the need to pull hard enough to cause marking point 550 of positioning member 500 to gouge this surface—instead merely applying a pressure on the surface will create a clearly demarcated mark. Also shown in FIGS. 14-16 are removable portions 2738 and 2748 (schematically indicated by the vertical dashed lines in these figures). These portions 2738 and 2748 can be removed if the user does not desire overlap. However, the user may desire the overlap to protect the surface upon which pull cord 900 slides over during a downward pull. It is expected that the user can place as many sectional layers (e.g., 2730,2740, or more layers) to reduce the gap 2052 that the positioning member 500 must longitudinally traverse during a pull before making the mark (which is expected to increase the accuracy of the position of the mark ultimately made and used. Additionally, the edges sections 2730 and 2740 can be beveled or tapered so that tight gaps between the door 2500 and the door frame 2000 will allow the door to more easily pass the edge of gap reducer 2704 without tending to remove gap reducer 2704 from door frame 2000.

FIG. 15 is a sectional view taken from the lines 15-15 of FIG. 13 after significant force is put on the pull cord 900 (schematically indicated by arrow 580) so that the positioning member 500 extends from the opening 2630 and makes a mark 2154 on the marking tape 2700. FIG. 16 is a sectional view taken from the lines 15-15 of FIG. 13 after significant force (schematically indicated by arrow 580) is put on the pull cord 900 so that the positioning member 500 extends from the opening 2630 and makes a mark 2154 on the marking tape 2700, but after the door 2500 has been partially opened (schematically indicated by arrow 584) while maintaining significant force on the pull cord 900 (schematically indicated by arrow 580) which causes the positioning member 500 to make an extended mark or scratch 2154 on the marking tape 2700.

Figure 17:
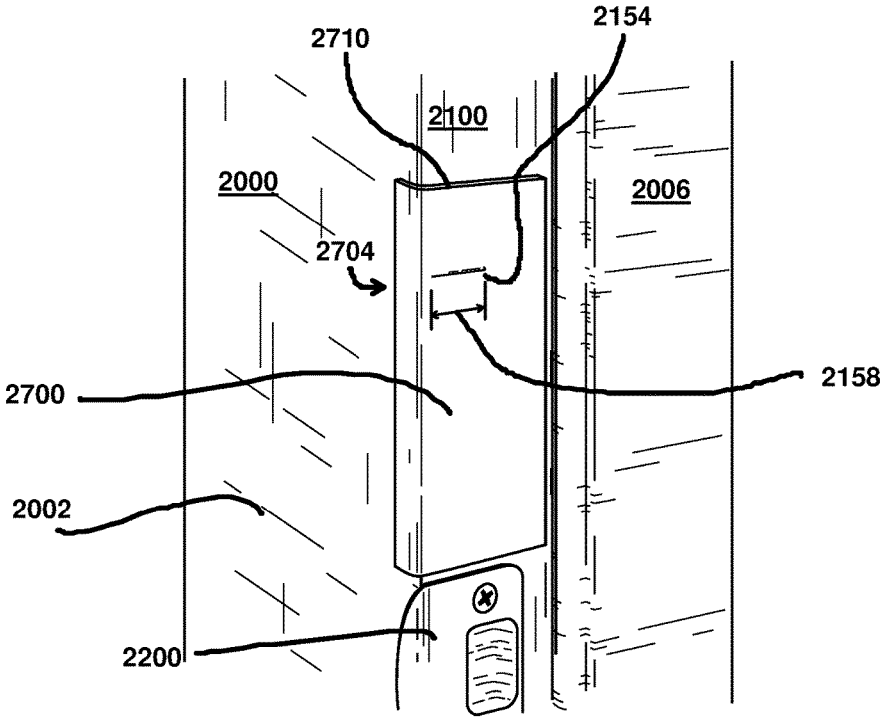
FIG. 17 shows a perspective view of a door frame with an extended mark made on the removable marking material.

FIG. 17 shows a perspective view of a door frame 2000 with an extended mark 2158 made on the removable marking tape 2700. As will be shown in FIG. 22, mark 2154 is located at the beginning of the extended mark 2158, and extended mark 2158 is used to better locate mark 2154.

Figure 18:
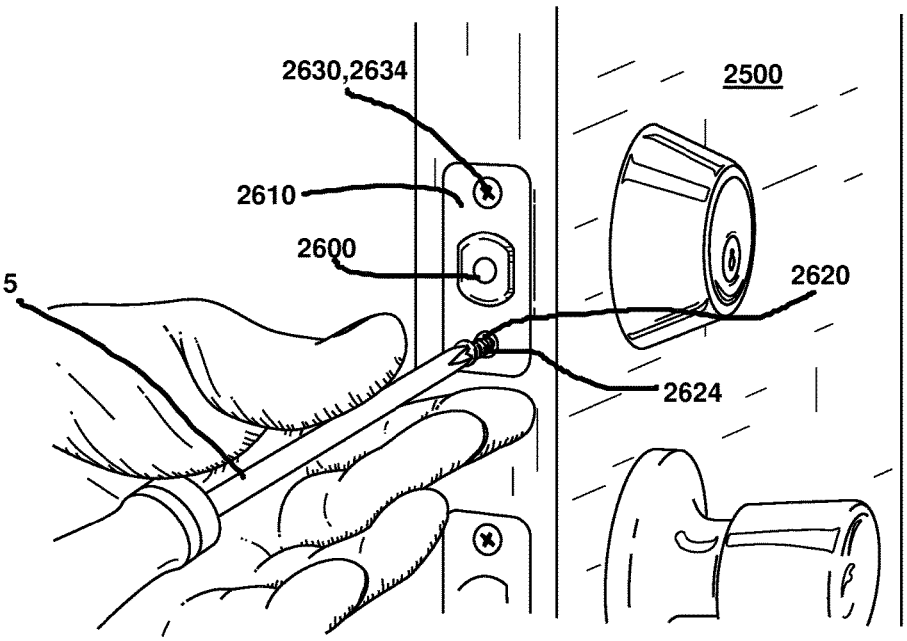
FIG. 18 shows a perspective view of a user removing a second screw to provide a second opening to insert the positioning member of FIG. 1.
Figure 19:
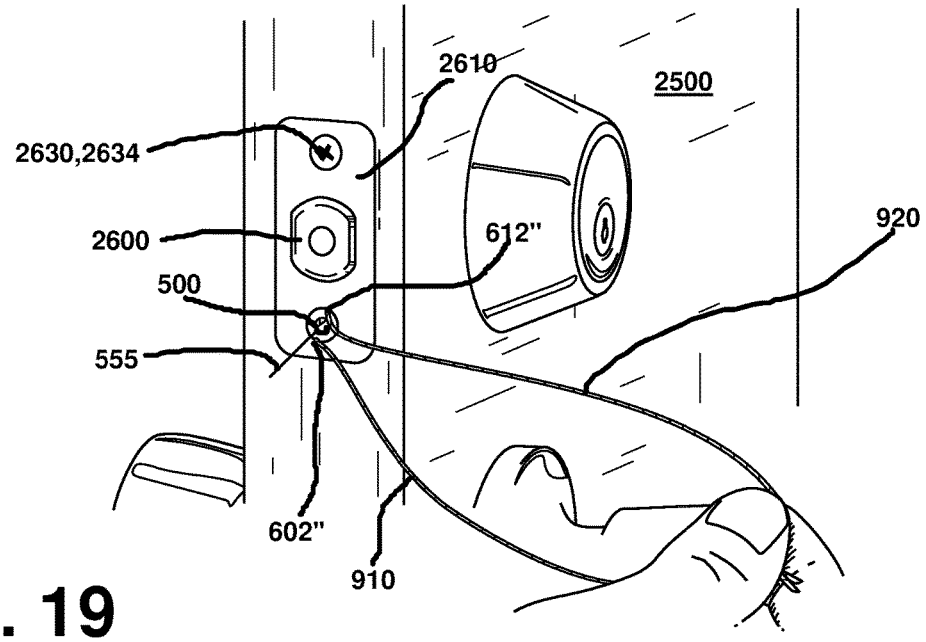
FIG. 19 shows a perspective view of the positioning member of FIG. 1 now inserted in the second opening from the removed second screw.
Figure 20:
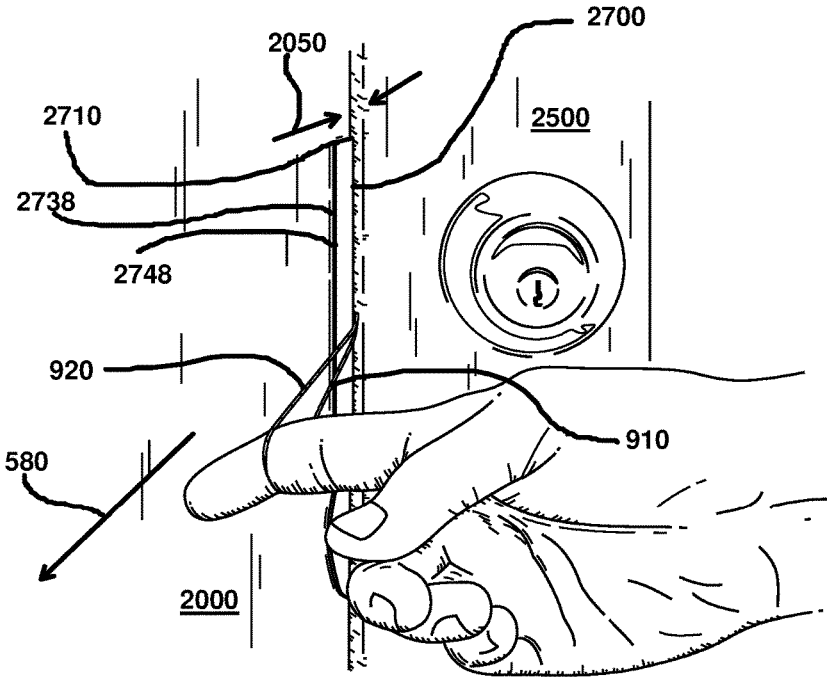
FIG. 20 is a perspective view schematically showing the door now fully closed and the pull cord being pulled to cause the positioning member to make a second positioning mark.

A similar procedure can be used for making a second positioning mark 2152 (schematically shown in FIGS. 18 through 21). FIG. 18 shows a perspective view of a user removing a second screw 2624 to provide a second opening 2620 to insert the positioning member 500. FIG. 19 shows a perspective view of the positioning member 500 now inserted in the second opening 2620 from the removed second screw 2624. FIG. 20 is a perspective view schematically showing the door 2500 now fully closed and the pull cord 900 being pulled (schematically indicated by arrow 580) to cause the positioning member 500 to make a second positioning mark 2150 on door frame 2000.

Figure 21:
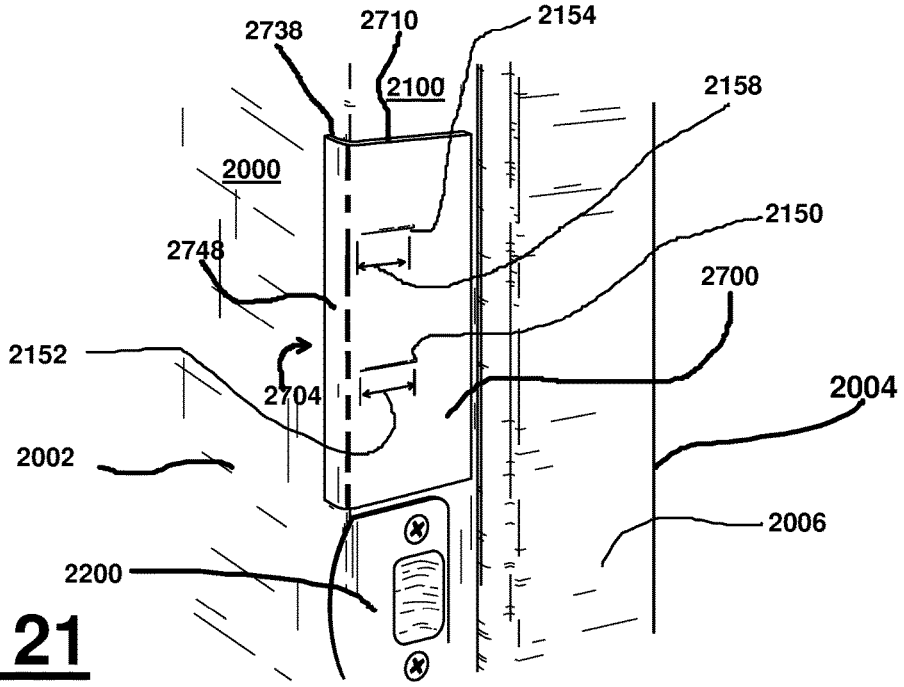
FIG. 21 shows a perspective view of a door frame with two an extended marks made on the removable marking material.

FIG. 21 shows a perspective view of a door frame 200 with two extended marks 2150 and 2154 made on the removable marking tape 2700. As will be shown in FIG. 22, mark 2154 is located at the beginning of the extended mark 2158, and extended mark 2158 is used to better locate mark 2154; and mark 2164 is located at the beginning of the extended mark 2168, and extended mark 2168 is used to better locate mark 2164.

Figure 22:
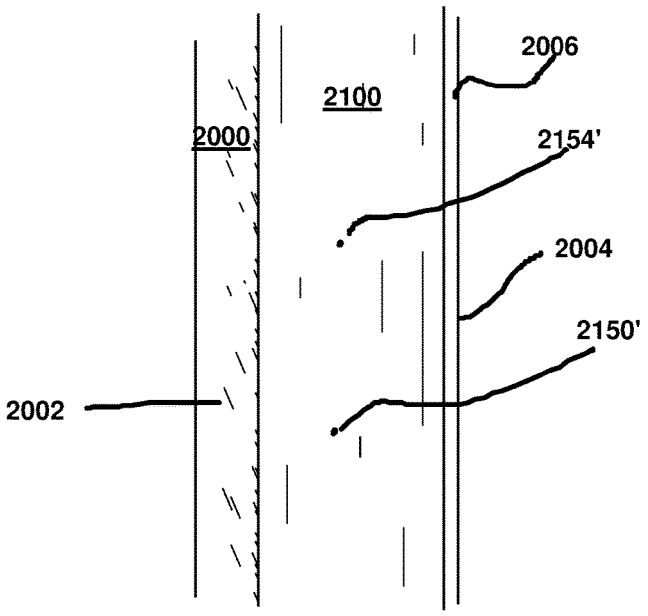
FIG. 22 shows a perspective view of a door frame with two drilled openings through the door frame made at the beginning of the extended marks made by the positioning member on the removable marking material. In this embodiment it is assumed that the holes for the door locking member line up completely with the holes for the strike plate, deadbolt receiving plate, or electric strike so that no transposition template is required for transferring proper drill hole locations for the strike plate, deadbolt receiving plate, or electric strike in the door frame based on the marks made by the positioning member being pulled while in the screw holes for the door locking member in the door.

FIG. 22 shows a perspective view of a door frame 2000 with two drilled openings 2150' and 2154' through the door frame 2000 made at the beginning of the extended marks (respectively 2152 and 2158) and made by the positioning member 500 on the removable marking material 2700. In this embodiment it is assumed that the holes 2620,2630 for the deadbolt 2600 line up completely with the holes (respectively 2252 and 2456) for the deadbolt receiving plate 2204 so that no template is required to be used to transfer the drill holes 2150 and 2154 for the deadbolt receiving plate 2204 based on the marks 2150 and 2154 made by the positioning member 500 while in the screw holes 2620 and 2630 for the deadbolt member 2600 in the door 2500.

One embodiment provides a method and apparatus for marking positions for receiving or strike plates on door frame 2000, the door being attached to a frame comprising the steps of:

(a) providing a first marking apparatus 500 the first marking apparatus including a first marking point 550, (b) placing the first marking apparatus 500 in a first opening 2630 for a latch or deadbolt mechanism for the door 2500;

(c) while the first marking apparatus 500 is in the first opening 2630, closing the door 2500 in the door frame 2000;

(d) while the door 2500 is closed, applying force on the first marking apparatus 500 causing it to place a mark 2156 on the side 2100 of door frame 2000;

(e) opening the door 2500 and removing the first marking apparatus 500 from the door; and (f) using the first positioning mark 2156 to install a strike plate 2200 (or deadbolt receiving plate 2204 or electric strike 2206) on the door frame 2000 for receiving the door locking member 2600.

One embodiment includes the further steps of: after step "e" placing the first marking apparatus 500 in a second opening 2620, closing the door 2500, and while the door is closed, applying force on the first marking apparatus 500 causing it to place a second mark 2150 on the side 2100 of door frame 2000 for locating the installation of a strike plate 2200 (or deadbolt receiving plate 2204 or electric strike 2206), and during step "f" using both the first and second positioning marks 2156 and 2150 to install strike plate 2200 (or deadbolt receiving plate 2204 or electric strike 2206).

One embodiment provides a method and apparatus for marking positions for installing strike plates 2200 (or deadbolt receiving plates 2204 or electric strikes 2206) on door frame 2000, the door 2500 being attached to a frame 2000 comprising the steps of:

(a) providing a first marking apparatus 500 the first marking apparatus including a first marking point 550, and providing a second marking apparatus 500', the second marking apparatus including a second marking point 550';

(b) placing the first marking apparatus 500 in a first opening 2630 for a latch or deadbolt mechanism 2600 for the door 2500, and placing the second marking apparatus 500' in a second opening 2620 for a latch or deadbolt mechanism 2600 for the door 2500;

(c) while the first marking apparatus 500 is in the first opening 2630 and the second marking apparatus 500' in a second opening 2620, closing the door 2500 in the door frame 2000;

(d) while the door 2500 is closed, applying force on the first marking apparatus 500 causing it to place a mark 2156 on the side 2100 of door frame 2000;

(e) while the door 2500 is closed, applying force on the second marking apparatus 500' causing it to place a mark 2150 on the side 2100 of door frame 2000;

(f) opening the door 2500 and removing the first and second marking apparatuses 500, 500' from the door; and (f) using the first and second positioning marks 2156, 2150 to install a strike plate 2200 (or deadbolt receiving plate 2204 or electric strike 2206) on the door frame 2000 for receiving a door locking member 2600.

One embodiment provides a method and apparatus for marking positions for receiving or strike plates on door frame 2000, the door 2500 being attached to a frame comprising the steps of:

(a) providing a first marking apparatus 500 the first marking apparatus including a first marking point 550, (b) placing the first marking apparatus 500 in a first opening 2630 for a latch or deadbolt mechanism for the door 2500;

(c) while the first marking apparatus 500 is in the first opening 2630, closing the door 2500 in the door frame 2000;

(d) while the door 2500 is closed, applying force on the first marking apparatus 500 causing it to place a mark 2156 on the side 2100 of door frame 2000;

(e) opening the door 2500 and removing the first marking apparatus 500 from the door; and (f) using the first positioning mark 2156 to install a plate 2200 on the door frame 2000 for receiving a door locking member 2600.

In one embodiment, screw holes for plate 2200 are drilled in exactly the same locations as positioning marks 2152 and 2154. In this embodiment it is assumed that the holes for strike plate 2200 (or deadbolt receiving plate 2204) on door frame 2000 line up completely with the screw holes 2620 and 2630 for the door locking mechanism 2600 so that no transition is required between the proper drill holes for plate 2200 on door frame 2000 based on the positioning marks 2152 and 2154 made by positioning member 500 while in screw holes 2620 and 2630 for the door locking member 2600 in the door 2500.

However, in many cases the proper locations for drilling the screw holes in the door frame 2000 do not match up exactly with the corresponding positioning marks 2152 and 2154 made by positioning member 500 when respectively in screw holes 2620 and 2630. In these non-matching cases a simple and easy method and apparatus will be needed for transposing the proper locations of the screw holes to be drilled in the door frame 2000 from the corresponding positioning marks 2152 and 2154 made by positioning member 500 when respectively in screw holes 2620 and 2630.

Sometimes the door 2500 and/or the door locking member 2600 do not line-up with and/or are not parallel to the door frame 2000 when fully closed. In various embodiments misalignment can occur in up to three misalignment conditions: (1) misalignment in vertical position; (2) misalignment in horizontal position; and (3) misalignment relative rotation or skewing from a vertical line. One or more of the referenced misalignment conditions can cause difficulties in proper locking of a door 2500 in door frame 2000 with a strike plate 2200 (or deadbolt receiving plate 2204 or electric strike 2206). In various embodiments the positioning marks 2150 and 2154 created by positioning member 500 can be used to properly position the location of the screw holes for the strike plate 2200 (or deadbolt receiving plate 2204 or electric strike 2206) which in turn address and correct for one or more of the above referenced misalignment conditions.

In various embodiments, in a correctly aligned condition between the strike plate 2200 (or deadbolt receiving plate 2204 or electric strike 2206) and the door locking member 2600, the mounting screw holes for the strike plate 2200 (or deadbolt receiving plate 2204 or electric strike 2206) do not line up exactly with the mounting screw holes 2620,2630 for the strike or latch locking member 2600, such as when the strike plate 2200 (or deadbolt receiving plate 2204 or electric strike 2206) are different sizes compared to the door locking member 2600.

In these cases the differences in lining up of the various mounting screw holes in a correctly aligned condition can be addressed using the following procedure which utilizes the fact that mounting openings for strike plate 2200 (or deadbolt receiving plate 2204 or electric strike 2206) are typically symmetrically spaced about center point on a line for such strike plate 2200 (or deadbolt receiving plate 2204 or electric strike 2206). Such symmetrical spacing causes the mounting screw holes for such items to also be symmetrically spaced about the same center point.

In various embodiments the user can use positioning member 500 to create two positioning marks 2150 and 2154. The two positioning marks 2150 and 2154 can be placed directly on the door frame 2000, or directly placed on a marking tape 2700 previously placed the doorframe 2000. In various embodiments, the location of the center point between said two positioning marks 2150 and 2154 made by positioning member 500 can be visually approximated by the user. In various embodiments the location of the center point between positioning marks 2150 and 2154 can be identified using a straight edge and/or measuring device such as a ruler and/or other measuring device.

In various embodiments the plurality of positioning marks 2150 and 2154 made by the positioning member 500 can be used to locate a center point between said two positioning marks 2150 and 2154, and said center point can further be used to identify the correctly aligned locations for the mounting screw holes 2152 and 2156 for the strike plate 2200 and/or strike 2200' to be installed on door frame 2000 for proper alignment with door locking member 2600 when door 2500 is closed in door frame 2000.

In various embodiments the plurality of positioning marks 2150 and 2154 made by positioning member 500 can be used to locate a center point between said two positioning marks 2150 and 2154, and said center point can further be used to identify the correctly aligned vertical locations for the mounting screw holes 2152 and 2156 for the strike plate 2200 and/or strike 2200'.

Figure 23:
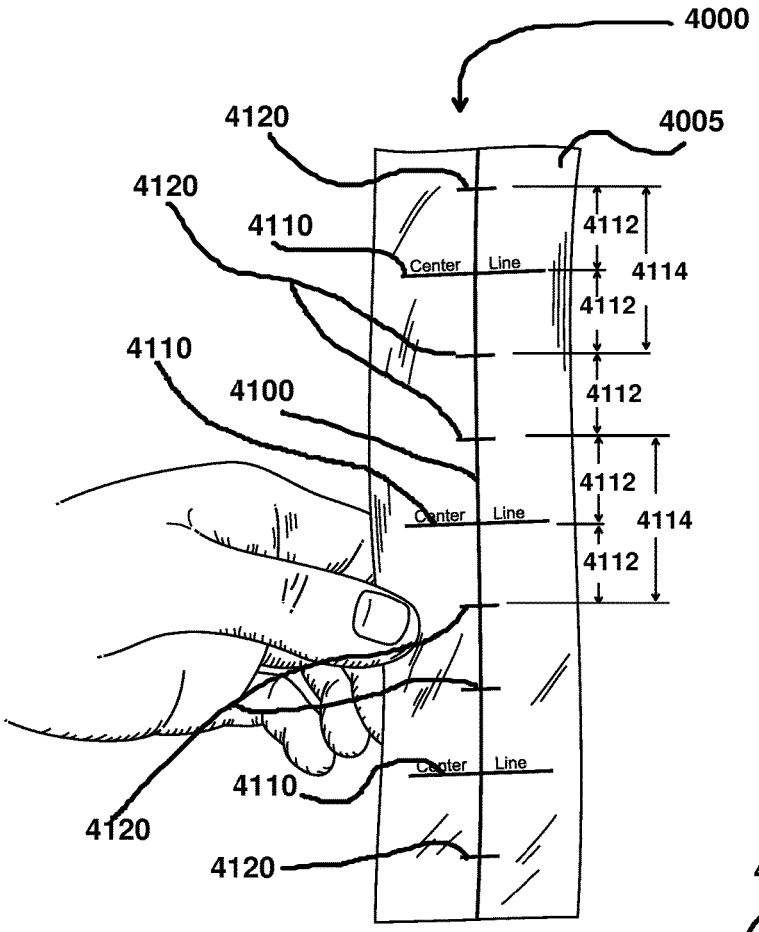
FIG. 23 shows one embodiment of mapping tape.
Figure 24:
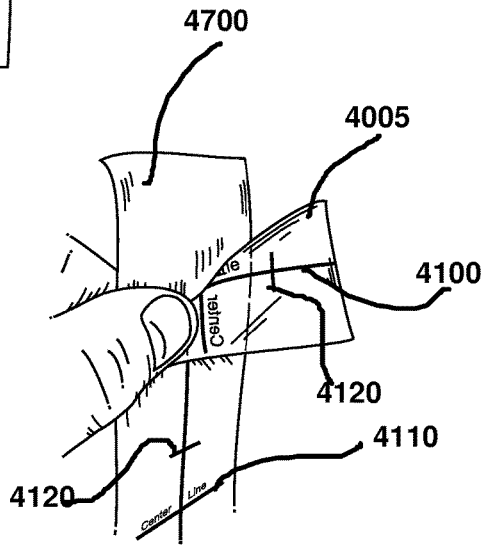
FIG. 24 shows a perspective view of the mapping tape of FIG. 23 being removed from its backing so that it can be applied against the positioning marks made by positioning member.
Figure 25:
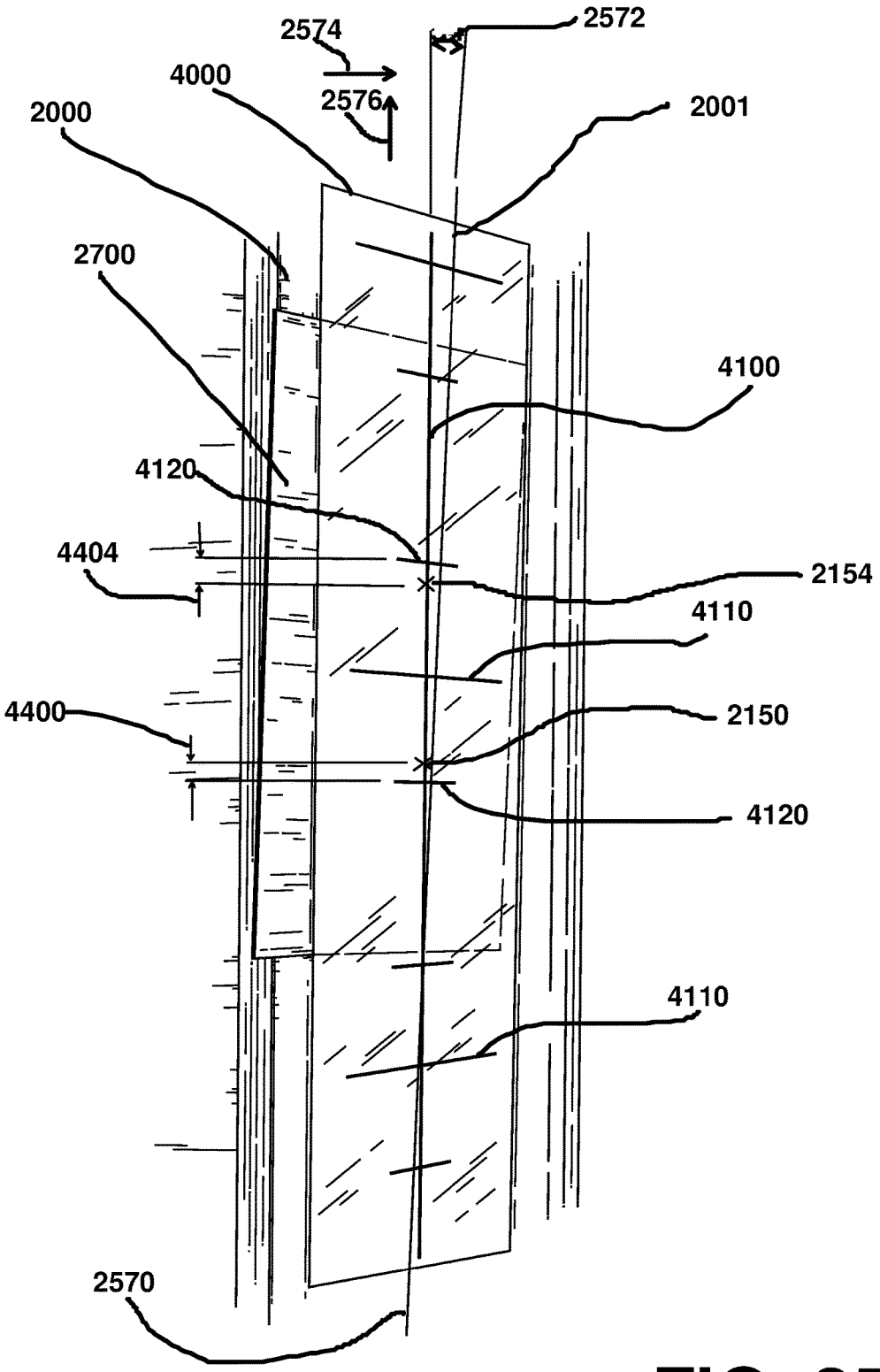
FIG. 25 is a perspective view of the mapping tape of FIG. 23 now applied against the positioning marks made by positioning member.

FIG. 23 shows one embodiment of mapping tape 4000 which can be used in combination with the strike plate 2200 (or deadbolt receiving plate 2204 or electric strike 2206) to be installed on door frame 2000. FIG. 24 shows a perspective view of mapping tape 4000 being removed from its backing so that it can be applied against the positioning marks 2150 and 2154 made by positioning member 500. FIG. 25 is a perspective view of mapping tape 4000 now applied against the positioning marks 2150 and 2154 made by positioning member 500.

Figure 27:
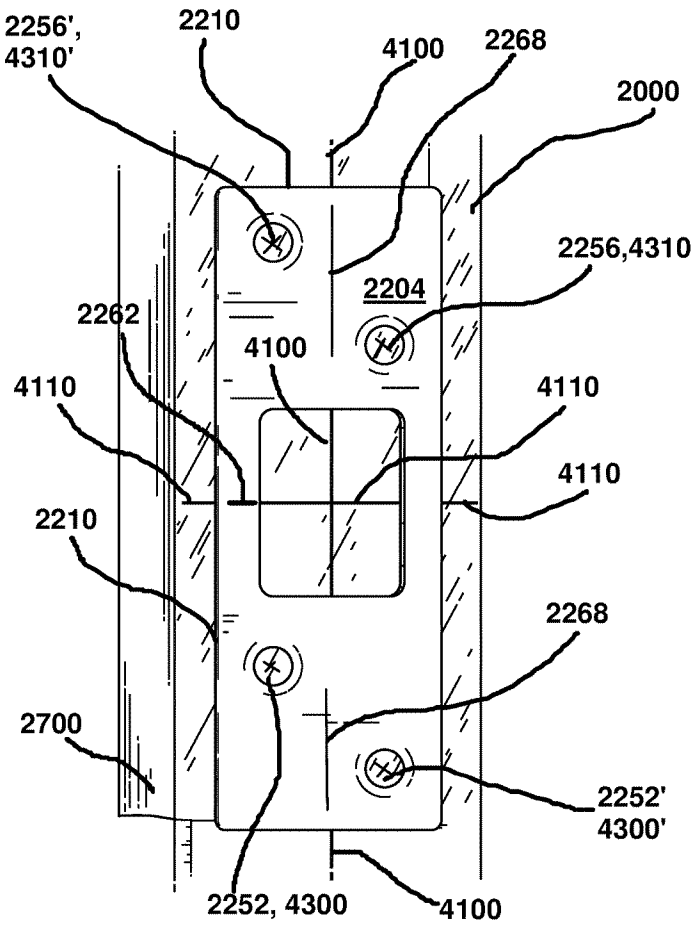
FIG. 27 is a view of a deadbolt receiving plate having four screw hole openings placed over the mapping tape of FIG. 25.
Figure 26:
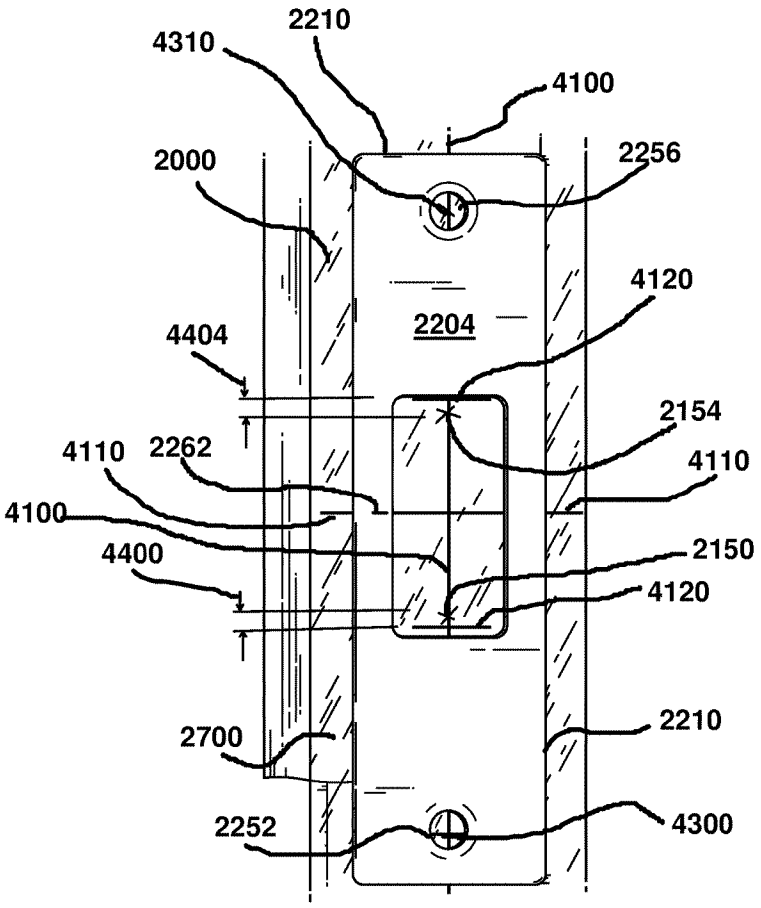
FIG. 26 is a view of a deadbolt receiving plate having two screw hole openings placed over the mapping tape of FIG. 25.
Figure 28:
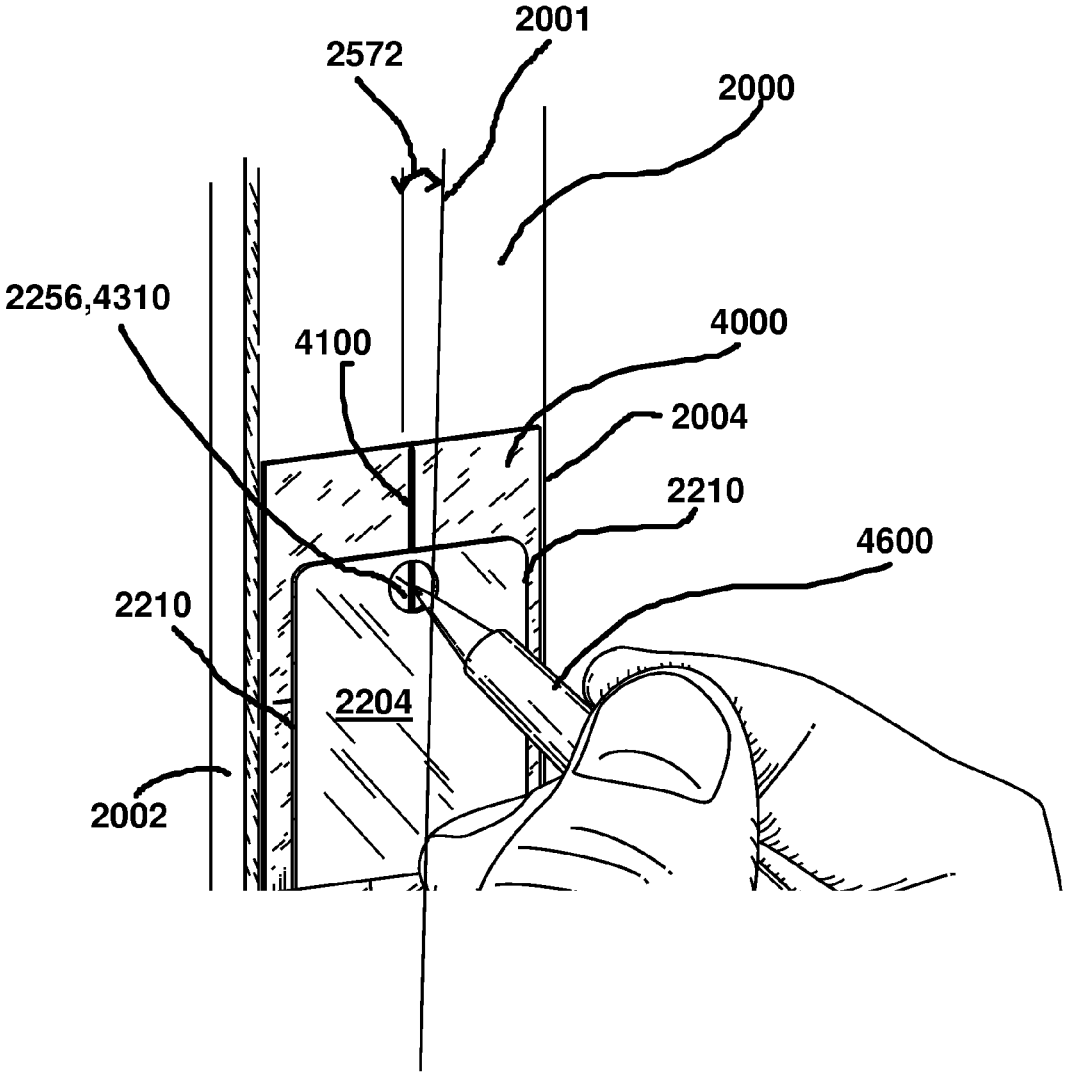
FIG. 28 is a closeup perspective view of the deadbolt receiving plate positioned in FIG. 26, and showing a screw hole mark being made using the upper opening of the deadbolt receiving plate (both upper and lower screw hole marks are made based on the position of the deadbolt receiving plate shown in FIG. 26).

FIG. 26 is a view of a deadbolt receiving plate 2204 having two screw hole openings 2252 and 2256 placed over the mapping tape 4000. FIG. 27 is a view of a deadbolt receiving plate 2204 having four screw hole openings 2252, 2252' and 2256,2256' placed over the mapping tape 4000. FIG. 28 is a closeup perspective view of a screw hole mark 4300 being made based on the position of the deadbolt receiving plate 2204 shown in FIG. 26 (both upper 4300 and lower screw hole marks 4310 are made based on the position of the deadbolt receiving plate 2204 shown in FIG. 26).

In various embodiments the plurality of positioning marks 2150 and 2154 made by positioning member 500 can be used to locate a center point between said two positioning marks 2150 and 2154, and said center point can further be used to identify the correctly aligned horizontal locations for the mounting screw holes 2152 and 2156 for the deadbolt receiving plate 2204 (or strike plate 2200 or electric strike 2206).

In various embodiments the plurality of positioning marks 2150 and 2154 made by positioning member 500 can be used to locate the relative rotation or skewing from a vertical line for proper alignment, and said relative rotation or skewing can further be used to identify the correctly "rotated or skewed" aligned locations for the mounting screw holes 2152 and 2156 for the receiving plate 2204 (or strike plate 2200 or electric strike 2206). Angle 2572 from longitudinal 4100 (of mapping tape 4000 aligned with positioning marks 2150 and 2154) is the amount or relative rotation or skewing for the properly aligned angle of longitudinal line 4100 (for locating mounting holes 2152,2156) with respect to the longitudinal centerline 2002 of door frame 2000. In various embodiments angle 2572 can be 0, 1, 2, 3, 4, 5, 6, 7, 8, 9, 10, 12, 14, and 15 degrees. In various embodiments the angle 2572 can be between any two of the above specified angles.

In various embodiments can be provided a mapping tape 4000 which mapping tape includes (a) a longitudinal line 4100; (b) an orthogonal centerline 4110; and (c) a plurality of orthogonal positioning lines 4120 symmetrically spaced about the longitudinal line (FIGS. 23-25). In one embodiment, the orthogonal centerline 4110 is at least a specified length such as 2 inches (5 cm). In various embodiments the orthogonal centerline 4100 and the plurality of orthogonal positioning lines 4120 symmetrically spaced about the longitudinal line have a repeating pattern on the mapping tape 4000.

In a preferred embodiment the orthogonal positioning lines 4120 have a predefined spacing 4130 which equals a specified spacing between the mounting screw hole openings 2152 and 2156 for a particular make and model of a strike or strike plate assembly 2200. (FIG. 23)

In one embodiment the mapping tape 4000 can be translucent or clear (FIG. 25). In one embodiment the mapping tape 4000 can have indicia printed thereon: (a) a long vertical center line 4100 which can be placed over the two positioning marks 2150, 2154 made by positioning member. (FIG. 25), (b) a horizontal centerline 4110 which can be used to locate the center point between the two positioning marks 2150 and 2154 created by positioning member 500; and (c) two short horizontal positioning lines 4120' and 4120" which can be used to locate positioning relative to the two positioning marks 2150 and 2154.

As described above, the mounting openings for deadbolt receiving plates 2204 (or strike plates 2200 or electric strikes 2206) being typically symmetrically spaced about center point on a line for such deadbolt receiving plates 2204 (or strike plates 2200 or electric strikes 2206) allows the described installation embodiment steps to be used for determining the correctly aligned locations for the mounting screw holes. This procedure also works for identifying the correctly aligned locations for the mounting screw holes for deadbolt receiving plates 2204 (or strike plates 2200 or electric strikes 2206).

Most spacing between mounting screw hole openings 2152 and 2156 for deadbolt receiving plates 2204 (or strike plated 2200 or electric strikes 2206) for different manufacturers are standardized so it is expected that the two orthogonal lines 4120 on the mapping tape 4000 will have the same spacing 4130 as the spacing between the two positioning marks 2150 and 2154 made by positioning member 500 described above on the marking tape 2700. The user can position the two orthogonal positioning lines 4120 (printed on the mapping tape 4000) directly on top of the positioning mark imprints 2150 and 2154 left by the positioning member 500 on the marking tape 2700. Once the two orthogonal positioning lines 4120 have been aligned with the positioning marks 2150 and 2154 made by positioning member 500 on marking tape 2700, the user presses mapping tape 4000 on top of marking tape 2700.

In the event that the spacing 2258 between mounting screw hole openings 2252 and 2258 for a particular deadbolt receiving plate 2204 (or strike plate 2200 or electric strike 2206) is different from the spacing 4130 between the two orthogonal lines 4120 on the mapping tape 4000, then the two orthogonal lines 4120 can not be directly lined up with the positioning marks 2150 and 2154 on marking tape 2700 made by positioning member 500—instead there will be a differential spacing. In this case of unequal spacing, the longitudinal line 4100 of the mapping tape 4000 is aligned with the two positioning marks 2150 and 2154 of positioning member 500 (to provide correct angular alignment), and the centerline 4110 on the mapping tape 4000, along with the two orthogonal lines 4120 on the mapping tape 4000 are symmetrically positioned around the two positioning marks 2150 and 2154 made by positioning member 500. Centerline 4110 is positioned in the center of the two positioning marks 2150 and 2154 and the differential spacing between each orthogonal line 4120 and its respective positioning mark (mark 2150 or mark 2154) are equalized to the other orthogonal line 4120 and its respective positioning mark (mark 2150 to orthogonal line 120 and mark 2154 to the other orthogonal line 4120). In this way the mapping tape 4000 can be properly positioned relative to the two positioning marks 2150,2154 made positioning member 500 for ultimate proper alignment of the deadbolt receiving plate 2204 (or strike plate 2200 or electric strike 2206) with the door 2500 locking member 2600.

Figure 31:
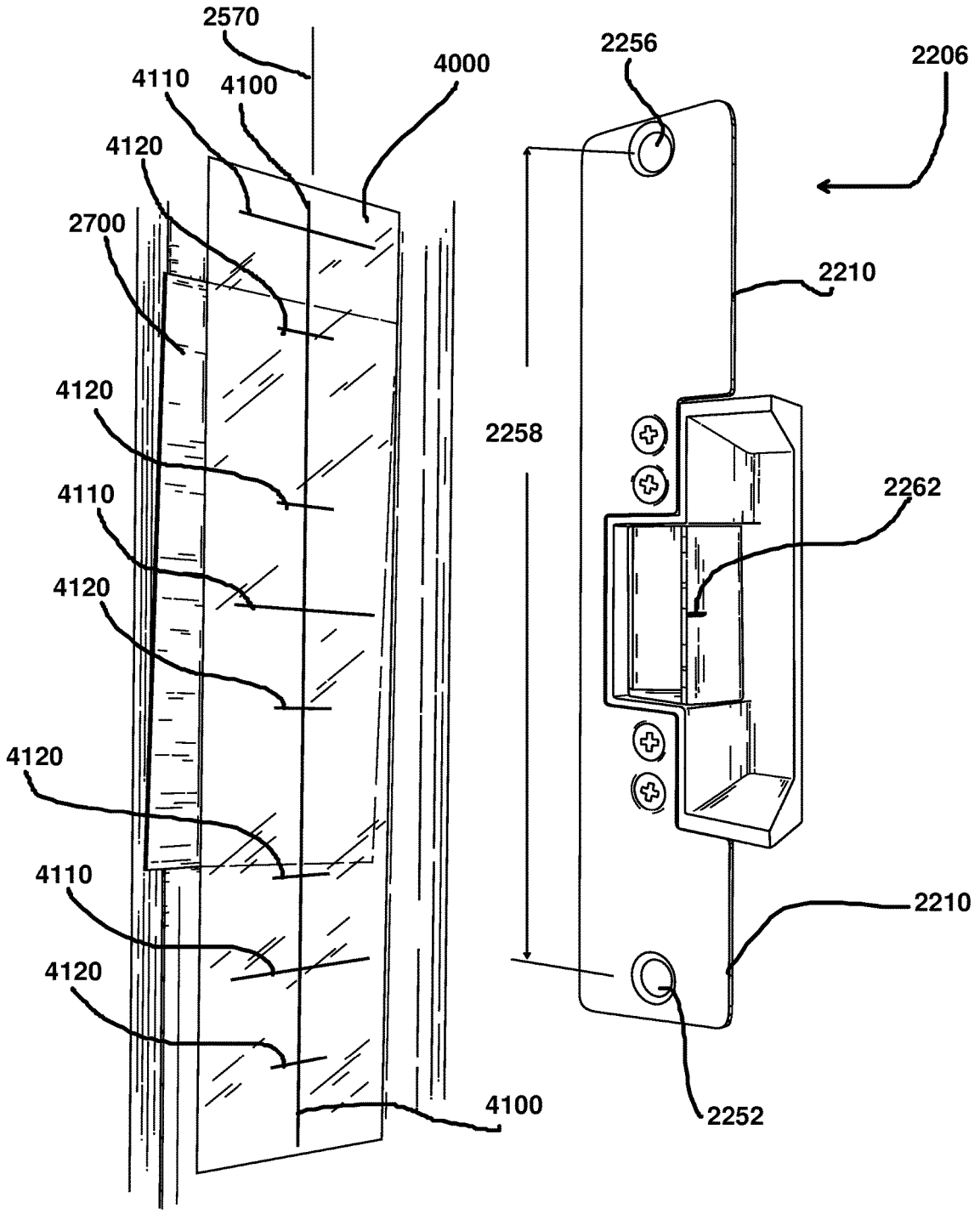
FIG. 31 is a perspective view of the mapping tape of FIG. 23 now applied against the positioning marks made by positioning member, and also showing an electric latch which will be installed on the door frame based on the placed positioning marks.
Figure 32:
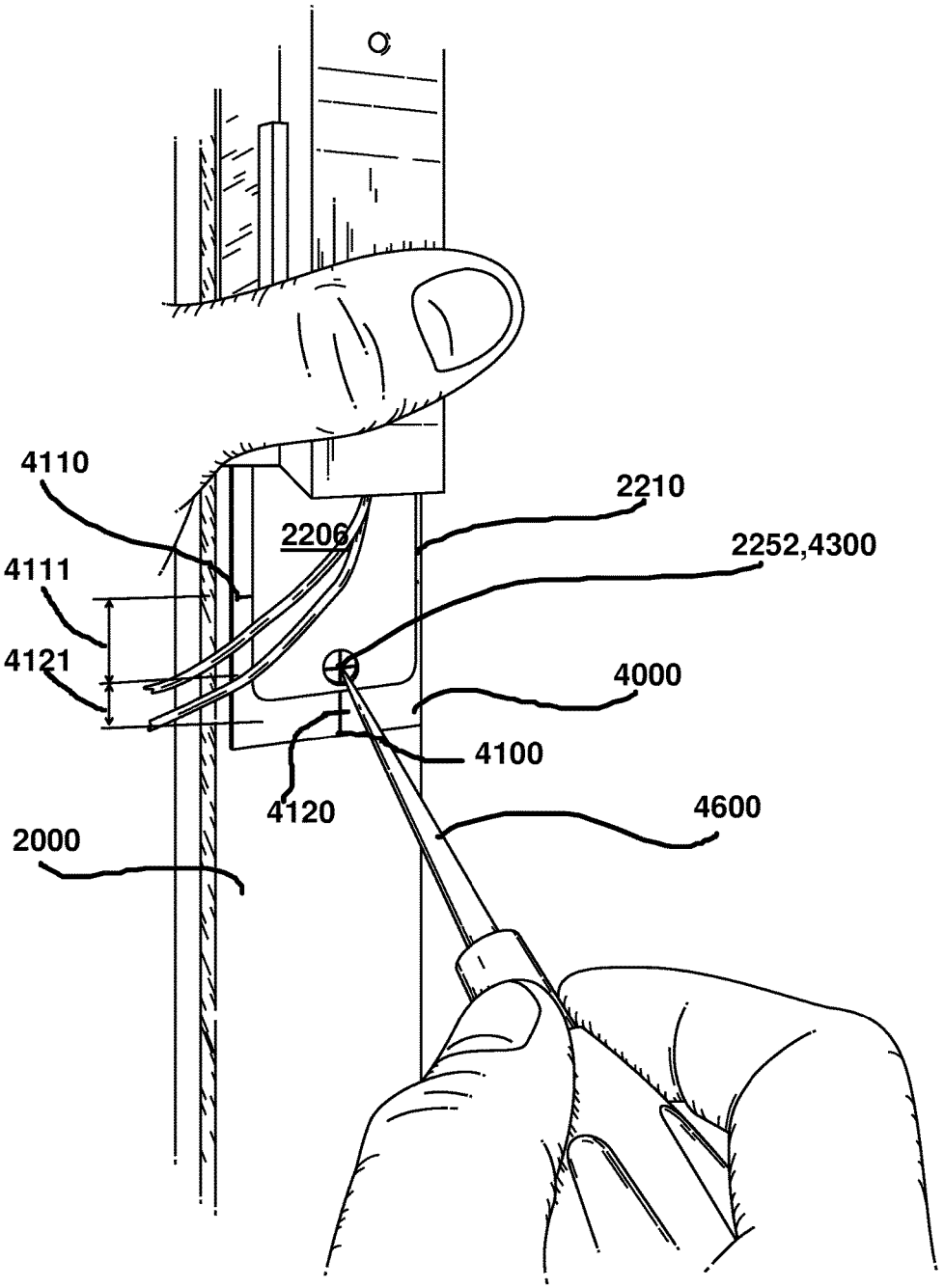
FIG. 32 is a perspective view of an upper screw hole mark being made based on the position of the electric latch shown in FIG. 31.
Figure 33:
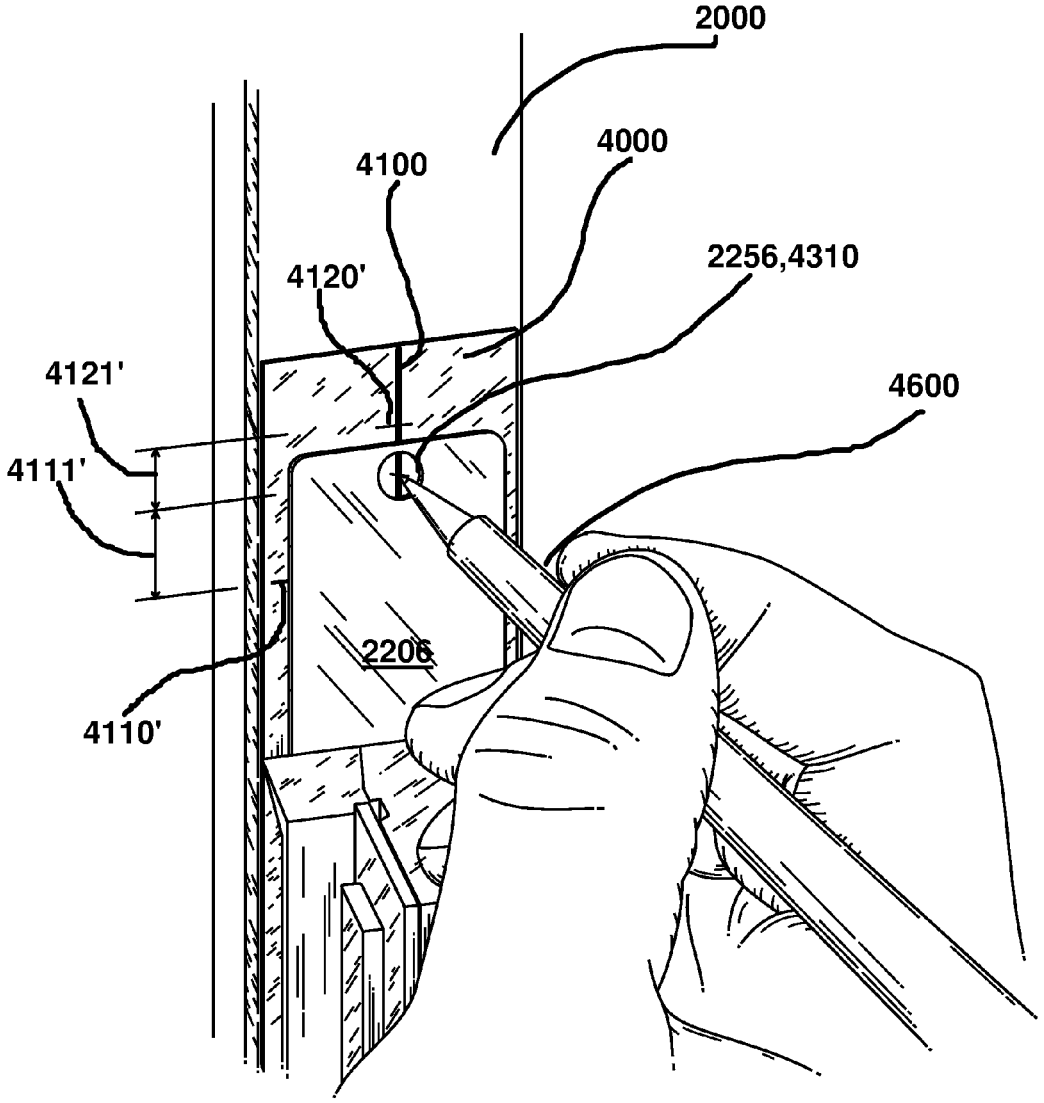
FIG. 33 is a perspective view of a lower screw hole mark being made based on the position of the electric latch shown in FIG. 31.
Figure 34:
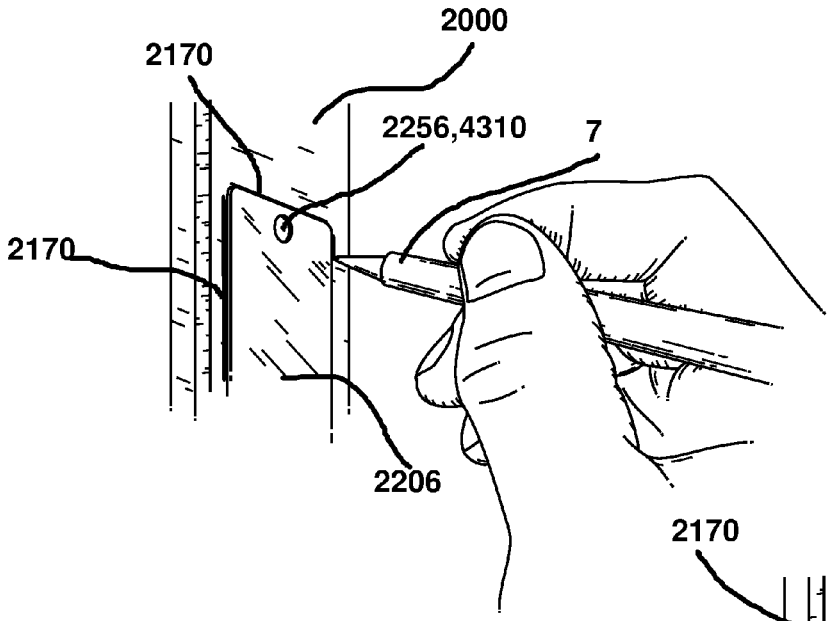
FIG. 34 shows the electric latch of FIG. 31 being used to outline the area to be for installing the electric latch.
Figure 35:
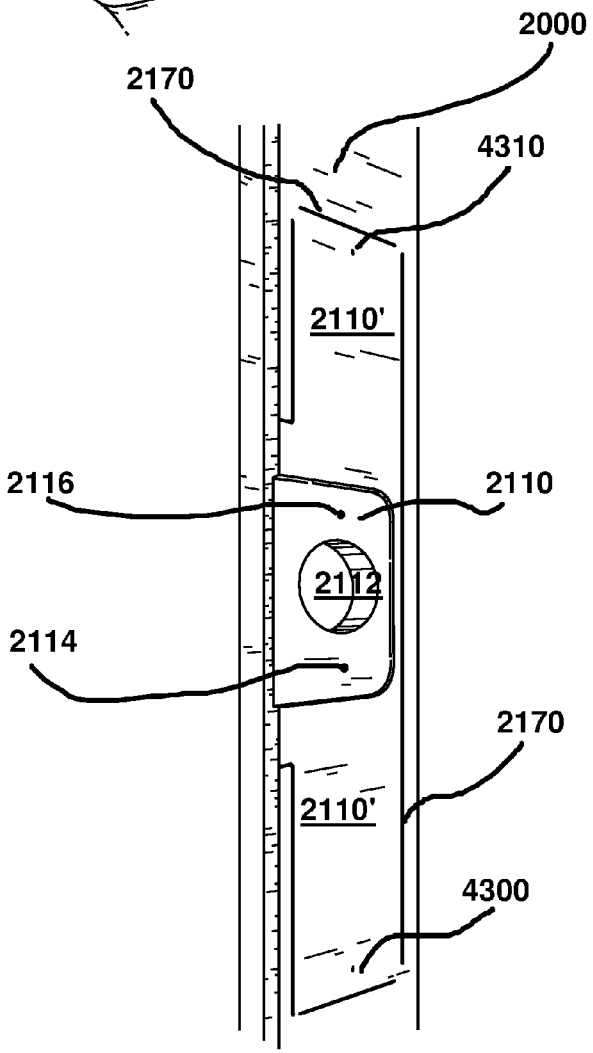
FIG. 35 shows the outline for the recessed area for the electric latch made around the two drilled holes from the screw hole marks made in FIGS. 33 and 34.

FIG. 31 is a perspective view of mapping tape 4000 now applied against the positioning marks 2150 and 2154 made by positioning member 500, and also showing an electric strike 2206 which will be installed. FIG. 32 is a perspective view of an upper screw hole mark 4300 being made based on the position of the electric strike 2206. FIG. 33 is a perspective view of a lower screw hole mark 4310 being made based on the position of the electric strike 2206. FIG. 34 shows the electric strike 2206 being used to outline the area to be for installing the electric strike 2206.

After the mapping tape 4000 as been positioned on the door frame 2000 as described above has been completed, below is described a procedure for determining the correctly aligned locations of the mounting screw holes 2152 and 2156 for a deadbolt receiving plate 2204 (or strike plate 2200 or electric strike 2206).

Before positioning the deadbolt receiving plate 2204 (or strike plate 2200 or electric strike 2206) the user makes a center mark 4010 on the deadbolt receiving plate 2204 (or strike plate 2200 or electric strike 2206). The center mark 2262 can be approximated or can be more accurately made using a measuring device. The center mark 2262 placed on the deadbolt receiving plate 2204 (or strike plate 2200 or electric strike 2206) assists the user in matching up the deadbolt receiving plate's 2204 (or strike plate's 2200 or electric strike's 2206) center point 2262 with the centerline mark 4110 printed on the mapping tape 4000. Once the deadbolt receiving plate 2204 (or strike plate 2200 or electric strike 2206) is positioned on top of the mapping tape 4000 center to center, the user also positions the deadbolt receiving plate's 2204 (or strike plate's 2200 or electric strike's 2206) two screw holes openings 2252 and 2256 parallel to and on top of longitudinal line 4100 of mapping tape 4000. This positioning shows the user the correct mounting position for deadbolt receiving plate 2204 (or strike plate 2200 or electric strike 2206) on doorframe 2000 to match up with the door locking member 2600 when door 2500 is closed in door frame 2000.

Using a hole punch tool 4600, the user than can make secondary positioning marks 4300, 4310 in the door frame 2000 by, at the screw hole openings 2252 and 2256 of the deadbolt receiving plate 2204 (or strike plate 2200 or electric strike 2206), penetrating the mapping tape 4000, penetrating the marking tape 2700 and/or gap reducer 2704 (if used) and thereby marking the door frame 2000 itself at the properly positioned locations for deadbolt receiving plate's 2204 (or strike plate's 2200 or electric strike's 2206) screw hole openings 2252 and 2256.

The user can also use a marker 4310 (e.g., a pen, pencil, sharpie, etc) to trace the perimeter 4100 of deadbolt receiving plate 2204 (or strike plate 2200 or electric strike 2206) onto the mapping tape 4000, and then remove deadbolt receiving plate 2204 (or strike plate 2200 or electric strike 2206). The user can create a recessed area 2107 in the door frame 2000 by using a utility knife 4300 cut out the drawn out perimeter 4100 of deadbolt receiving plate 2204 (or strike plate 2200 or electric strike 2206) through the mapping tape 4000, and then mortise door frame 2000 to create a recessed area 2107 in the door frame 2000 for installing deadbolt receiving plate 2204 (or strike plate 2200 or electric strike 2206).

Figure 29:
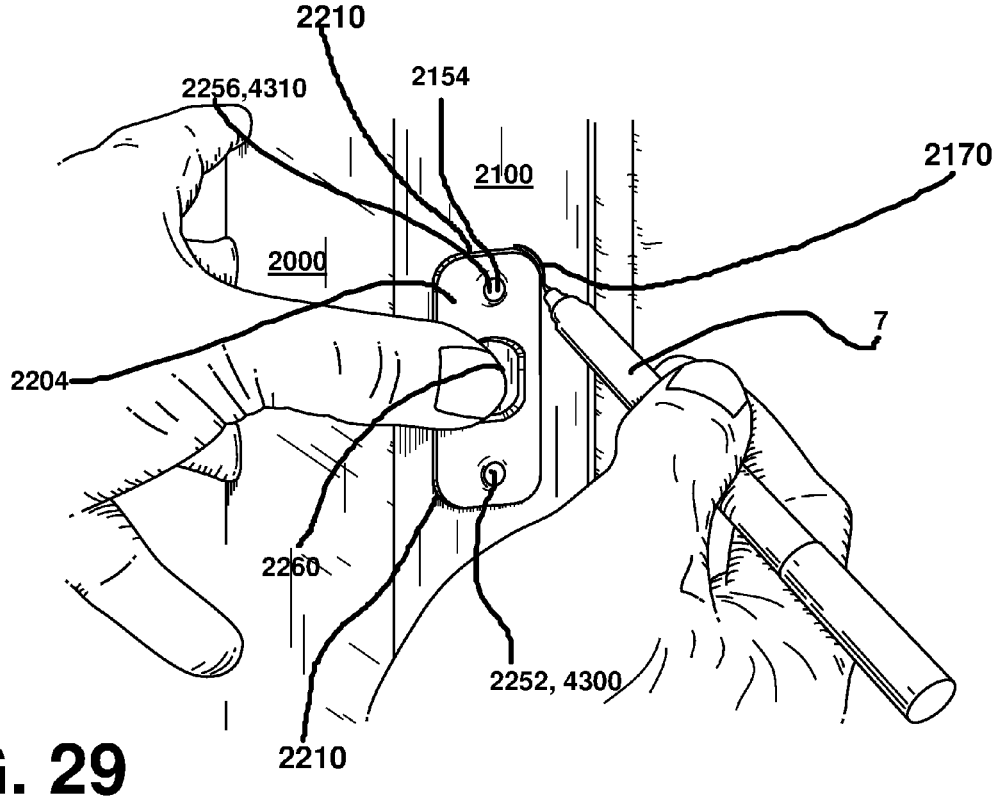
FIG. 29 shows the deadbolt receiving plate of FIG. 26 being used to outline the area to be for installing the strike plate.
Figure 30:
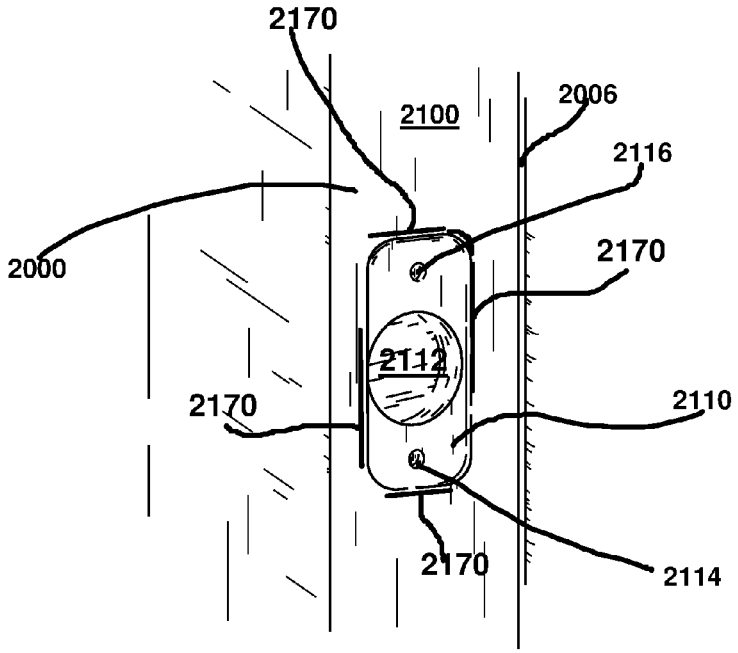
FIG. 30 shows the recessed area for the deadbolt receiving plate made around the two drilled holes from the screw hole marks made in FIG. 28, along with creation of a mortised or recessed area for installation of the deadbolt receiving plate and bore hole.

FIG. 29 shows a deadbolt receiving plate 2204 being used to outline the area to be recessed area 2107 for installing the deadbolt receiving plate 2204. The interior of deadbolt opening 2260 should also be traced. FIG. 30 shows the recessed area 2107 for the deadbolt receiving plate 2204 made around the positioning screw hole marks 2150 and 2154, along with deadbolt receiving plate bore 2160 made from the respective tracings made in FIG. 29.

FIG. 30 shows a recessed area 2105 for the deadbolt receiving plate 2204 made around the two holes drilled from the positioning marks 2150 and 2154 made in FIG. 20, along with placement of deadbolt receiving plate 2204 and hole 2160 cut out for deadbolt receiving plate 2204 to match the deadbolt locking member 2600.

If the user correctly positioned the mapping tape 4000 relative to the positioning marks 2150 and 2154 made on the marking tape 2700 (or the door frame 2000 if no marking tape 2700 and/or gap reducer 2704 was used) along with a determined center point between said positioning marks 2150,2154 made by positioning member 500; correctly positioned the center point 2262 of deadbolt receiving plate 2204 (or strike plate 2200 or electric strike 2206) on the center line 4110 of the mapping tape 4000; correctly positioned the screw hole openings 2252, 2256 of deadbolt receiving plate 2204 (or strike plate 2200 or electric strike 2206) relative to the longitudinal line 4100 of the mapping tape 4000 (and possibly also relative to the orthogonal positioning lines 4120 or 4120' or 4120" of the mapping tape 4000 depending on the spacing 2258 between screw hole openings 2252 and 2256) in making the secondary positioning marks 4300 and 4310 on the mapping tape 4000 and into the door frame 2000; then the screw holes 2252 and 2256 in the door frame 2000 made at these secondary positioning marks 4300, 4310 will be in the correctly aligned position for deadbolt receiving plate 2204 (or strike plate 2200 or electric strike 2206) and door locking member 2600 to match up exactly.

Additionally, the user outlining 2170 the perimeter 2210 of deadbolt receiving plate 2204 (or strike plate 2200 or electric strike 2206) at a time when deadbolt receiving plate 2204 (or strike plate 2200 or electric strike 2206) is positioned for making the secondary positioning marks 4300 and 4310 as set forth above allows the user to mortise the recessed area 2160 in the door frame 2000 in the properly aligned position to receive deadbolt receiving plate 2204 (or strike plate 2200 or electric strike 2206) for final installation.

After the mapping tape 4000 has been positioned on the door frame 2000 as described above has been completed, below is described a procedure for determining the correctly aligned locations of the mounting screw holes 2252 and 2256 for an electric strike 2206. Before positioning the electric strike 2206 the user makes a center mark 2262 on the electric strike 2206 where the door locking member 2600 will hit first. The center mark 2262 can be approximated or can be more accurately made using a measuring device.

Turning the electric strike 2206 face down, where the smooth side is against the doorframe 2000, makes it easier to position the electric strike plate 2206 closely adjacent the frame 2000 and thereby easier to trace an outline 2170 of the electric strike 2206 on the doorframe 2000. The center mark 2262 placed on the electric strike 2206 assists the user in matching up the electric strike's 2206 center point with the centerline mark 4110 printed on the mapping tape 4000. Once the electric strike 2206 is positioned on top of the mapping tape 4000 center to center, the user also positions the electric strike's 2206 two screw holes' 2252 and 2256 with the longitudinal center line 4100 on mapping tape 4000. This positioning shows the user the position electric strike 2206 should be in for proper alignment of the electric strike 2206 in the doorframe 2000 to match up with the door locking member 2600.

Using a hole punch tool 4600, the user than can make secondary positioning marks 4300 and 4310 in the door frame 2000 by, at the screw hole openings 2252 and 2256 of electric strike 2206, penetrating mapping tape 4000, penetrating the marking tape 2700 (and gap reducer 2704 if used), and thereby marking the door frame 2000 at the location of electric strike's 2206 screw hole openings 2252 and 2256.

The user can also use a marker 4310 (e.g., a pen, pencil, sharpie, etc) to trace the perimeter 2210 of electric strike 2206 onto the mapping tape 4000, and then remove electric strike 2206. The user can create a recessed area 2160 in the door frame 2000 by using a utility knife 4300 cut out the drawn out perimeter 2170 of electric strike 2206 through the mapping tape 4000, and then mortise the door frame 2000 to create a recessed area 2160 in door frame 2000 for installing electric strike 2206.

If the user correctly positioned the mapping tape 4000 relative to the positioning marks 2150 and 2154 made on the marking tape 2700 (or the door frame 2000 if no marking tape 2700 (and/or gap reducer 2704 if used) along with a determined center point between said positioning marks 2150,2154 made by positioning member 500; correctly positioned the center point 2262 of electric strike 2206 on the center line 4110 of the mapping tape 4000; correctly positioned the screw hole openings 2252, 2256 of electric strike 2206 relative to the longitudinal line 4100 of the mapping tape 4000 (and possibly also relative to the orthogonal positioning lines 4120 or 4120' or 4120" of the mapping tape 4000 depending on the spacing 2258 between screw hole openings 2252 and 2256) in making the secondary positioning marks 4300 and 4310 on the mapping tape 4000 and into the door frame 2000; then the screw holes 2252 and 2256 in the door frame 2000 made at these secondary positioning marks 4300, 4310 will be in the correctly aligned position for electric strike 2206 and door locking member 2600 to match up exactly.

Additionally, the user outlining 2170 the perimeter 2210 of electric strike 2206 at a time when electric strike 2206 is positioned for making the secondary positioning marks 4300 and 4310 as set forth above allows the user to mortise the recessed area 2160 in the door frame 2000 in the properly aligned position to receive electric strike 2206 for final installation.

It is envisioned that mapping tape 4000 can also be used to line up door locks, deadbolts, electric strikes, drop bolts and ball catchers etc.

Relocating Position of Mounting Screw Openings

In many cases new doorframes 2000 and doors 2500, when nailed in position, fail to correctly line up for locking. It is preferable that the condition of failing to properly line up be known before being the doorframe 2000 is permanently nailed into the structure. Determining the condition of misalignment before permanently nailing in the frame 2000 to the structure allows for better corrective alignment measures to be taken compared to corrective alignment measures available after the doorframe 2000 has been permanently nailed in to the structure (e.g., home or building).

In various embodiments a proper alignment condition of a closed door 2500 between the door locking member 2600 and strike plate 2200 (or deadbolt receiving plate 2204 or electric strike 2206) occurs when the mounting screw holes 2620 and 2630 for the door locking member 2600 line up with the mounting screw holes 2114 and 2116 for the strike plate 2200 (or deadbolt receiving plate 2204 or electric strike 2206). In these embodiments, then the condition of proper alignment occurs when the transposed positioning marks 2150' and 2154' overlay the positions of "previously made" mounting screw holes 2114 and 2116 for the strike plate 2200 (or deadbolt receiving plate 2204 or electric strike 2206). Accordingly, where the transposed positioning marks 2150' and 2154' on tape 2754 line up with "previously made" mounting screw holes 2114 and 2116 for the strike plate 2200 (or deadbolt receiving plate 2204 or electric strike 2206), the door 2500 and doorframe 2000 have been determined to be an a "correctly aligned" condition. However, where the transposed positioning marks 2150' and 2154' on tape 2754 fail to line up with the "previously made" mounting screw holes 2114 and 2116 for the strike plate 2200 (or deadbolt receiving plate 2204 or electric strike 2206), the door 2500 and doorframe 2000 have been determined to not be an a "correctly aligned" condition.

Where the door 2500 and doorframe 2000 have been determined to not be in a correctly aligned condition, the user can now make necessary adjustments to the doorframe 2000 before the whole doorframe 2000 is permanently nailed into the structure which pre-installation timing allows greater flexibility in correcting the misaligned condition. On the other hand, if the permanently nailing the door frame 2000 into the structure occurs with a "misaligned condition" between the door 2500 and door frame 2000, the user's option to correct such misaligned condition are less satisfactory. For example, the user would be required to either "chisel around" the already mortised door strike area 2110 (to re-position the strike plate 2200 (or deadbolt receiving plate 2204 or electric strike 2206)), or reposition the door hinges (chiseling around the hinges) to reposition the door 2500 relative to the door frame 2000. In any event such chiseling takes time and leaves an end product that is not aesthetically pleasing.

On existing installations where the door locking member 2600 is misaligned with the strike plate 2200 (or deadbolt receiving plate 2204 or electric strike 2206), a pre-labeled positioning template 2750 with support pad 2790 can be used to help show exactly where the strike plate 2200 should be repositioned to correct the misalignment. In one embodiment (FIGS. 36 through 44), for new construction doorframe installations, before the doorframe 2000 is permanently nailed into position in a structure such as a building or home, an at least partially translucent pre-labeled positioning template 2750 can be used in connection with positioning member 500, to identify improper alignment conditions (e.g., where the "already mortised" recess 2110 in the doorframe 2000 and door locking member 2600 fail to line up correctly). Incorrectly aligned strike plate 2200 (or deadbolt receiving plate 2204 or electric strike 2206) and door locking members 2600 cause many problems including doors 2000 which do not lock, and which only lock when the door 2000 is manually pulled (e.g., vertically) by the user into an "alignment position" for locking. Having a correctly aligned doorframe 2000/door 2500 eliminates some or all of the disadvantages including the need to push, pull, and/or lift the door 2500 during closing to lock the door 2500.

Figure 36:
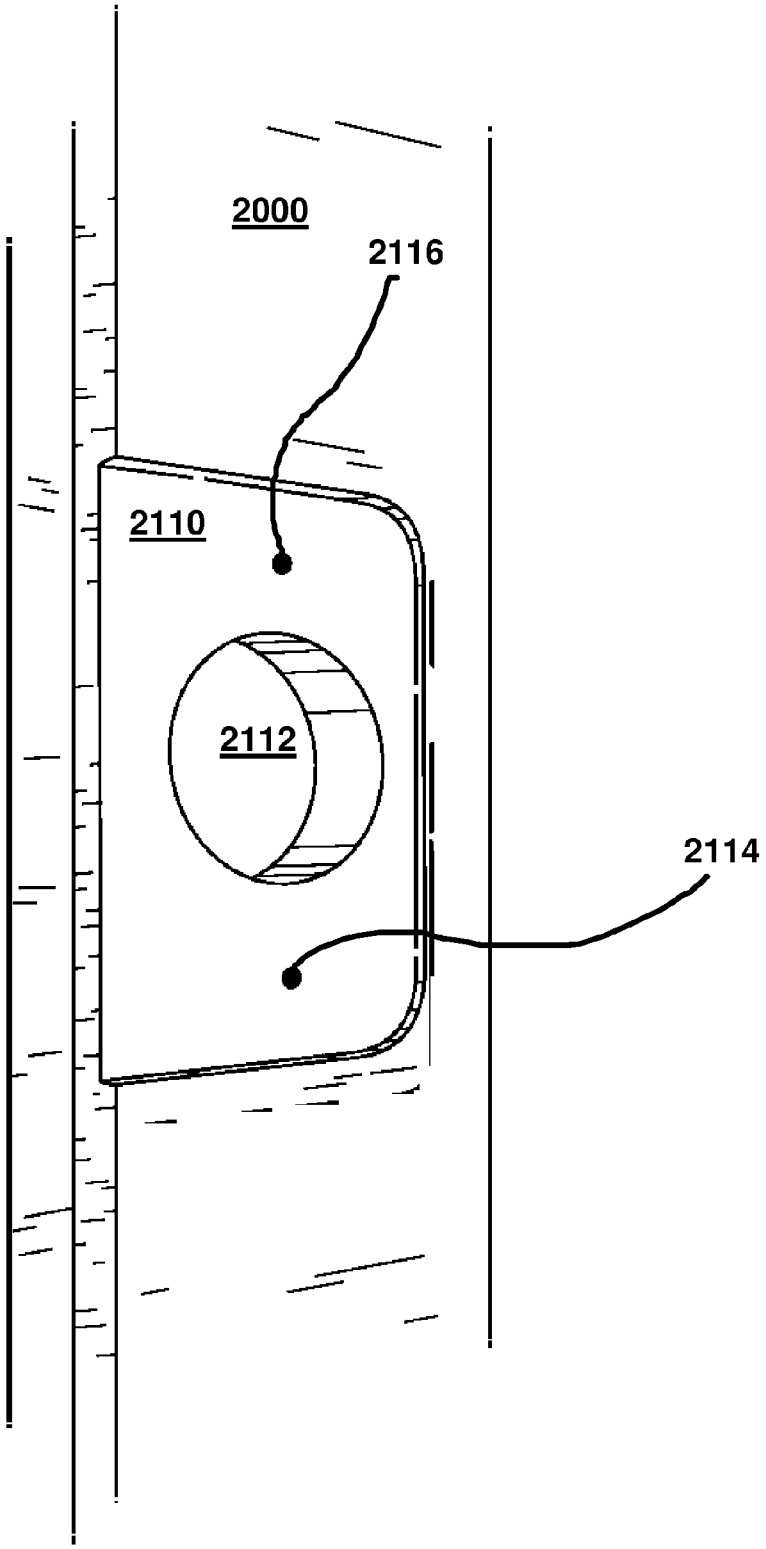
FIG. 36 shows a door frame before being installed and/or nailed into a structure (e.g., home or building) which includes an existing mortised/recessed area for a strike plate to be installed on the door frame.

FIG. 36 shows a door frame 2000 before being installed and/or nailed into a structure (e.g., home or building) which includes a recessed area 2110 for a strike plate 2200 (or deadbolt receiving plate 2204 or electric strike 2206) to be installed.

Figure 37:
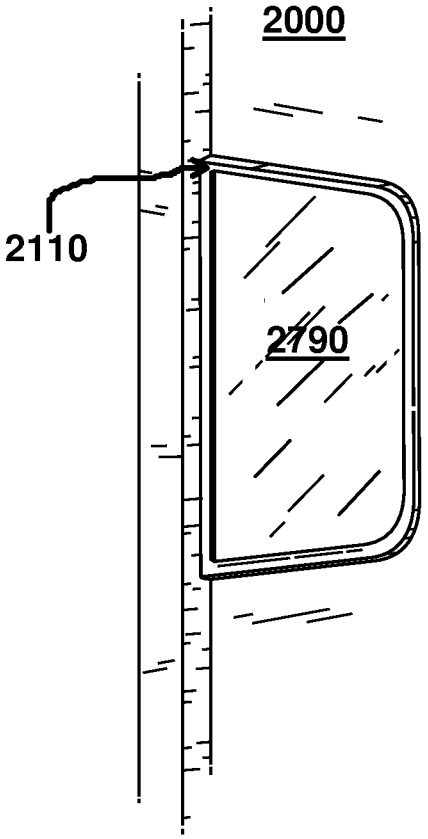
FIG. 37 shows a support pad placed in the existing mortised/recessed area for a strike plate which support pad can close the gap of the recessed area by making the thickness of the support pad about equal to the depth of the recessed area of the existing mortised area.

FIG. 37 shows a reinforcing and/or support pad 2790 placed in an existing recess mortised area 2110 of frame 2000 for ultimately checking alignment of already placed screw hole locations 2114 and 2116 for a strike plate 2200 (or deadbolt receiving plate 2204 or electric strike 2206).

Figure 38:
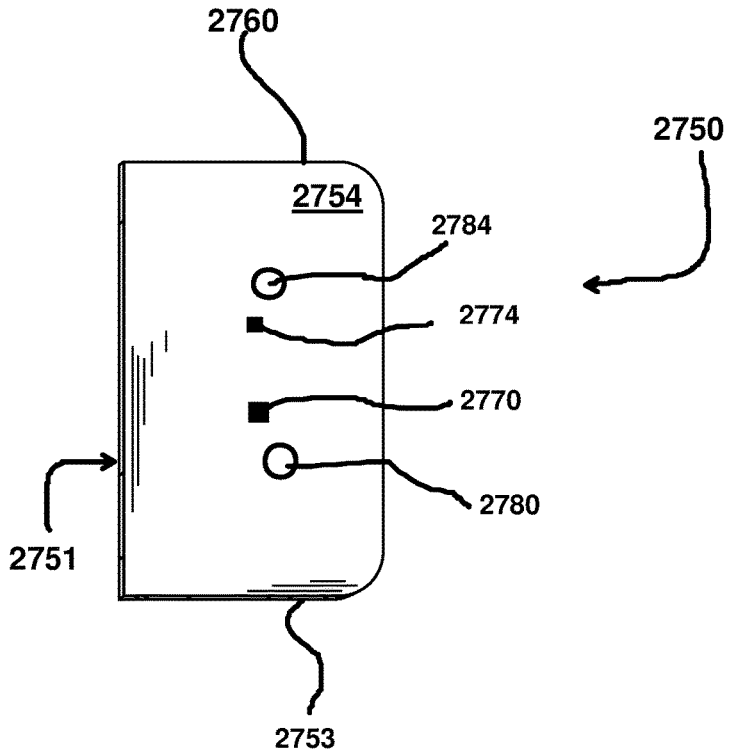
FIG. 38 schematically illustrates a pre-labeled positioning template which can be used in various embodiments for door installation.

FIG. 38 schematically illustrates that pre-labeled positioning template 2750 includes a removable translucent marking tape body portion 2754 and a removable liner 2751 (which can also be translucent).

Figure 39:
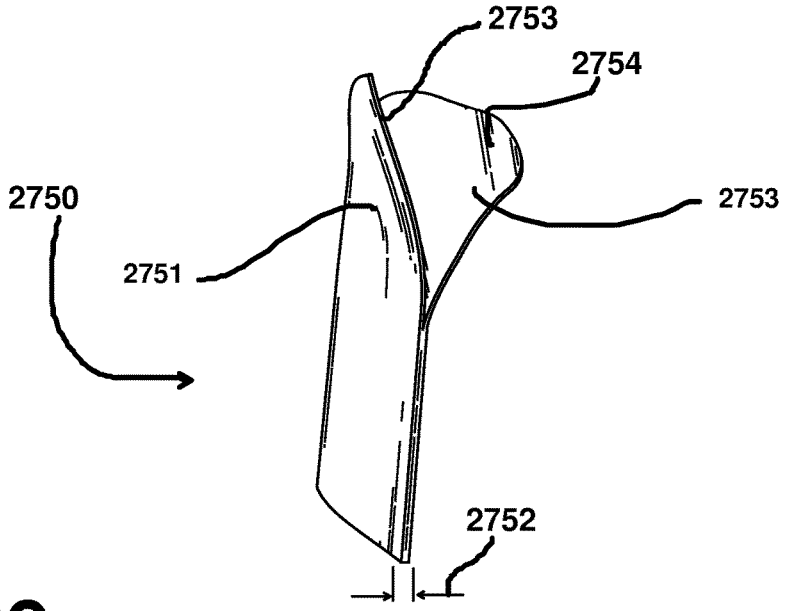
FIG. 39 schematically illustrates how the positioning template of FIG. 38 showing the lining being removed from the translucent positioning template portion.

FIG. 39 shows removable translucent marking tape body portion 2754 being separated from the liner 2751 to expose the adhesive on the back of translucent portion 2754.

Figure 40:
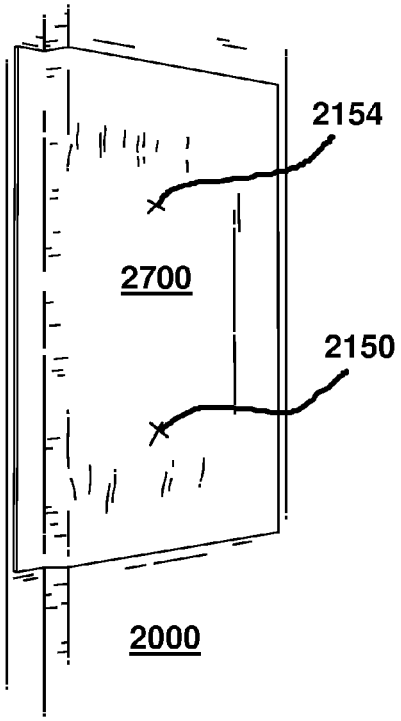
FIG. 40 shows marking tape placed over the reinforcing and/or support pad shown in FIG. 37.

FIG. 40 shows a marking tape 2700 already placed over the support pad 2750 shown in FIG. 37, along with positioning marks 2150 and 2154 made on marking tape 2700 by positioning member 500 using one or more of the disclosed methods.

Figure 41:
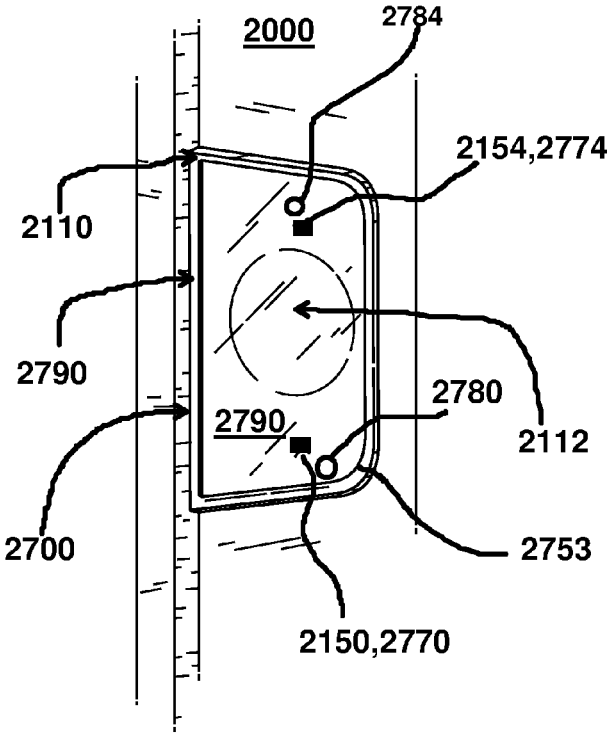
FIG. 41 shows the positioning template of FIG. 38 positioned and stuck over the positioning marks made by a positioning member using one of the embodiments disclosed in this application.

FIG. 41 shows the transposed positioning marks 2150' and 2154', which were transposed from the positioning marks 2150 and 2154 on marking tape 2700 to support pad 2790 with pre-labeled positioning template 2750 placed over these transposed marks 2150' and 2154', now showing the ultimate location for drilling screw holes 2124 and 2126 (at indicia 2780 and 2784).

Figure 42:
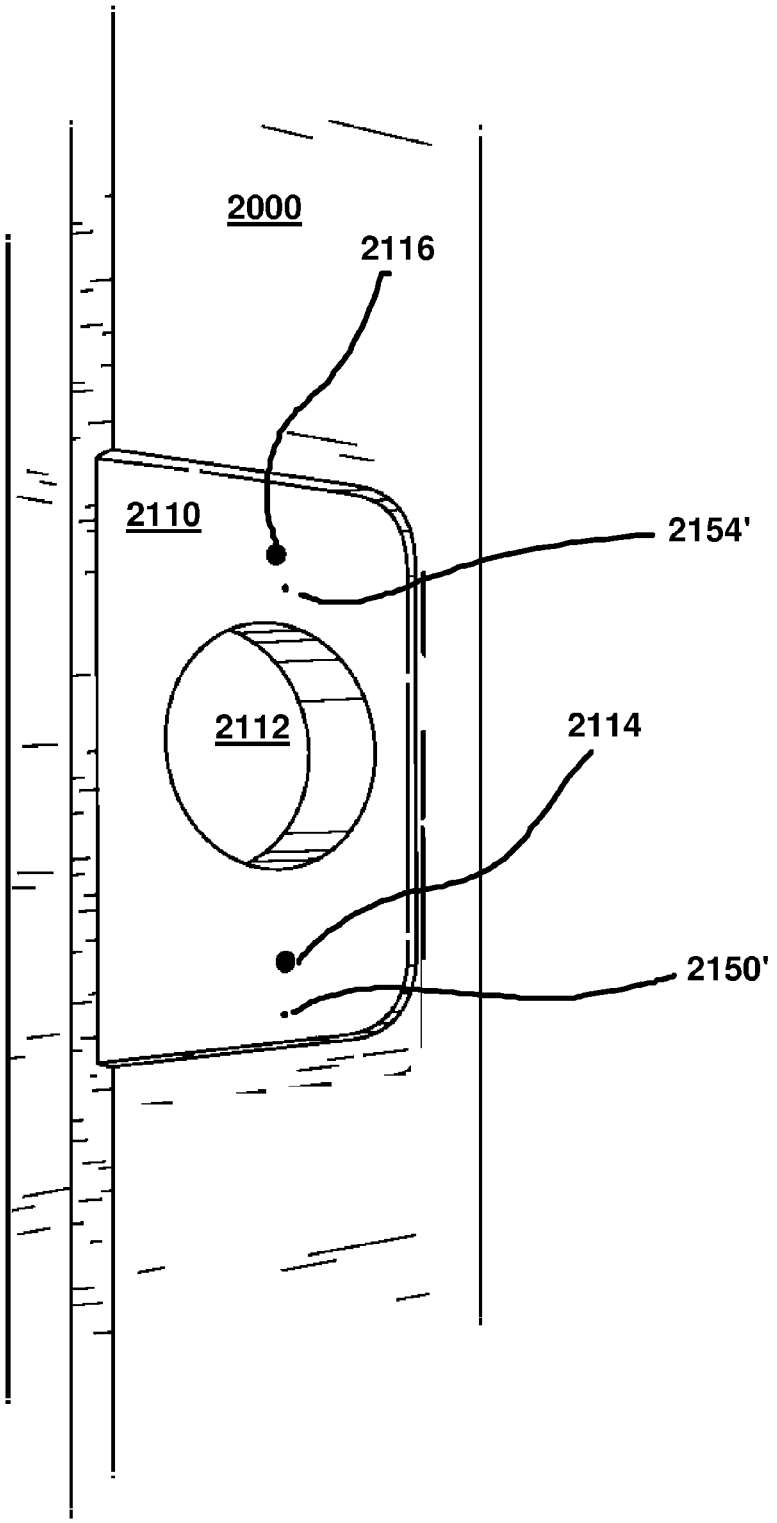
FIG. 42 shows the door frame of FIG. 36 with existing recessed area for a previously installed strike plate and its two original screw holes 2114 and 2116 for securing the strike plate, but now with transposed positioning marks for newly positioned screw holes for proper alignment between the strike plate and the door locking member (located on the door).

FIG. 42 shows the door frame 2000 with existing recessed area 2110 for a previously installed strike plate 2200; and its two original screw holes 2114 and 2116 for securing the strike plate 2200, but now with transposed positioning marks 2150' and 2154' (transposed to frame 2000) for newly positioned screw holes 2124 and 2126 for proper alignment between the strike plate 2200 and the locking member 2600 for the door 2500. Transposed positioning marks 2150' and 2154' can be made on door frame 2000 using positioning member 500 and one of the previously described embodiments.

Figure 43:
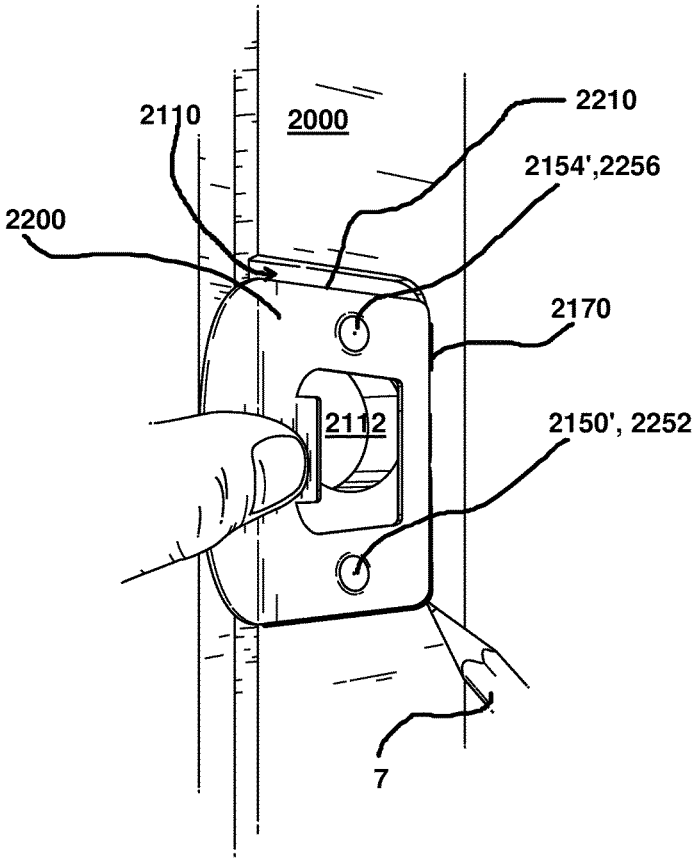
FIG. 43 shows a strike plate placed over the transposed positioning marks of FIG. 42 (positioned used strike plate openings), and the use of marking pencil to trace the perimeter of strike plate onto frame thereby creating an outline for a repositioned recessed area.

FIG. 43 shows a strike plate 2200 placed over the transposed positioning marks 2150' and 2154' (strike plate 2200 being positioned using strike plate openings 2252 and 2262), and then using marking pencil 7 to trace the perimeter 2210 of strike plate 2200 onto frame 2000 thereby creating an outline 2170 for a repositioned recessed area 2120. With strike plate 2200 placed over positioning marks 2150 and 2154 via openings 2252 and 2256, an outline 2170 for a repositioned recessed area 2120 can be made by tracing marking pencil 7 around the perimeter 2210 of strike plate 2200 onto frame 2000.

Figure 44:
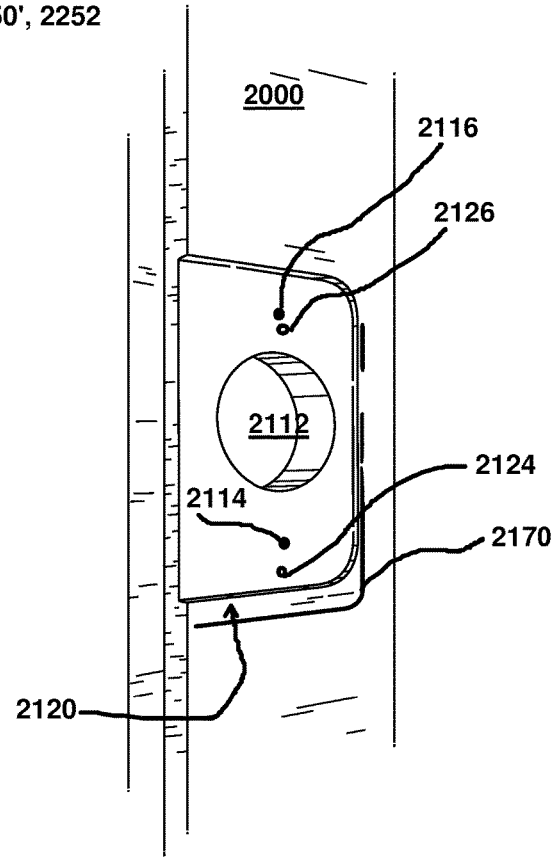
FIG. 44 shows the now traced outline for the new position for the recessed area for the strike plate to match the location of the locking member on the door along with newly drilled screw holes for the repositioned strike plate.

FIG. 44 shows the now traced outline 2170 for the new position for repositioned recessed area 2120 for the strike plate 2200 to correctly align with locking member 2600 on the door 2500 (when closed in frame 2000) along with newly drilled screw holes 2124 and 2126 for the correctly repositioned strike plate 2200. The mortising procedure is substantially the same as described previously, but after the user positions the strike plate 2200 over the correct strike plate screw holes 2124 and 2126, the user will re-trace the strike plate 2200 in the correct position and then re-mortise the recessed area 2110 for installing the strike plate 2200 (making repositioned recessed area 2120). A similar procedure for properly locating the installation position can be used for a deadbolt type plate 2200'.

Procedure for Installing Strike Plate Having Screw Hole Openings Directly Matching the Screw Holes for the Door Locking Mechanism In one embodiment the following procedure is used for repositioning a strike plate 2200 (or deadbolt receiving plate 2204 or electric strike 2206) on a frame 2000. The procedure will be described in relation to a strike plate 2200 and deadbolt receiving plate 2204, but can be used equally well for an electric strike 2206.

Support pad 2790 can be used in combination with marking 2700 (and/or gap reducer 270) for repositioning a strike plate 2200 and deadbolt receiving plate 2204 plate that was installed or in an out of alignment condition with a door locking member 2600.

In this embodiment it is assumed that spacing between the strike plate 2200 and deadbolt receiving plate 2204 openings 2252 and 2252 for mounting screws and spacing between the door locking member 2600 mounting screw openings 2620 and 2630 is the same (so both the strike plate 2200 and deadbolt receiving plate 2204 mounting screw holes line up with the locking mechanism's 2600 mounting screw holes 2620 and 2630). Where this assumption is not correct mapping tape 4000 can be used to identify the positions of screw hole openings 2124 and 2126 for correctly aligning strike plate 2200 with door locking mechanism 2600.

(1) Remove the strike plate 2200 and deadbolt receiving plate 2204 from the doorframe 2000 (FIG. 36).

(2) Remove the protective liner backing 2754 from the tape body 2751 (FIG. 38), and then place the support pad 2750 (with adhesive 2753) in the mortise area 2110 over the existing strike plate screw holes 2114 and 2116 (FIG. 41).

(3) Remove the protective liner from the adhesive side of the marking tape 2700 (and optionally with gap reducer 2704) and place it over the support pad 2750 and on top of the mortise 2110 area (FIG. 40). The marking tape 2700 (and optional gap reducer 2704) does not have to extend over the edge of the frame (but extending it over edge can assist in resisting the tendency of the door 2500 to pull it off when the door 2500 is being closed).

(4) Use positioning member 500 to create positioning marks 2150 and 2154 on the marking tape 2700 (FIG. 41) using one of the methods previously described for using positioning member 500 to create positioning marks.

(5) Before removing the marking tape 2700 (and optional gap reducer 2704) from doorframe 2000, use a hole punch tool to transpose positioning marks 2150 and 2154 through marking 2700, body 2751 of support pad 2750, and into door frame 2000 creating transposed positioning marks 2150' and 2154'. Then remove the marking tape 2700 (and optional gap reducer 2704) from the doorframe 2000 to expose transposed positioning marks 2150' and 2154' (FIG. 41).

(6) The transposed positioning marks 2150' and 2154' on body 2751 indicate the correct positions for the mounting screw holes 2124 and 2126 for the strike plate 2200 and deadbolt receiving plate 2204 to achieve an aligned condition with the door locking mechanism 2600 (FIG. 44). Place the strike plate 2200 and deadbolt receiving plate 2204 face down aligning openings 2252 and 2256 of strike strike plate 2200 and deadbolt receiving plate 2204 with transposed positioning markings 2150' and 2154; trace with a pen or pencil 7 the perimeter 2210 of strike plate 2200 and deadbolt receiving plate 2204 (FIG. 43); and then re-mortise recessed area 2110 (FIG. 44) so that strike plate 2200 and deadbolt receiving plate 2204 can be placed in the correct position for the door 2500 to lock properly where locking member 2600 aligns with mounted strike plate 2200 and deadbolt receiving plate 2204. Plug the old screw holes 2114 and 2116 if needed.

In one embodiment, support pad 2750 can be used and shaped or molded to fit the interior of a recessed area (or mortised area) 2110 for repositioning an existing recessed area 2110 (to 2120) where the strike plate 2200 and deadbolt receiving plate 2204 is not installed in the door frame 2000. In various embodiments, different shapes and/or sizes of support pads 2750 can be made for different sizes and shapes of strike plate 2200 and deadbolt receiving plate 2204 for door locks, deadbolts, electric strikes, drop bolts and ball catchers and more. Support pad 2750 can be used when a door frame 2000 includes an "existing" recessed area 2110 in the door frame (or "mortised" area), but not in the proper location for accurate alignment and locking between the strike plate 2200 and deadbolt receiving plate 2204 and door locking mechanism 2600.

A user can position and attach the body 2751 of the support pad 2750 inside the "already mortised area" 2110 of the doorframe 2000, and covering the existing screw holes 2114 and 2116 for installing the strike plate 2200 (FIGS. 36 to 39).

In various embodiments the user can next place the marking tape 2700 on top of the "already mortised area" 2110 of the doorframe 2000 and previously placed support pad 2750 (body 2751 and backing 2754).

The user can next place the positioning member 500 into one of the screw holes (e.g., 2620 or 2630) of the locking member 2600 in the door 2500, close the door 2500 (i.e., put it in the locking position), and when closed, cause positioning member 500 to make a positioning mark (2150 or 2154) onto the marking tape 2700 as described with previous embodiments. Also as described with previous embodiments, the user can then use a punch tool and at the location of this positioning mark (2150 or 2154) to push through marking tape 2700 (and optional gap reducer 2704), causing a secondary positioning mark (2150' or 2154') to be made on the underlying backing 2754 at the location of the positioning mark (2150 or 2154) on the marking tape 2700. (FIGS. 40 and 41). The user can then remove the marking tape 2700 (and optional gape reducer 2704), and body 2753 to expose the transposed positioning marks 2150' and 2154' on the tape 2754. (FIG. 41).

Once the marking tape 2700 (and optional gap reducer 2704), and support pad 2750 are removed, the transposed positioning marks 2150' and 2154' are now exposed allowing the user to compare the locations of the transposed positioning marks with the locations of the "previously made" door latch mounting screw holes 2114 and 2116 (FIG. 42 shows these two sets of items not being aligned).

The marking tape 2700 (which in some embodiments can be thick enough to can also serve as a gap reducer) is an accessory which can be used with positioning member 500 such as for alignment of door locks, deadbolts, electric strikes, drop bolts, ball catchers etc.

When using positioning member 500 without a marking tape 2700, positioning member 500 creates a mark (e.g., 2150 from elongated mark 2152) which is a scratch on the wood frame 2000, but in some cases the "created mark and/or scratch" may have limited visibility to a user. For example, on metal doorframes the mark or scratch would not likely be visible (as the metal of the door is typically harder than the materials for positioning member 500 marking point 500). In such examples of greater hardness of the materials on which the mark 2150 is to be made, compared to the hardness of the marking point 550 of positioning member 500 which is to make the mark, multiple different layers of a materials of reduced hardness (e.g., layers of masking tape) can be placed on top of the surface of the materials of greater hardness (e.g., metal door frame).

In addition to creating a marking surface of sufficiently lower hardness wherein positioning member 500 can create the positioning mark (e.g., mark 2150), said additional layers also provide the benefit of decreasing the "gap" of travel that positioning member 500 must traverse from its initial positioning location to its location of creating the positioning mark. In situations where there is a relative large gap between a doorframe 2000 and the door 2500, such relatively large gap can cause positioning member 500 to "skew" or slant when moving from its initial positioning location to its location of creating the positioning mark (e.g., mark 2150). In skewing or slanting, the positioning mark made by positioning member 500 is not as accurately positioned compared to a position where the mark would have been made if the positioning member 500 had not become skewed or slanted. By reducing the size of the gap to be traversed by positioning member 500 before creating a positioning mark, the potential for skewing or slanting is reduced and the accuracy of location of the positioning mark is increased. Reducing the size of the gap between the door 2500 and the doorframe 2000, reduces the amount of pivoting/skewing/misalignment that positioning member 500 makes before it hits the doorframe 2000 to make the positioning mark (e.g., marks 2150 and/or 2152), and thereby increasing the accuracy of the positioning mark made. When a very large gap exists between the door 2500 and the doorframe 2000, multiple layers of gap reducers 2704, 2704', 2704", etc. can be placed on top of each other. Multiple layers further reduce the size of the gap between the door 2500 and the doorframe 2700 increasing the accuracy of the positioning mark (e.g., marks 2150 and/or 2152) to be left on the doorframe 2000.

In one embodiment the marking tape 2700 can itself act as a gap reducer and be comprised of a layer of adhesive or tape backing 2753 and a second layer of foam 2751. The adhesive layer 2753 allows the marking tape 2700 to be temporarily affixed by the user at a selected location. The body layer 2751 can be positioned on the doorframe 2000 at the approximate area where the user expects the door locking member 2600 to hit. The body layer 2751, with its relative reduced hardness compared to the hardness of the door 2500 and/or door frame 2000, facilitates the creation of an "increased visibility" positioning mark (e.g., marks 2150 and/or 2152) by positioning member 500.

The body layer 2751 can also provide a stiffening function, which can be used when the marking tape 2700 combined with gap reducer 2704 is located on a doorframe 2000 which already has an existing recessed area 2110. The thickness 2752 of the support pad 2750 also reduces the amount of the gap that positioning member 500 must traverse.

After the positioning member 500 has been used to create one or more positioning marks (e.g., marks 2150 and/or 2152) on the marking tape 2700, a punching tool (of sufficient hardness compared to the hardness of the door frame 2000), can be used (at the relative location of each positioning mark (e.g., marks 2150 and/or 2152) on the marking tape 2700), to create final positioning marks (e.g., marks 2150' and/or 2152') on the underlying door frame 2000 (at the locations of the positioning marks (e.g., marks 2150 and/or 2152) on the marking tape 2700) by pushing the punching tool at the location of a particular positioning mark (e.g., marks 2150 and/or 2152) on the marking tape 2700, through the marking tape 2700 (and through any optionally used gap reducer 2704 if used), and into the material of the underlying door frame 2000.

The above described processes effectively transfer the locations of the positioning marks (e.g., marks 2150 and/or 2152) on the marking tape 2700 to the final positioning marks (e.g., marks 2150' and/or 2152') on the underlying door frame 2000. After creating the final positioning marks (e.g., marks 2150' and/or 2152') on the underlying door frame 2000, the user removes the marking tape 2700 (and optionally used gap reducer 2704) from the door frame 2000.

The user can start the process of creating a template on the door frame 2000 based on the final positioning marks (e.g., marks 2150' and/or 2152') made on the door frame 2000. The user can place a door strike plate 2200 over the final positioning marks (e.g., marks 2150' and/or 2152') on the door frame 2000. Preferably the strike plate 2200 and deadbolt receiving plate 2204 is placed in a face down condition. The user can then trace around the now placed/located strike plate 2200 and deadbolt receiving plate 2204 to create a "positioned" template 2170 for the location of installation of the strike plate 2200 and deadbolt receiving plate 2204 on the door frame 2000. The user then removes the strike plate 2200 and deadbolt receiving plate 2204 and can then use the created template 2170 to mortise/carve/cut out in the door frame 2000 a recessed area 2122 for installing the strike plate 2200 and deadbolt receiving plate 2204. Such a process can accurately locate the installation location of the strike plate 2200 and deadbolt receiving plate 2204 compared to the door locking member 2600 (in most cases providing an exact match of with the door locking member 2600).

Procedure for Manufacturer and Model Specific Door Lock/Strike Plate Pre-Labeled Positioning Templates As shown in FIGS. 38 through 40, in various embodiments, a door lock manufactures can include a pre-labeled positioning template 2750 having transposing indicia (indicia 2770 transposing to indicia 2780 and indicia 2774 transposing to indicia 2784) for properly locating the aligned positions for screw holes 2124 and 2126 for mounting strike plate 2200 and deadbolt receiving plate 2204. In these embodiments pre-labeled positioning template 2750 can have indicia corresponding to the offset amounts between the aligned locations of the screw hole openings of the strike plate 2200 and deadbolt receiving plate 2204 and the aligned locations of the door locking member's 2600 mounting screw holes 2620 and 2630 (template 2750's indicia 2770 transposing to indicia 2780 and indicia 2774 transposing to indicia 2784). The steps in these embodiments generally follow the steps for installing other strike plate 2200 (or deadbolt receiving plate 2204 or electric strike 2206) installation embodiments such as those described for using mapping tape 4000 excepting that dedicated manufacture and/or model number "indicia and spacings" (indicia 2770 transposing to indicia 2780 and indicia 2774 transposing to indicia 2784) exist on the pre-labeled positioning template 2750 so that no estimation need be made by the user in ultimately locating the correctly aligned and positioned locations for mounting screw holes 2252 and 2256 for mounting strike plate 2200 (or deadbolt receiving plate 2204 or electric strike 2206) on frame 2000.

In one embodiment the procedure for using a manufacture and model number specific pre-labeled positioning template 2750 is generally described in the following disclosure related to FIGS. 36 through 44 for a door frame 2000 having an existing mortised area 2110. If an existing mortised area 2110 exists on door frame 2000, the following steps can be performed to create properly positioned drill holes 2124 and 2126 (locations shown in FIG. 44).

(1) Where there is an existing mortised 2110 area exists on door frame 2000, remove the strike plate 2200 from the doorframe 2000 (FIG. 36).

(2) As shown in FIG. 36, a support pad 2790 can be provided to enable support (over the expanse of bore 2112) and fill in the recessed portion of existing mortised area 2110 as shown in FIG. 37.

(3) Provide a pre-labeled positioning template 2750 as shown in FIGS. 38 and 39 having a body 2751, backing 2754, and adhesive 2753 between backing 2754 and body 2751; the backing 2754 being relatively clear/transparent and including: (a) indicia 2770, 2774 for matching up respectively for positioning marks 2150, 2154 made by positioning member 500 (on marking tape 2700 if used or directly on frame 2000 if marking tape 2700 is not used); and (b) indicia 2780, 2784 for transposing the ultimate locations of transposed positioning marks 2150', 2154' for positioning the ultimate location of screw holes 2124 and 2126 for strike plate's 2200 openings 2252,2256.

(4) Optionally, as schematically shown in FIG. 40, provide removable marking tape 2700 for placing over both the support pad 2790 (shown in FIG. 37) and door frame 2000. In various embodiments removable marking tape 2700 can be placed on the door frame 2000 to increase the ultimate visibility of the positioning marks 2150 and 2154 to be made by positioning member 500. In various embodiments removable marking tape 2700 can include an exterior layer of carbonless type marking surface which is conventionally available, such as that available for conventional duplicate check books. In various embodiments removable marking tape 2700 can also have a desired thickness to act as a gap reducer between door 2500 and frame 2000 when making a pull to create positioning marks 2150 and 2154 (or the user can in combination with the marking tape 2700 use a separate gap reducer 2704).

(5) Use positioning member 500 in door 2500 to make positioning marks 2150 and 2154 as described and shown in FIGS. 14-17 (positioning marks 2150 and 2154 are shown in the FIG. 40).

(6) As schematically shown in FIG. 41, align the positioning marks 2770 and 2774 of pre-labeled positioning template 2750 over positioning marks 2150 and 2150 and stick template 2750 on frame 2000 at this aligned position. Now the proper locations to create screw holes on frame 2000 for strike plate 2200 are shown by indicia 2780 and 2784 of template 2750.

(7) Optionally, drill screw holes 2124 and 2126 directly in frame 2000 at the locations indicia 2780 and 2784 shown on template 2750. Alternatively, create in frame 2000 transposed positioning marks 2150' and 2154' at the locations of indicia 2780 and 2784, and then drill screw holes 2124 and 2126 through the transposed positioning marks 2150' and 2154' and into frame 2000. Now drilled screw holes 2124 and 2126 will align for proper mounting of strike plate 2000 using the openings 2252 and 2256 of strike plate 2200. The process of creating screw holes 2124 and 2126 may require the plugging of original screw holes 2114 and/or 2116.

(8) If required relocate the mortised area 2110 as shown and described in FIGS. 43 and 44 (schematically indicated by area 2170).

(9) Mount strike plate 2200 (or deadbolt receiving plate 2204) using the newly created screw holes 2124 and 2126.

Alternatively, if there is no existing mortised area on the frame 2000 steps (1), (2), and (8) can be omitted, and the following procedure used.

(1) Provide a pre-labeled positioning template 2750 as shown in FIGS. 38 and 39 having a body 2751, backing 2754, and adhesive 2753 between backing 2754 and body 2751; the backing 2754 being relatively clear/transparent and including: (a) indicia 2770,2774 for matching up respectively for positioning marks 2150, 2154 made by positioning member 500 (on marking tape 2700 if used or directly on frame 2000 if marking tape 2700 is not used); and (b) indicia 2780,2784 for transposing the ultimate locations of transposed positioning marks 2150', 2154' for positioning the ultimate location of screw holes 2124 and 2126 for strike plate's 2200 openings 2252,2256.

(2) Optionally, as schematically shown in FIG. 40, provide removable marking tape 2700 for placing over door frame 2000. In various embodiments removable marking tape 2700 can be placed on the door frame 2000 to increase the ultimate visibility of the positioning marks 2150 and 2154 to be made by positioning member 500. In various embodiments removable marking tape 2700 can include an exterior layer of carbonless type marking surface which is conventionally available, such as that available for conventional duplicate check books. In various embodiments removable marking tape 2700 can also have a desired thickness to act as a gap reducer between door 2500 and frame 2000 when making a pull to create positioning marks 2150 and 2154 (or the user can in combination with the marking tape 2700 use a separate gap reducer 2704).

(3) Use positioning member 500 in door 2500 to make positioning marks 2150 and 2154 as described and shown in FIGS. 14-17 (positioning marks 2150 and 2154 are shown in the FIG. 40).

(4) Align the positioning marks 2770 and 2774 of pre-labeled positioning template 2750 with over positioning marks 2150 and 2150 and stick template 2750 on frame 2000 at this aligned position. This aligned condition can be seen in FIG. 41 but existing mortised area 2110 and bore 2112 must be omitted so that the pre-labeled positioning template 2750 is placed directly over a generally smooth area of frame 2000. Now the proper locations to drill are shown by indicia 2780 and 2784 of template 2750.

(5) Optionally, drill screw holes 2124 and 2126 directly in frame 2000 at the locations indicia 2780 and 2784 shown on template 2750. Alternatively, create in frame 2000 transposed positioning marks 2150' and 2154' at the locations of indicia 2780 and 2784, and then create screw holes 2124 and 2126 through the transposed positioning marks 2150' and 2154' and into frame 2000. Now newly created screw holes 2124 and 2126 will be in an aligned condition for proper mounting of strike plate 2200 (or deadbolt receiving plate 2204) using the openings 2252 and 2256 of strike plate 2200.

(6) Mount strike plate 2200 using the newly created screw holes 2124 and 2126.

In various embodiment the support pad 2700 can be cut to size by the user to fit into mortised area. In various embodiments the lining backing 2751 can be cut to size by the user to fit into the mortised area.

In various embodiments the methods and apparatus can be used to install strike plates 2200, deadbolt receiving plates 2204, electric strikes 2206, ball catches, drop bolts, recessed magnetic locks, and other lock receiving apparatuses in door frames 2000 for doors 2500 including door locking members 2600.

Alarm Sensor Installation

Physical Features

Figure 45:
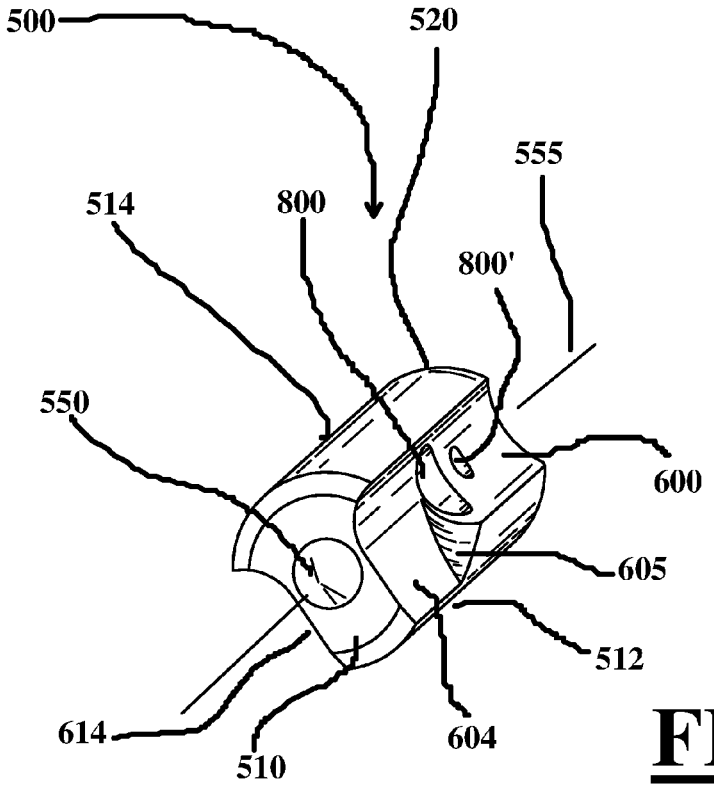
FIG. 45 shows a perspective view of an alternative embodiment of a positioning member for use in installation of alarm sensors.
Figure 46:
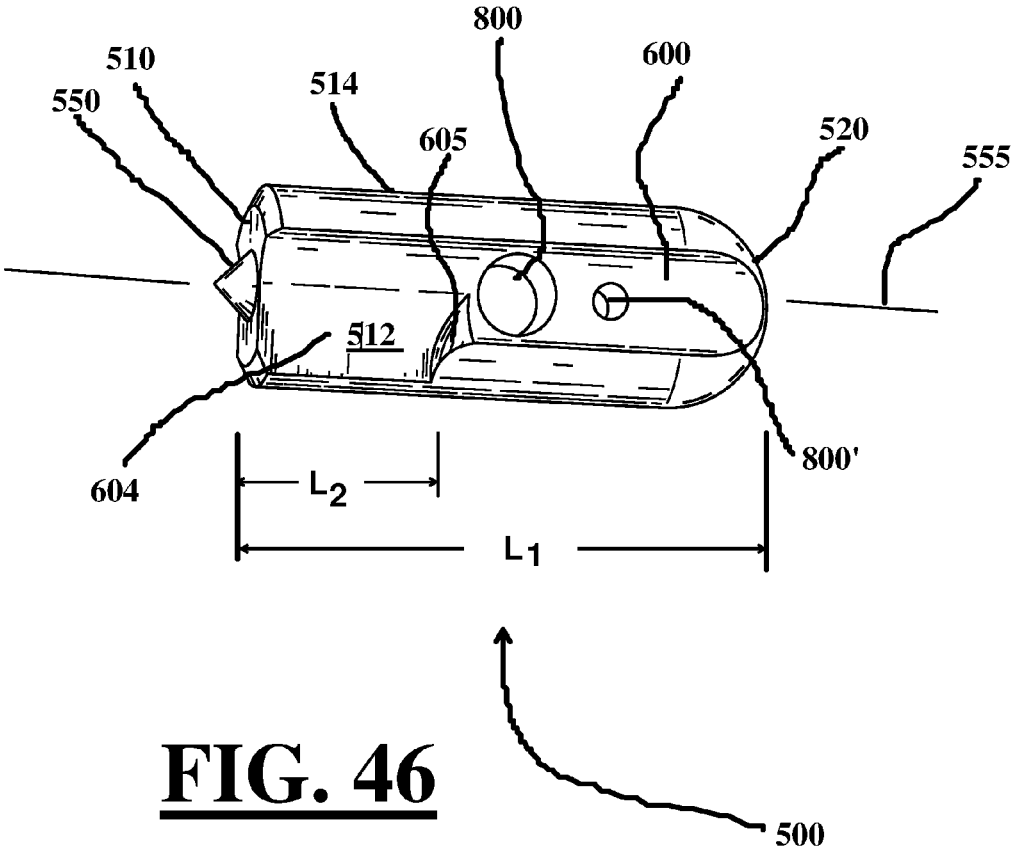
FIG. 46 shows a perspective view of the positioning member of FIG. 45 rotated from the angular orientation of said figure.

FIGS. 45 and 46 show one embodiment of a positioning member 500 with marking point 550, with the positioning member having two longitudinal grooves 600 and 610 symmetrically spaced apart (180 degrees from each other). FIG. 45 is a lower perspective view of positioning member 500 for use in installation of alarm sensors, which positioning member 500 has two horizontal openings or bores 800 and 800'. FIG. 46 is a side view of the positioning member 500.

Positioning member 500 can include first end 510, second end 520, and have a length "L1". First end 510 can include a pointed area 550 which can act as punch 700. In a preferred embodiment second end 520 can be rounded, hemispherically shaped, curved, and/or pointed to allow for easy insertion into an opening. In a preferred embodiment, positioning member 500 is symmetrically shaped with pointed area 550 being located in the longitudinal center line 555.

In various embodiments positioning member 500 can include marking point 550 on bottom side 510 and rounded positioning member on top 520, with positioning member 500 having two longitudinal grooves (600, 610).

Positioning member 500 can also include a opening spanning from one side to the other side, such as from groove 600 to groove 610.

In one embodiment positioning member 500 can include one or more longitudinal grooves 600, 610, and/or 620 (although groove 620 is not shown in the drawings) about its positioning surface 530. In one embodiment one groove 600 is provided. In one embodiment two grooves 600 and 610 are provided which are symmetrically spaced apart 180 degrees from each other.

In one embodiment the positioning member 500 includes a plurality of grooves 600 and 610 which are substantially parallel to the longitudinal centerline CL of the positioning member 500.

In one embodiment the positioning member 500 can include at least one bore 800 which is substantially perpendicular to the longitudinal centerline CL 555 of the positioning member 500. In one embodiment positioning member 500 can include two horizontal openings 800 and 800' which can be of different sizes. Opening 800' can be smaller than opening 800. In various opening 800' can be 25, 30, 35, 40, 45, 50, 55, 60, 65, 70, 75, 80, 85, 90, 95, 96, 97, 98, 99, and 100 percent of the cross sectional area of opening 800. In various embodiments opening 800' can be between about any two of the above referenced percentages of the cross sectional area of opening 800.

In various embodiments the vertical length L2 of openings 604 and 604 can be at least 3 percent of the length L1 of positioning member 500. In various embodiments the length L2 can be at least 5, 10, 15, 20, 25, 30, 35, 40, 45, 50, 55, 60, 65, 70, 75, 80, 85, 90, 95, 97, and 99 percent of length L1. In various embodiments L2 can be between about any two of the above referenced percentages of L1.

FIGS. 47 through 65 schematically illustrate the steps of using positioning member 500 inserted in a door frame 2000, in combination with a force application system 900 (e.g., pull cord) to apply force (schematically indicated by arrow 2070) on the positioning member 500 with marking tip 550.

Insertion and Self Sticking

Figure 47:
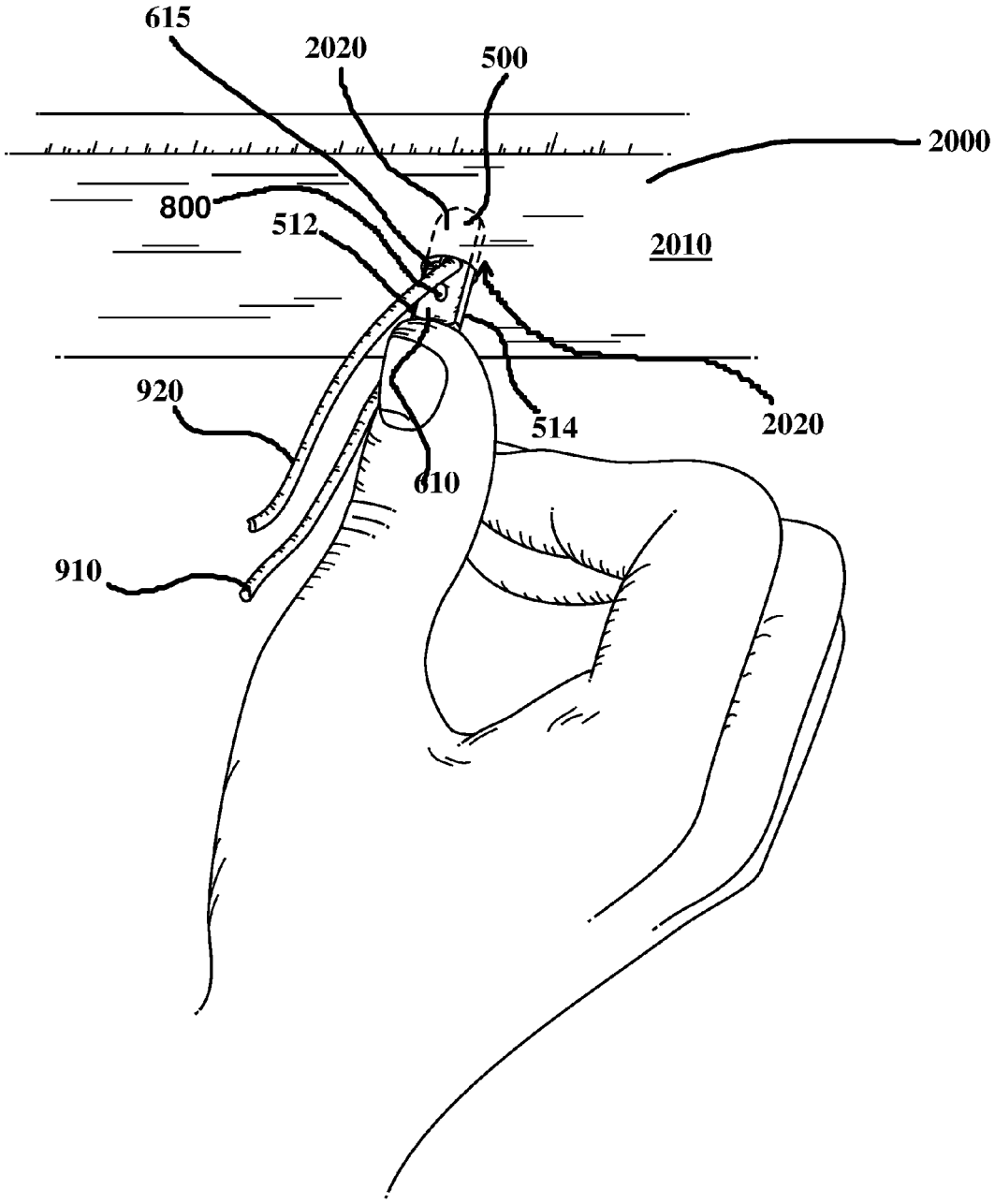
FIG. 47 shows a perspective view of the positioning member of FIG. 45 being inserted into an opening of a door frame with a pull cord hanging from the positioning member.
Figure 48:
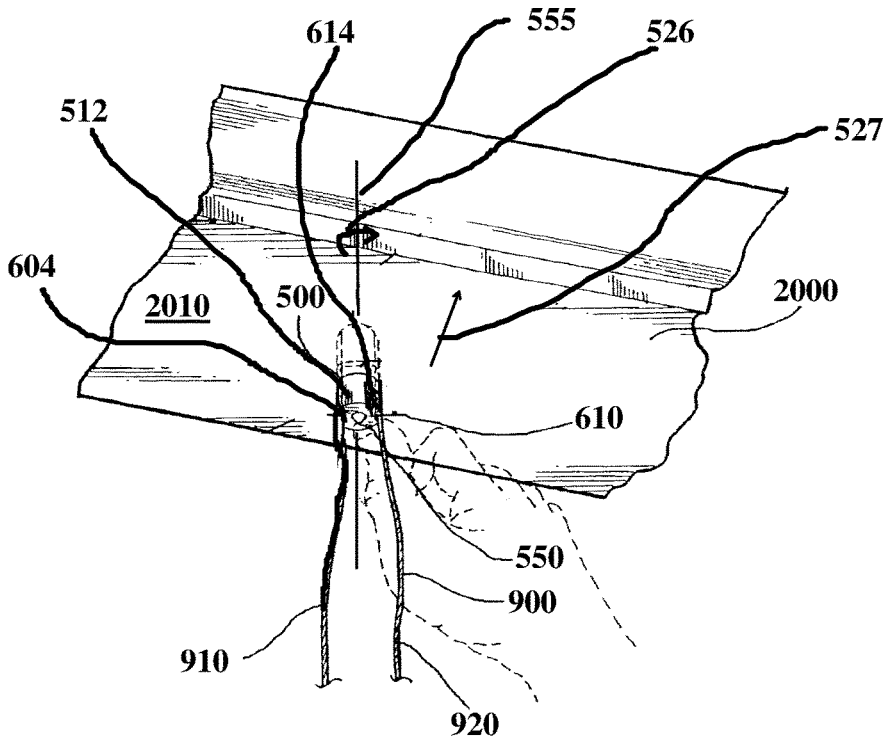
FIG. 48 shows a perspective view of the positioning member of FIG. 45 now inserted into an opening of a door frame with a pull cord hanging from the positioning member.

FIGS. 47 and 48 show positioning member 500 (with pull cord 900 threaded through bore 800') being placed into an alarm sensor hole 2020 of door frame 2000, and with door 2500 being in an open state. A flexible member 900 can be threaded through the bore 800 or bore 800'. Flexible member 900 can have first and second ends 910 and 920 and threaded through bore 800. In one embodiment the flexible member 900 is a rope, wire, chain, cord, or string.

Door frame 2000 can have a door sensor system 10 which includes contact wire 20 along with upper 12 and lower sensor 14 elements. Door sensor system 10 (which includes upper sensor 12 and sensor wire 20) can be installed in the upper portion of a door frame 2000 (see FIG. 65). The header of door frame 2000 can have opening 2020 which had been previously made (such as by a drill), and can include a sensor wire 20 hanging from the opening 2020. Although not shown, header can have both a front and rear portion with a door jam towards the rear and weather stripping placed on the door jam.

Figure 49:
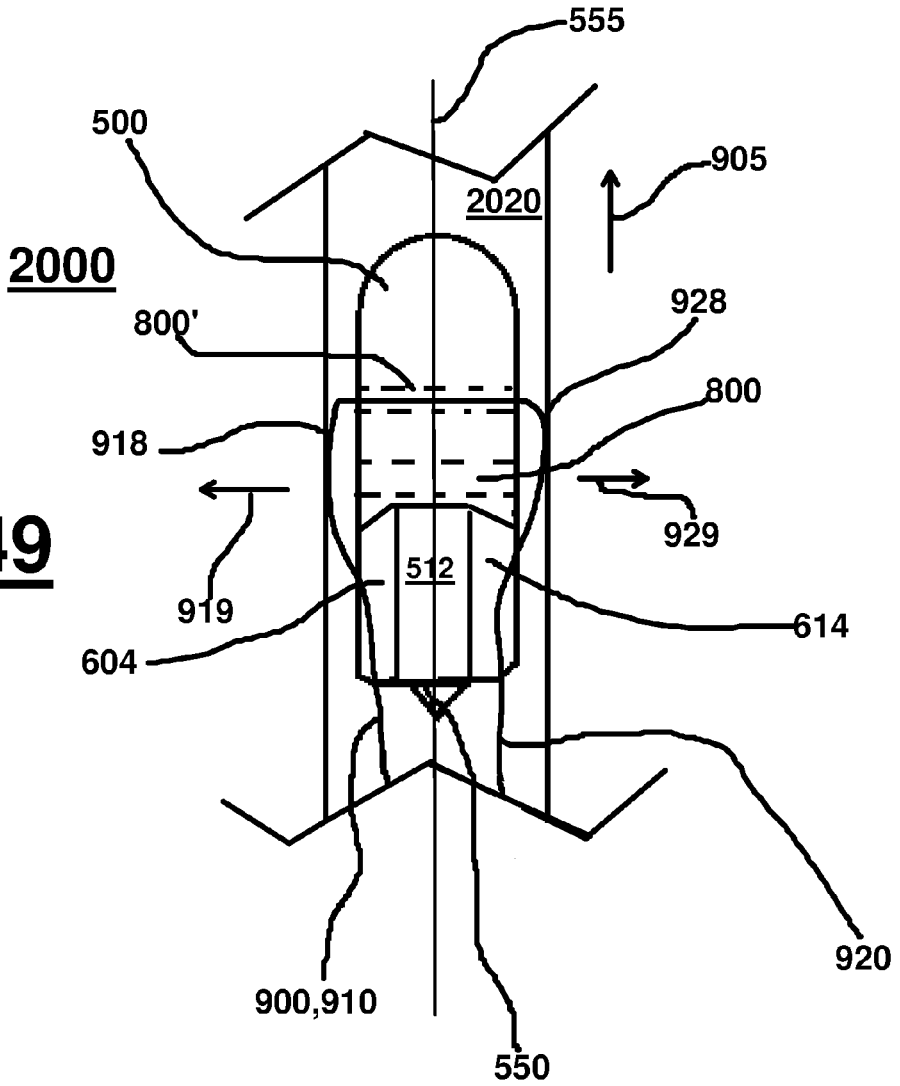
FIGS. 49 and 50 are schematic side and bottom views of positioning member inserted into alarm sensor hole, and schematically indicating that a pull cord will tend to push outwardly to the interior walls of alarm sensor hole such that outwardly pushing cord segments will tend to frictionally hold positioning member vertically in place in opening until door can be closed and the a pull process started.
Figure 50:
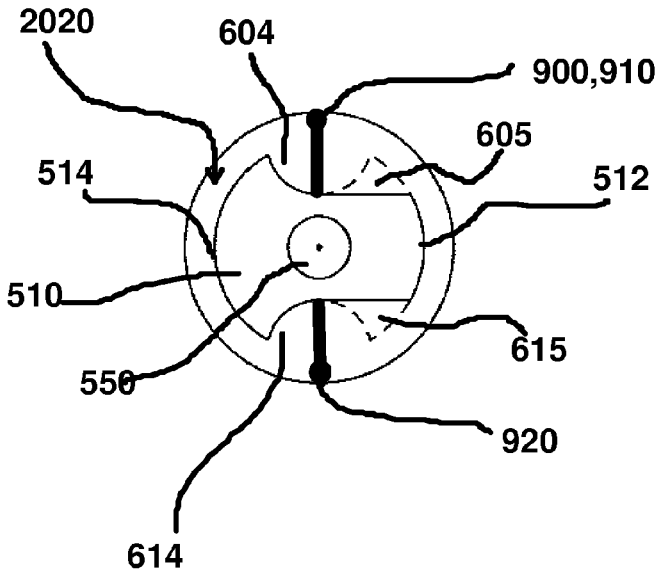

To avoid the tendency of positioning member 500 to fall out of opening 2010 (after being inserted into opening 2010), segments of pull cord 900 can be used as a frictional restraint. FIGS. 49 and 50 are schematic side and bottom views of positioning member 500 inserted into alarm sensor hole 2020, and schematically indicating that pull cord 900 will tend to push outwardly (schematically indicated by arrows 919 and 929) to the interior walls of alarm sensor hole 2020 such that outwardly pushing cord segments 910 and 920 will tend to frictionally hold positioning member 500 vertically in place in opening 2020 until door 2500 can be closed and the a pull process started. The gap between positioning member 500 and the interior walls of sensor hole 2020 is exaggerated in FIGS. 49 and 50, an in actually installation circumstances such gap is expected to be much smaller than that shown in FIGS. 49 and 50, but large enough that positioning member 500 would fall out of sensor hole 2020 without the pushing outward of pull cord 900.

Rotational Self-Alignment

Positioning surface 530 of positioning member 500 longitudinally aligns positioning member 500 about the centerline CL of opening 2020 made in header 2010 of frame 2000. After insertion into opening 2020, marking point 550 of positioning member 500 is now located about in the longitudinal center of opening 2020 for header 2010. When door 2500 is closed in frame 2000, pulling on pull cord 900 (schematically indicated by arrow 2070) causes marking point 550 to create a mark 2550 in door 2500. In this manner, when door 2500 is closed, mark 2550 is also aligned with centerline CL of opening 2020.

In various embodiments positioning member 500 can be "self aligning" rotationally during a pull from pull cord 900. FIGS. 51 through 56 schematically indicate this rotational self aligning property of positioning member 500.

Figure 51:
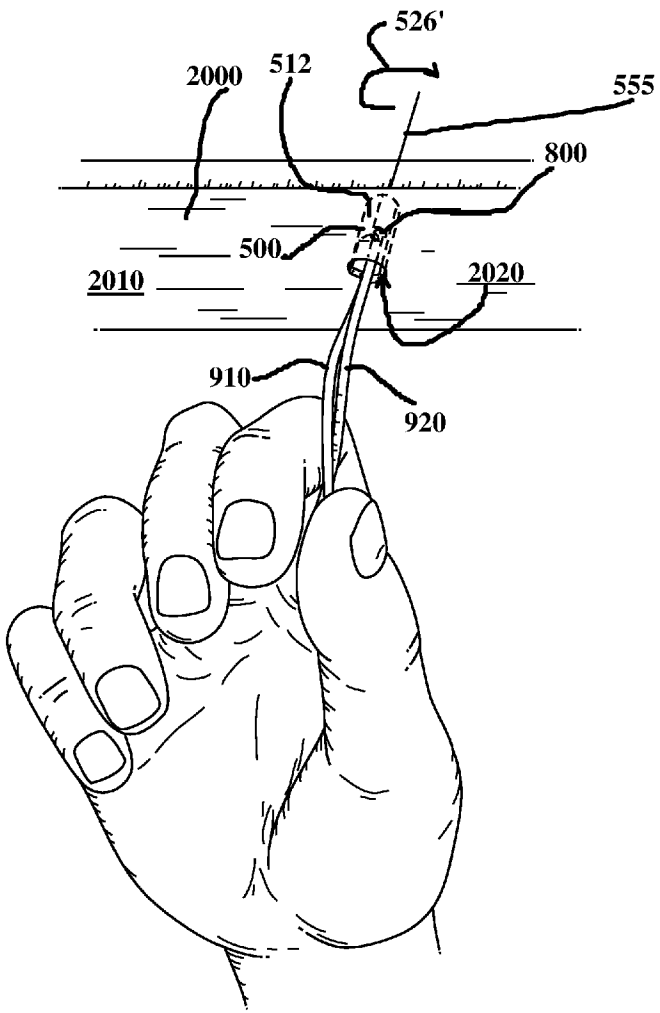
FIG. 51 is a perspective view of the positioning member inserted into an opening of a door frame with a pull cord hanging from the positioning member.
Figure 52:
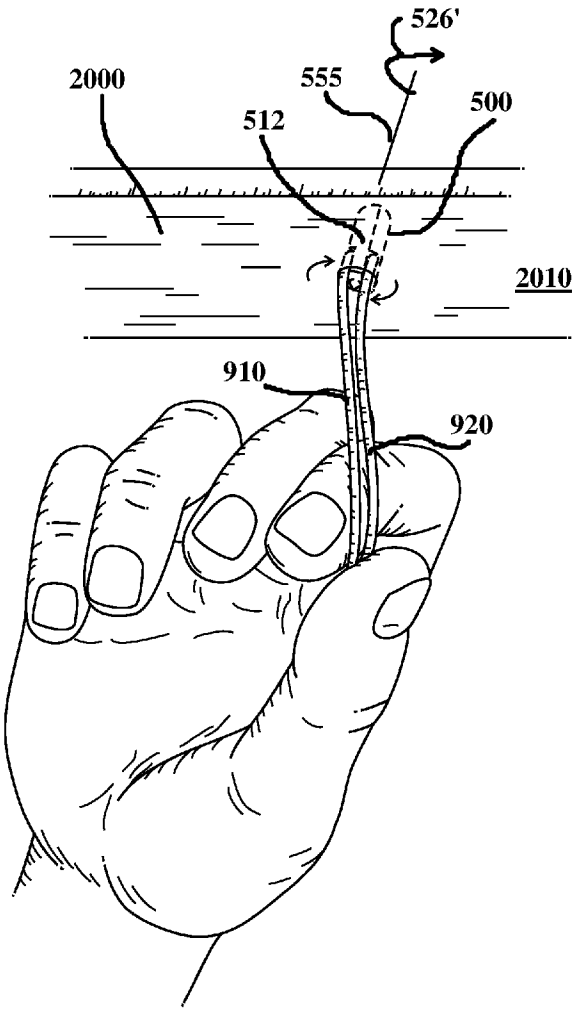
FIG. 52 is perspective view of the positioning member now inserted into opening with sections of the pull cord hanging from the positioning member.

FIG. 51 is a perspective view of the positioning member 500 inserted into an opening 2020 of a door frame 2000 with a pull cord 910,920 hanging from the positioning member 500. FIG. 52 is perspective view of the positioning member 500 now inserted into opening 2020 with sections 910,920 of pull cord 900 hanging from the positioning member 500. Arrow 526 schematically indicates that side 512 or offset from the direction of pull (schematically indicated by arrow 527) on pull cord 500.

Avoidance of Snagging During a Pull

In various embodiments positioning member 500 has the ability to both avoiding snagging with pull cord 900, and rotate relative to opening 2020 during a pull.

To avoid snagging of pull cord 900's sections 910 and/or 920, during a pull between positioning member 500 and an opening 2010 that positioning member 500 is inserted into, the grooves 600 and 610 of positioning member 500 can be "opened" towards lower first end 510 of positioning member 500. For example, groove 600 can include opened area 604 with a smooth or tapered shoulder 605. Groove 610 can include opened area 614 with a smooth or tapered shoulder 615. One side of positioning member 500 can be identified as 512 and the opposing side can be identified as 514. Side 512 is thinner than side 514 because the open areas 604 and 604 "open" towards side 512. In other embodiments (although not shown) open areas can be symmetric towards both side 512 and 514, although such may give less support for accurate marking by marking point 550 when positioning member is pulled by pull cord 900.

Figure 53:
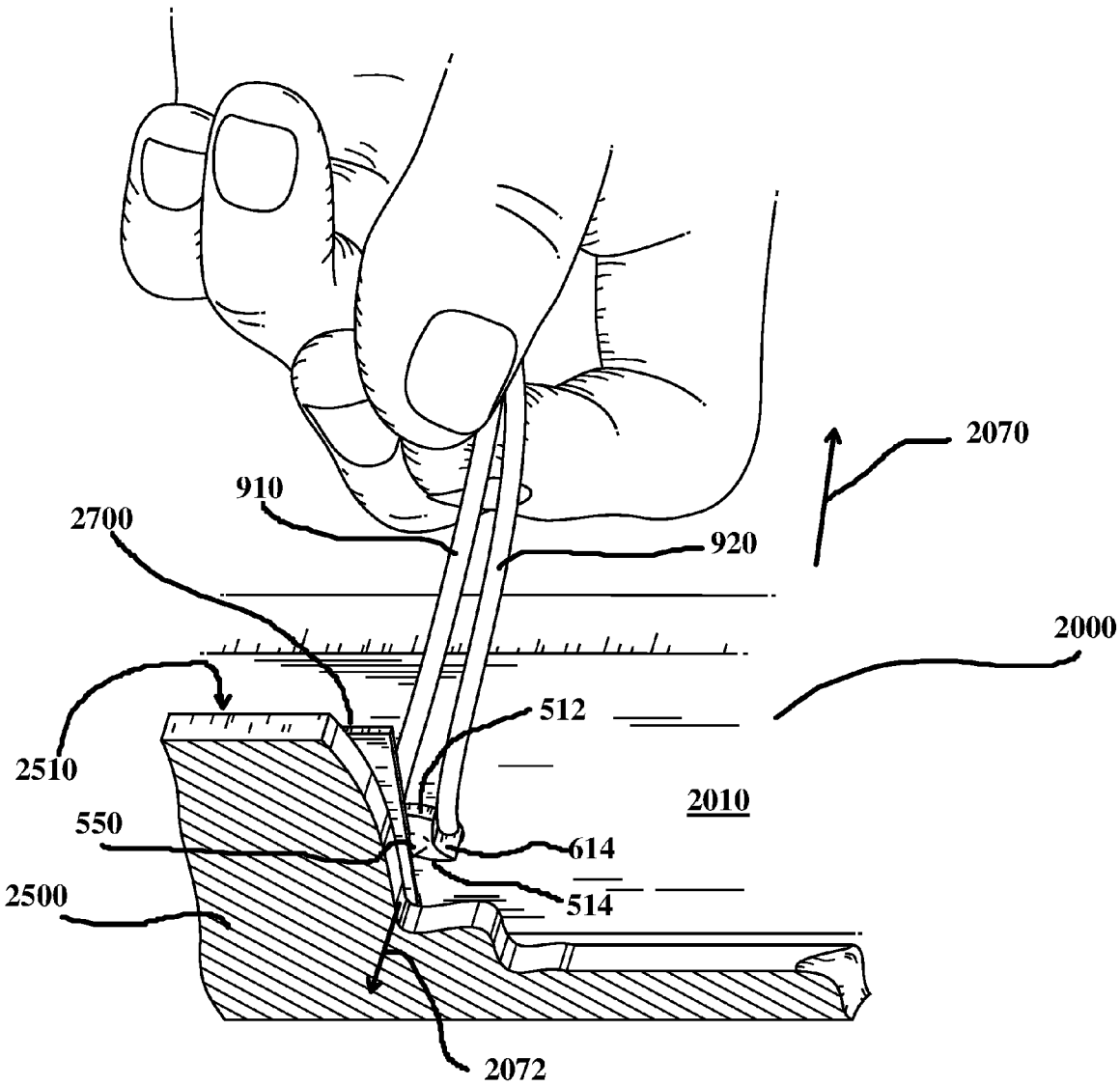
FIGS. 53 and 54 are perspective views of the positioning member of FIG. 45 showing how a user pulling on the pull cord causes the angular orientation of positioning member to line up with the direction of pull.
Figure 54:
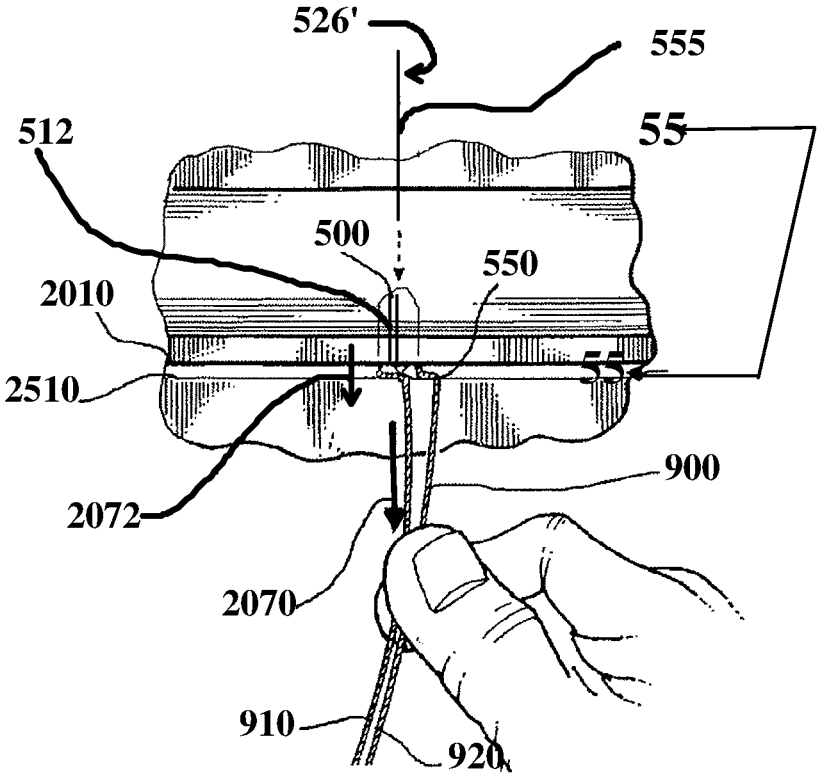

Before including open areas 604 and 614, there was a tendency for snagging to occur with pull cord 900 during a pull. Including open areas facilitate a correcting of misalignment of side 512 of positioning member 500 in the direction 527 of pull. FIGS. 53 and 54 are perspective views of the positioning member 500 schematically indicating how pulling on the pull cord 900 (sections 910,920) causes the angular orientation of positioning member (schematically indicated by arrow 526') to line up with the direction of pull. In FIGS. 53 and 54 the user pulls (schematically indicated by arrow 2070) on pull cord 900, which pulling causes a rotation of positioning member 500 relative to opening 2020 (schematically indicated by arrow 526') along with a downward movement of positioning member (schematically indicated by arrow 2072). In various embodiments the amount of correcting alignment during a pull (schematically indicated by arrow 526') can be at least 5 degrees of rotation about the centerline 555 of positioning member 500. In various embodiments the amount of corrective alignment can be at least 7, 8, 9, 10, 15, 20, 25, 30, 35, 40, 45, 50, 55, 60, 65, 70, 75, 80, 85, and 95 degrees of corrective rotation. In various embodiments the amount of corrective alignment can be between about any two of the above referenced degrees of rotation. FIG. 53 shows a perspective view of positioning member 500 with a user pulling on the pull cord (schematically indicated by arrow 2070), with such force causing positioning member 500 to move downwardly (schematically indicated by arrow 2072). FIG. 54 shows a perspective view of positioning member 500 with a user pulling on the pull cord (schematically indicated by arrow 2070), with such force causing positioning member 500 to both angularly orient face 512 of positioning member 500 towards the user (schematically indicated by arrow 526') and move downwardly (schematically indicated by arrow 2072).

Figure 55:
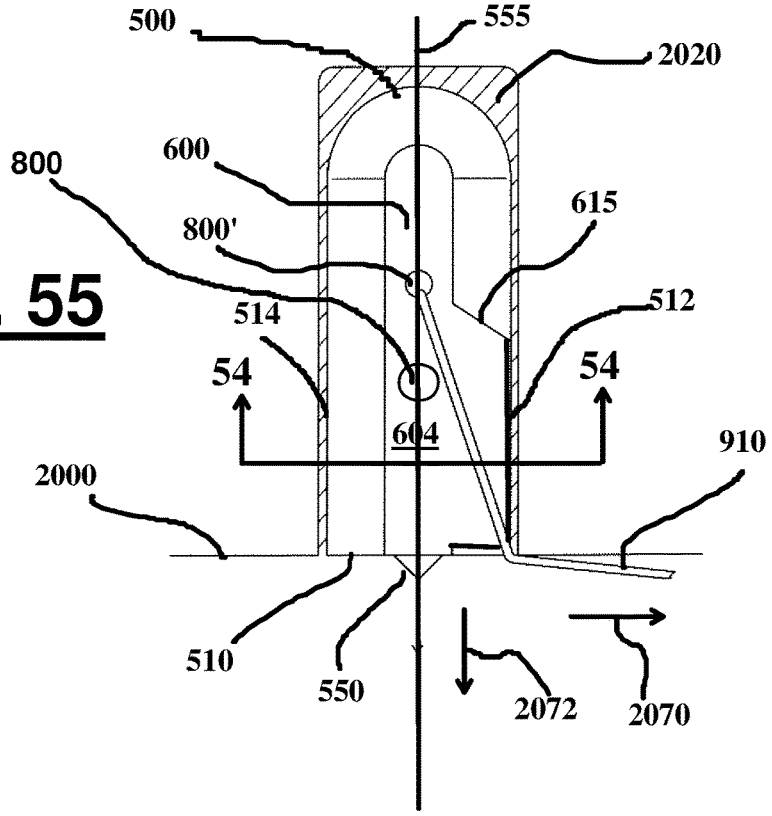
FIG. 55 is a side sectional view of the positioning member of FIG. 45.

FIG. 55 is a side sectional view of the positioning member 500.

Figure 56B:
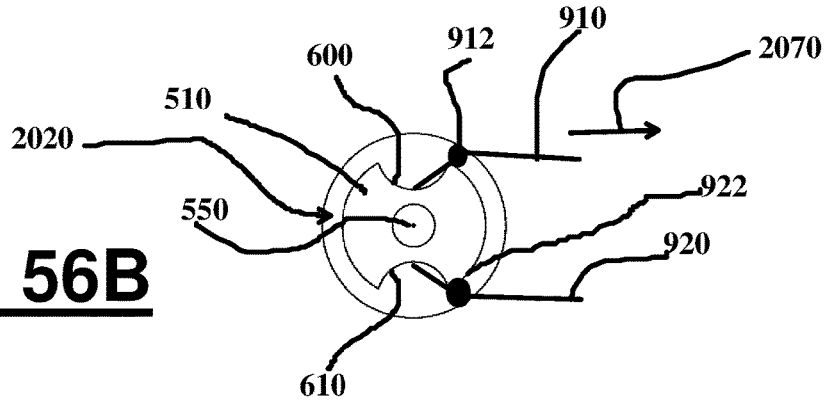
FIGS. 56A and 56B are bottom views of two embodiments of positioning member shown in the bore of the door frame with FIG. 56A showing adequate room for the two pull cord segments and FIG. 56B showing the two pull cord segments being caught between the sides of the positioning member and the bore of the door frame.
Figure 56A:
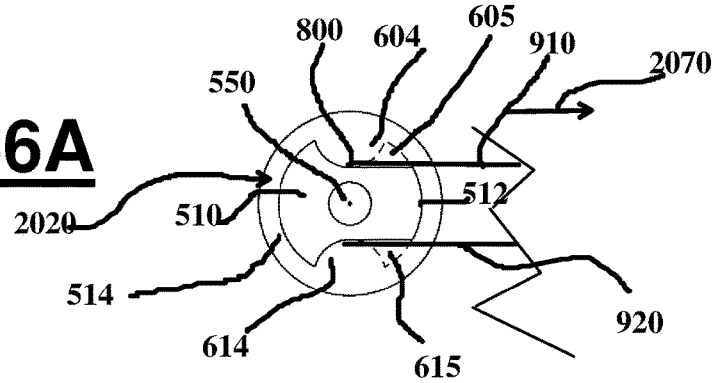

FIGS. 56A and 56B are bottom views of two embodiments of positioning member 500 shown in the bore of the door frame 2000 with FIG. 56A showing adequate room for the two pull cord segments 910,920 and FIG. 56B showing the two pull cord segments 910,920 being caught (schematically indicated by points 912,922) between the sides of the positioning member 500 and the bore 2020 of the door frame 2000.

Process of Making Positioning Marks

FIGS. 57 through 65 schematically indicate the steps of using positioning member 500 and pull cord 900 to make positioning marks.

Figure 57:
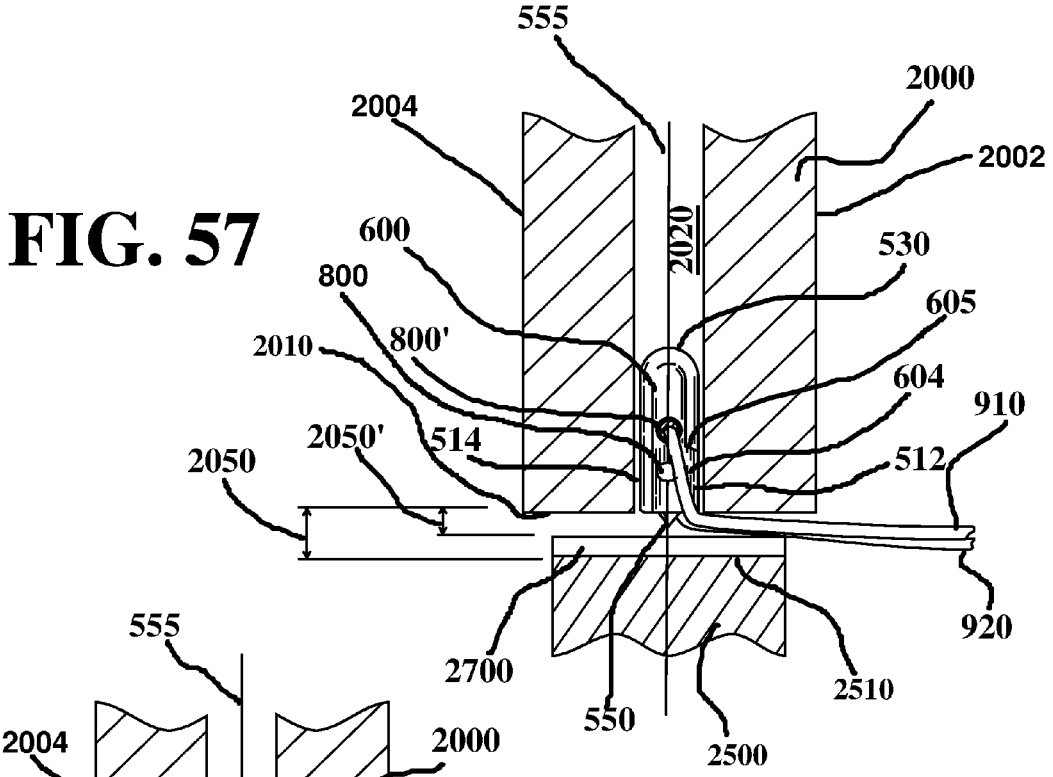
FIG. 57 is a side sectional view of the positioning member of FIG. 45 before force is applied to the pull cord, and while the door is in a closed position.
Figure 58:
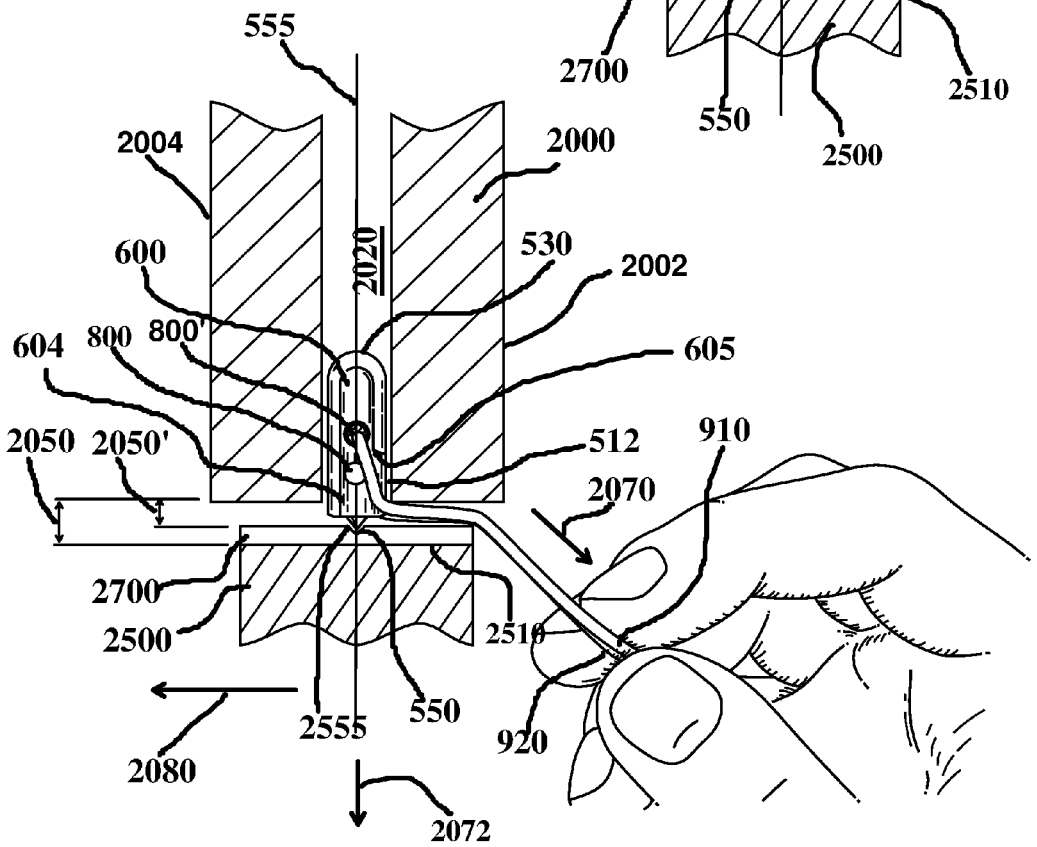
FIG. 58 is a side sectional view of the positioning member of FIG. 45 after force is applied to the pull cord, and while the door is in a closed position.
Figure 59:
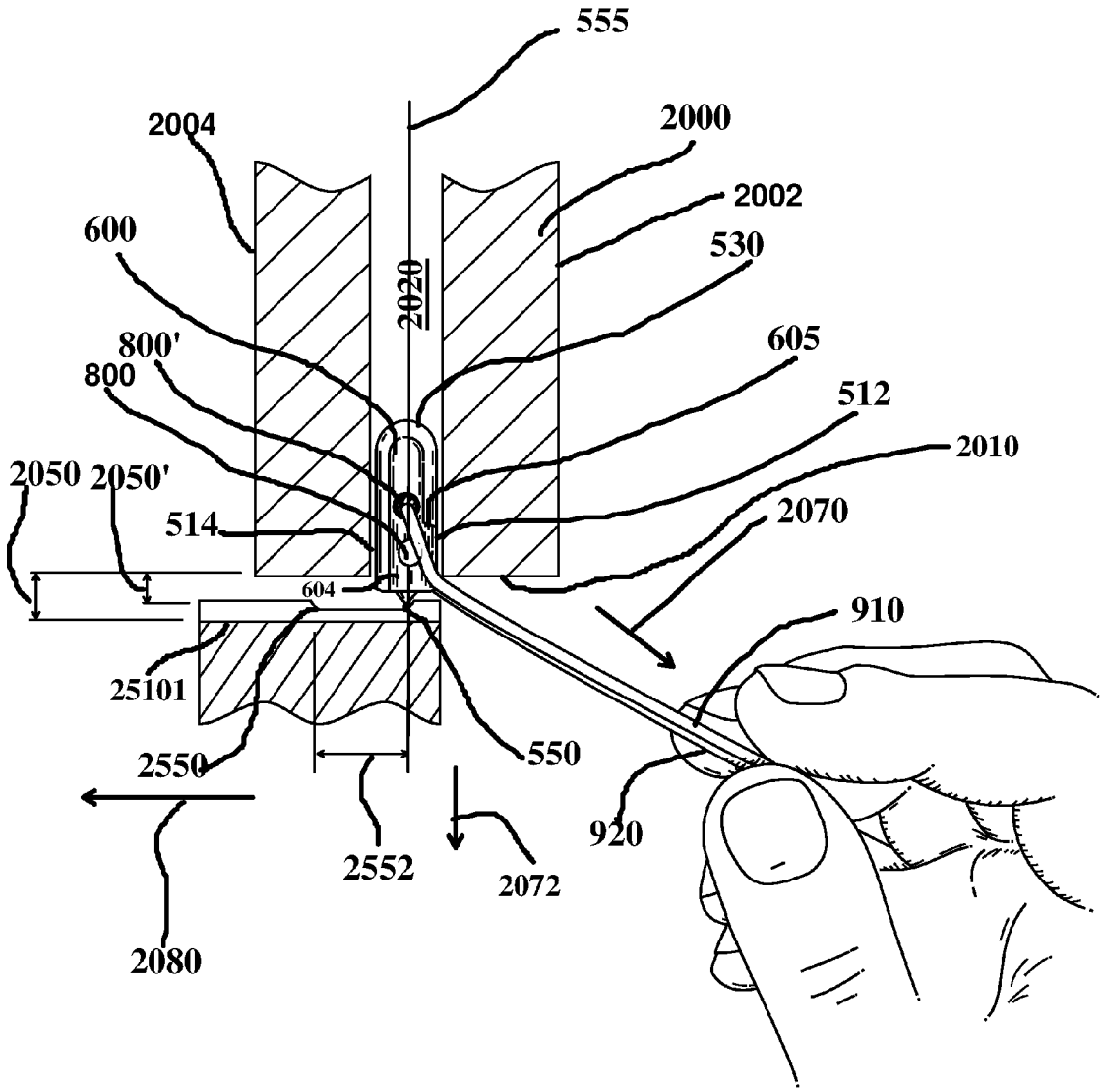
FIG. 59 is a side sectional view of the positioning member of FIG. 45 after force is applied to the pull cord and while the door is being opened.

FIG. 57 is a cutaway sectional view of a closed door 2500 and frame 2000 before any significant force is put on pull cord sections 910 and 920 so that the marking member 550 is recessed in the opening 2020. FIGS. 58 and 59 schematically indicate that force in the direction of arrow 2070 is applied by pulling on pull cord 900 causing marking point 550 to make a mark, indentation, scratch or scar 2550 on the top 2510 of the door 2500.

FIG. 57 is a side sectional view of the positioning member 500 with the door 2500 in a closed state, and before force is applied to the pull cord 900, and while the door 2500 is in a closed position. Preferably door 2500 is closed with door hardware (e.g., door knob 2504 and strike plate 2200) on the door 2500/frame 2000 so that the door 2500 will lock in place in the strike plate 2200 (as the door will normally be used). When closed pull cord 900, coming out of opening 800' can fit within open areas 604 and 614, and then in the gap 2050' between the top 2510 of the door 2500 and the header 2010 of the door frame 2000. If present, the hanging wire 20 also fits between the top 2510 of the door 2500 and the header 2010 of the door frame 2000. Although pull cord 900 is shown going through upper opening 800', in these embodiments threading pull cord 900 through lower opening 800 is also contemplated.

FIG. 58 is a side view of a closed door 2500 and frame 2000 after significant force is put on pull cord sections 910 and 920 so that the marking member 550 extends from the opening 2020 and makes a mark 2550 on the marking material 2700. Pulling on pull cord 900 (schematically indicated by arrow 2070), while positioning member 500 is in hole 2020 of top door frame 2010, and with door 2500 closed, causes positioning 500 member to move downwardly (schematically indicated by arrow 2072) and towards door 2500. If desired, door 2500 can be opened while force 2070 is applied to pull cord 900.

FIG. 59 is a side sectional view of positioning member 500 after force is applied to the pull cord 900 (schematically indicated by arrow 2070) causing positioning member to be forced downwardly (schematically indicated by arrow 2072) and while the door 2500 is being opened (schematically indicated by arrow 2080). In this manner a scratch, scar 2552 from point mark 2550 can be made. FIG. 57 is a sectional view of a partially open door and frame while significant force is put on pull cord sections 910 and 920 so that the marking member 550 extends from the opening 2020 and makes a mark 2550 on the marking material 2700, and after the door 2500 has been partially opened while maintaining significant force which continued application of force in combination with opening the door 2500 causes the marking member to make an extended mark or scratch 2552 on the marking material 2700. In another embodiment mark 2550 and extended mark 2552 can be made directly on the door 2500 without the use of removable marking material 2700. In theses figures the door 2500 is schematically being shown as pushed away from the user (i.e., towards the rear 2004 of the door frame 2000). In other embodiments the user can pull the door 2500 towards himself during the marking process (i.e., in the opposite direction of arrow 2080). This type of door 2500 opening and marking process is schematically shown by the drawings by flipping the direction of arrow 2080 (direction of movement of the door 2500) in the figures and is shown in the embodiments discussed in FIGS. 8-22 but on the side of the door 2500 when installing a strike plate.

Typically in these embodiments without removable marking material 2700 the door 2500 itself is sufficiently soft that marking member 550 can adequately make a mark 2550 without the necessity of using removable marking material 2700. In various embodiments markings 2720 can be made with pen, pencil, marker, crayon, felt tip marker, and other marking instruments.

Figure 60:
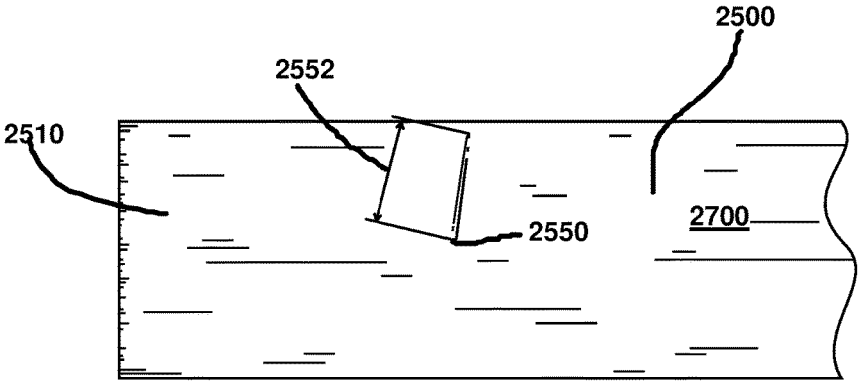
FIGS. 60 and 61 show a positioning mark which is left by the positioning member of FIG. 45.
Figure 61:
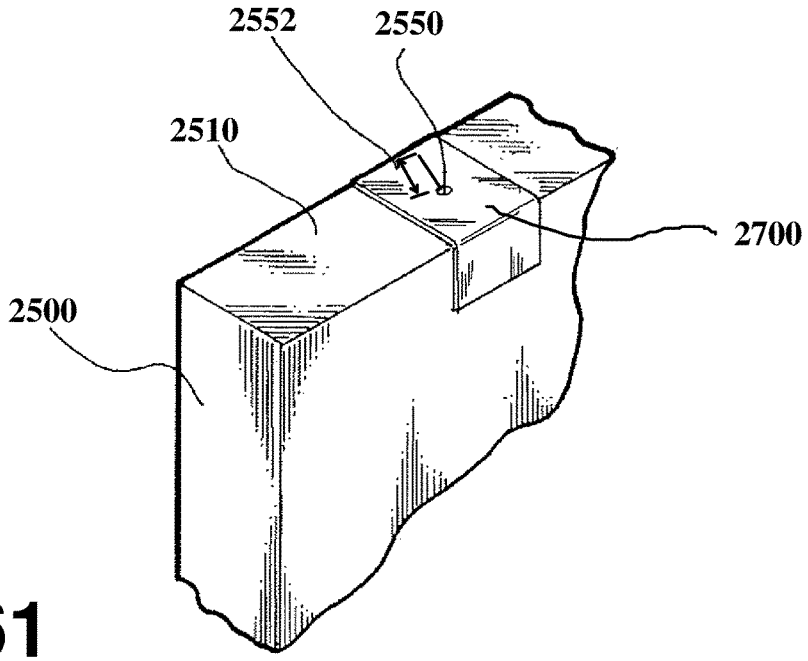

FIGS. 60 and 61 are perspective and top views of door 2500 with an extended mark 2552 made on the removable marking material 2700. In FIG. 60, mark 2550 and extended mark 2552 can be made directly on the door 2500 without the use of removable marking material 2700 (FIG. 61 shows the use of marking tape or a marking pad). In various embodiments markings 2720 can be made with pen, pencil, marker, crayon, felt tip marker, and other marking instruments.

After mark 2550 is made in the top 2510 of door 2500, marking apparatus 500 can be removed from opening 2020.

Figure 62:
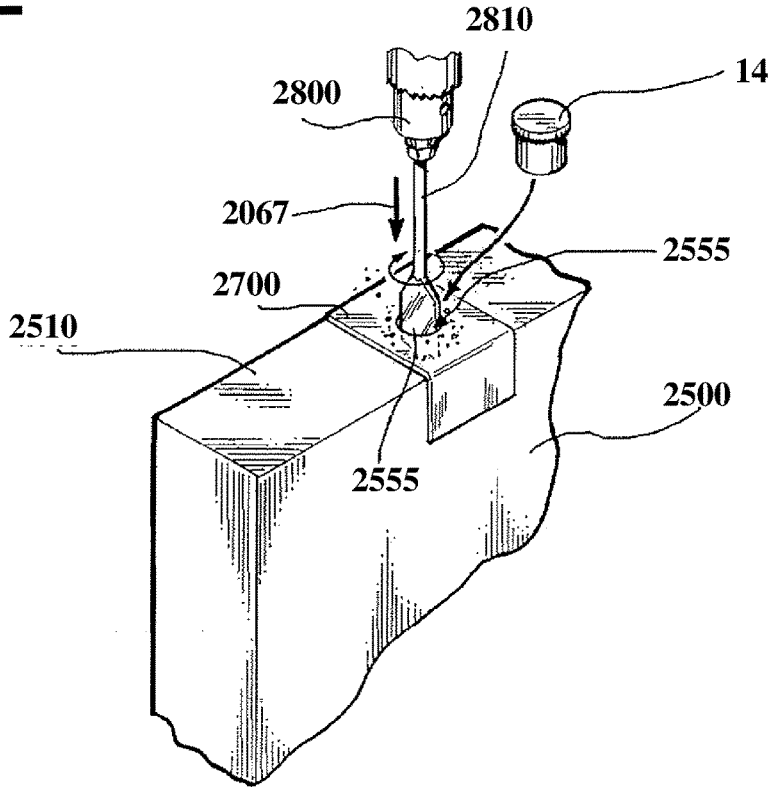
FIGS. 62 and 63 schematically show a hole being drilled on top of the door at the location of the positioning mark.
Figure 63:
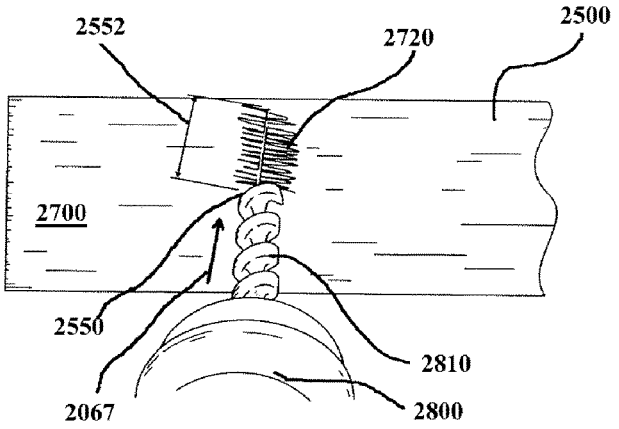

FIGS. 62 and 63 show a hole 2555 being drilled on top 2510 of door 2500 at mark 2550 with markings 2720 made around the extended mark or scratch 2552 to better identify the proper location (i.e., mark 2550) for the drill hole 2555. The hole 2555 should be the size of the lower sensor 14 to be placed in the door 2510 and should be drilled parallel to a vertical plane passing through the mark 2550 on the top 2510 of the door 2500. FIG. 62 shows the hole 2550 being drilled through the painter's tape 2700. After the hole 2550 is drilled the painter's tape 2700 should be removed from door 2500.

Figure 64:
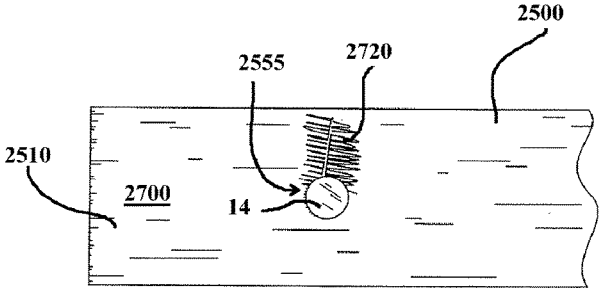
FIG. 64 shows the lower alarm sensor placed in the hole drilled in FIGS. 62 and 63.
Figure 65:
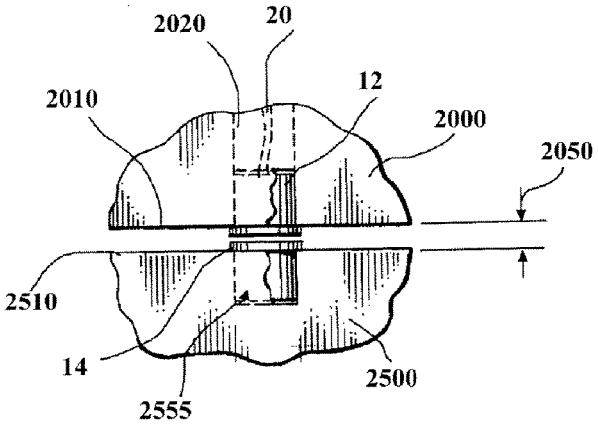
FIG. 65 shows upper and lower alarm sensors in an aligned position when the door is closed in the door frame.

FIG. 64 shows the lower alarm sensor 14 placed in the hole 2555 drilled in door 2500 shown in FIGS. 62 and 63. FIG. 65 shows upper 12 and lower 14 alarm sensors in an aligned position when door 2500 is closed in door frame 2100.

General Methods of Marking on Doors

One embodiment provides a method and apparatus for marking positions for burglar alarm sensor elements on a door 2500, the door 2500 being attached to a frame 2000 comprising the steps of:

(a) providing a positioning member 500, the positioning member 500 having a longitudinal centerline and a marking point 550, the marking point 550 being aligned with the longitudinal centerline of the positioning member 500, and the positioning member including a pair of longitudinal grooves and lower open areas;

(b) at least partially opening the 500 door;

(c) placing the positioning member 500 in a hole 2020 in the frame 2000;

(d) while the positioning member is in hole 2020, closing the door 2500 in the door frame 2000;

(e) causing the marking 550 point to make a mark 2550 on the door 2500;

(f) opening the door 2500 and removing the positioning member 500 from the hole 2020 in the frame 2000; and (g) causing an opening 2555 to be made in the door 2500 at the location of the positioning mark 2550.

In one embodiment the positioning member is attached to a flexible member 900 and in step "e" force is applied to the flexible member 900 and the positioning member 500 rotates about is longitudinal axis 555 an amount to align with the direction of the pulling force.

In one embodiment during step "e", the mark 2550 is made on marking material 2700 which is of a different material than the door 2500. For example, the marking material 2700 can be foam. In one embodiment the marking material 2700 has a substantially large thickness, and this thickness is used to reduce the gap 2050 between the door 2500 and the door frame 2000 and the thickness 2170 of the marking material 2700 reduces this gap 2050 greatly.

In various embodiments plurality of grooves 600, 610 can be used to allow contact wire 20 to hang during a pull from hole 2020 in the header 2000.

In one embodiment the door 2500 is pivotally connected to the frame 2000.

In one embodiment the door 2500 is slidably connected to the frame 2000 and the closing the door in the frame requires the door 2500 to slide parallel to the frame 2000 while the door 2500 is substantially parallel to the frame 2000.

In one embodiments is provided a method of installing an alarm sensor in a door 2500 attached to a door frame 2000, comprising the steps of:

(a) providing a positioning member 500, the positioning member 500 having a longitudinal centerline 555 and a marking point 550, the marking point 550 being aligned with the longitudinal centerline 555 of the positioning member 500, and the positioning member including a pair of longitudinal grooves and lower open areas;

(b) partially opening the door 2500;

(c) placing the positioning member 500 in a hole 2020 in the frame 2000;

(d) while the positioning member 500 is at least partially located in the hole 2020, closing the door 2500 in the door frame 2000;

(e) while the door 2500 is closed in the door frame 2000, applying force 2070 on the positioning member 500 to cause the marking point 550 of the positioning member 500 to make a positioning mark 2550 on the door 2500;

(f) after step "e", opening the door 2500 and removing the positioning member 500 from the hole 2020 in the frame 2000; and (g) after step "e", drilling an opening 2555 in the door 2500 at the location of the positioning mark 2550.

In one embodiment, during step "d" and before step "e", the door 2500 is partially opened, causing the positioning mark 2550 to be an extended mark or line 2552.

In one embodiment the positioning member is attached to a flexible member 900 and in step "e" force is applied to the flexible member 900 and the positioning member 500 rotates about is longitudinal axis 555 an amount to align with the direction of the pulling force.

Adapter for Thin Walled Door Frames Such as Metal Frames

Certain door frames 2000 may be thin walled and not solid so that a bore 2020 (schematically shown in FIGS. 70-74) is not formed and cannot provide alignment support for positioning member 500 during a pull. In such cases a thin wall adapter 5000 can be used to provide longitudinal alignment support for positioning member 500 during a pull.

Figure 66:
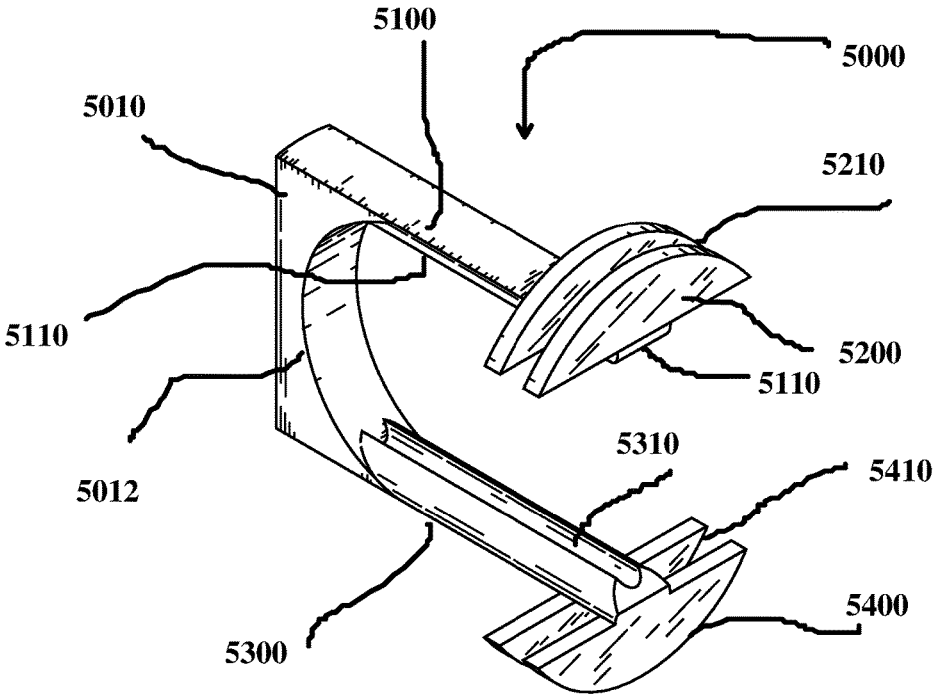
FIG. 66 shows a perspective view of an adapter member for thin walled door frames.
Figure 67:
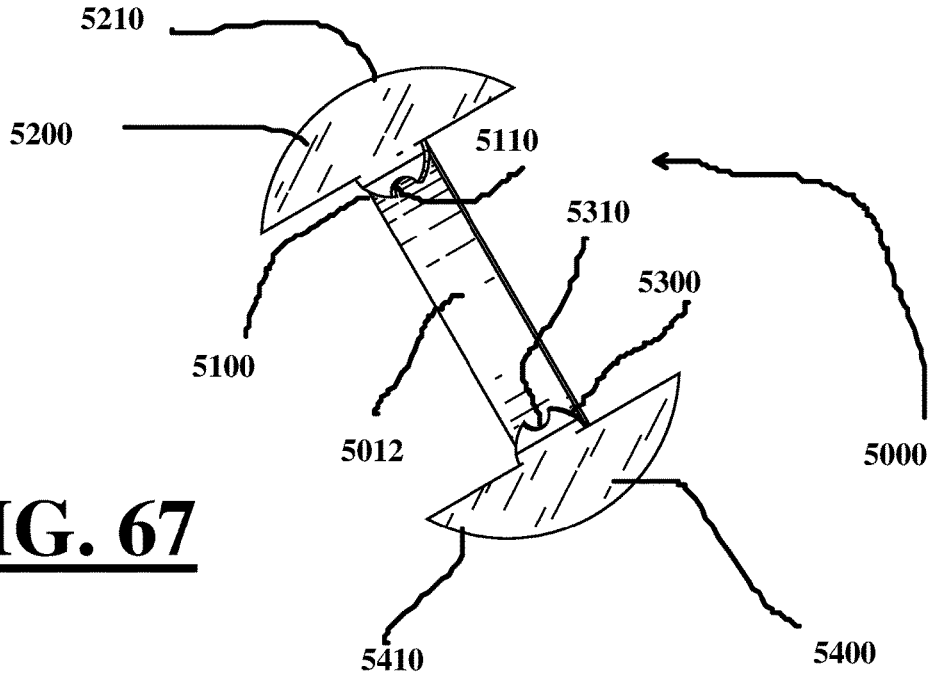
FIG. 67 shows a perspective view of the adapter member of FIG. 66 rotated from the angular orientation of said figure.

FIGS. 66 and 67 show perspective views of an adapter member 5000 for thin walled door frames. Adapter member can include body 5010, first arm 5100 and second arm 5300. First arm 5100 can include longitudinal recess 5110 and a foot 5200. Foot 5200 can include recessed area 5210. Second arm 5300 can include longitudinal recess 5310 and a foot 5700. Foot 5400 can include recessed area 5410.

Feet 5200 and 5400 of adapter member 5000 can be used to detachably connect adapter member 5000 to the thin wall of a door frame 2000.

Arms 5100 and 5300 can include longitudinal recesses 5110 and 5310 to receive at least a portion of pull cord 900 during a pull to assist in relative sliding between positioning member 500 and adapter member 500, and also assist in maintaining longitudinal alignment between positioning member 500 and adapter member 5000 during such relative sliding.

FIG. 68 shows a perspective view of adapter member 5000 being inserted into an opening 2020' of a door frame 2000. FIG. 69 shows a perspective view of adapter member 5000 now inserted into opening 2020', and being rotationally positioned (schematically indicated by arrow 5002) such that the fee 5200,5400 are respectively facing the front 2002 and rear 2004 of hollow door frame 2000. Recessed areas 5310 and 5410 connect to the thin wall of door frame 2000 at opening 2020'. In this manner adapter 5000 can be securely attached to door frame 2000.

Before being inserted into adapter 5000, positioning member 500 can have pull cord 900 threaded though upper and small horizontal bore 800' in an "S" shape—where portion 910 is in groove 610 and facing upwardly, and portion 920 is in groove 600 and facing downwardly. In any of the embodiments portion 910 in groove 610 can be facing downwardly similar to portion 920 in groove 600.

Figure 70:
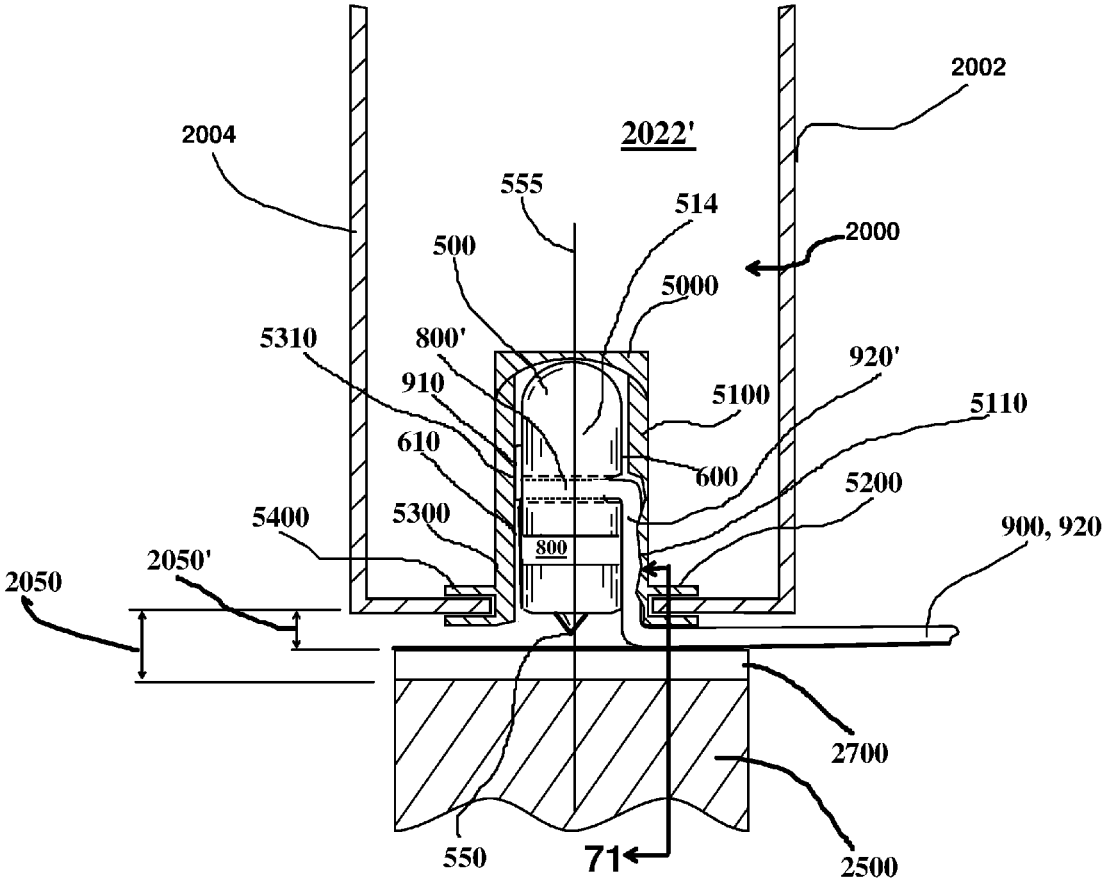
FIG. 70 shows a perspective view of positioning member of FIG. 51 being inserted into the adapter member of FIG. 64.

FIG. 70 is a side sectional view of positioning member 500 inserted into adapter member 5000, with the pull cord 900 threaded into the upper and smaller horizontal opening 800' of the positioning member 500, and the end 910 of the pull cord 900 bent upwards into the longitudinal slot 610 of the positioning member 500, causing the pull cord 900 to make an "S" or "zigzag" shape about the positioning member 500, and the terminating bent end 910 of the pull cord 900 being contained in the longitudinal slot 610 of the positioning member 500 along with being contained in the longitudinal slot 5310 of the adapter member 5000, before force is applied to the pull cord 900, and while the door 2500 is in a closed position. In any of the embodiments portion 910 in groove 610 can be facing downwardly similar to portion 920 in groove 600 and would then make a "U" shape. Additionally, it is noted that this single "S" shaped or "U" shaped pull cord 900 attachment to positioning member 500 can be used in the embodiments not using adaptor 5000 (such as those shown in FIGS. 57 through 59 where positioning member 500 would be rotated 90 degrees relative to that shown in FIGS. 57 through 59 similar to the alignment of positioning member 5000 discussed in FIGS. 70 through 74 but without adaptor 5000).

Figure 71:
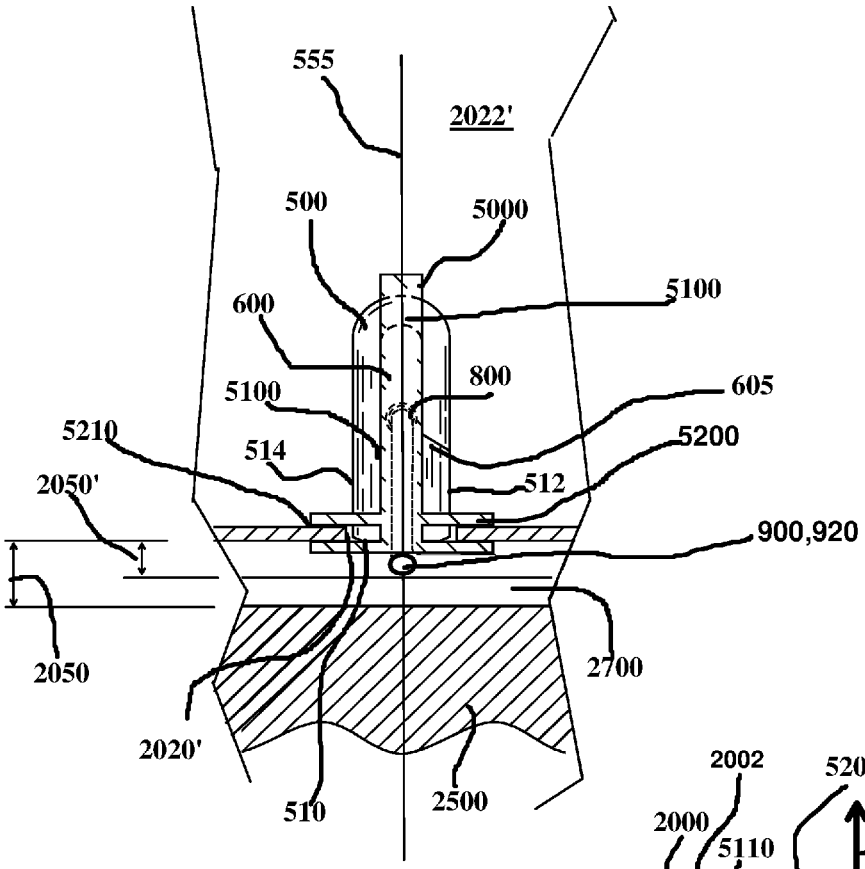
FIG. 71 is a side sectional view of the positioning member of FIG. 70 inserted into the adapter member of FIG. 66 before force is applied to the pull cord, and while the door is in a closed position.
Figure 72:
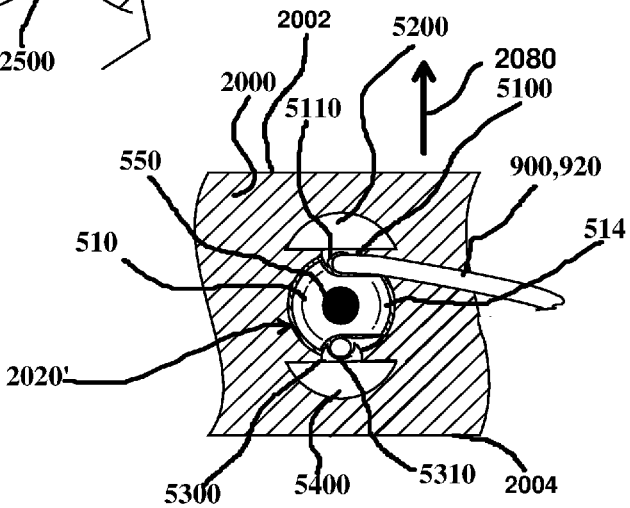
FIG. 72 is a bottom view of the positioning member of FIG. 70 inserted into the adapter member of FIG. 66 before force is applied to the pull cord, and while the door is in a closed position.

FIG. 71 is a front view positioning member 500 inserted into adapter member 5000 before force is applied to the pull cord 900, and while the door 2500 is in a closed position. FIG. 72 is a bottom view of positioning member 500 fully inserted into adapter member 5000, and before force is applied to the pull cord 900, and while the door 2500 is in a closed position.

Positioning member 500 has end 910 of pull cord 900 threaded though horizontal bore 800' and also running upwardly along longitudinal groove 610, side 920' running downwardly through groove 600. The spacing between first arm 5100 and second arm 5300 can be such that arms 5100,5300 at least partially recess in grooves 600 and 610 of positioning member 500. In this manner first and second arms 5100,5300 recessing inside grooves 600 and 610 provide longitudinal support for positioning member 500 during a pull. In various embodiments pull cord at least partially recesses inside grooves 5110,5310 of first and second arms 5100,5300, and at least partially recesses inside grooves 600 and 610 of positioning member 500 (and/or first and second arms 5100,5300 at least partially recessing inside grooves 600 and 610 of positioning member 500) to provide longitudinal support in the direction of arrow 2072 for positioning member 500 during a pull.

The spacing between first arm 5100 and second arm 5300 can be such that arms 5100,5300 fit inside grooves 600 and 610 of positioning member 500. In this manner first and second arms 5100,5300 fitting inside grooves 600 and 610 provide longitudinal support for positioning member 500 during a pull.

Longitudinal recess 5310 of second arm 5300 can receive at least part of the cross sectional area of cord 900 (e.g., part of portion 910). In various embodiments longitudinal recess 5310 can received at least 33 percent of the cross sectional area of cord 900. In various embodiments the longitudinal recess 5110 can receive at least 35, 40, 45, 50, 55, 60, 65, 70, 75, 80, 85, 90, 95, 96, 97, 98, 99, and 100 percent of the cross sectional area of cord 900. In various embodiments longitudinal recess 5310 can receive between about any two of the above referenced percentages of the cross sectional area of cord 900.

In various embodiments the length of portion 910 which is received in longitudinal recess 5310 of second arm 5300 and longitudinal recess of 610 of positioning member 500 is at least 0.1 inches (0.25 cm). In various embodiments the length is at least 0.15, 0.2, 0.3, 0.4, 0.5, 0.6, 0.7, 0.8, 0.9, and 1 inches (0.25, 0.5, 0.75, 1, 1.25, 1.5, 1.75, 2, 2.25, and 2.5 cm). In various embodiments the length of portion 910 received is between any two of the above referenced lengths.

Longitudinal recess 5110 of first arm 5100 can receive at least part of the cross sectional area of cord 900 (e.g., part of portion 920). In various embodiments longitudinal recess 5110 can received at least 33 percent of the cross sectional area of cord 900. In various embodiments the longitudinal recess 5110 can receive at least 35, 40, 45, 50, 55, 60, 65, 70, 75, 80, 85, 90, 95, 96, 97, 98, 99, and 100 percent of the cross sectional area of cord 900. In various embodiments longitudinal recess 5110 can receive between about any two of the above referenced percentages of the cross sectional area of cord 900.

Once positioning member 500 is inserted into adapter 5000, positioning marks can be made using the steps of the previously described embodiments.

Figure 73:
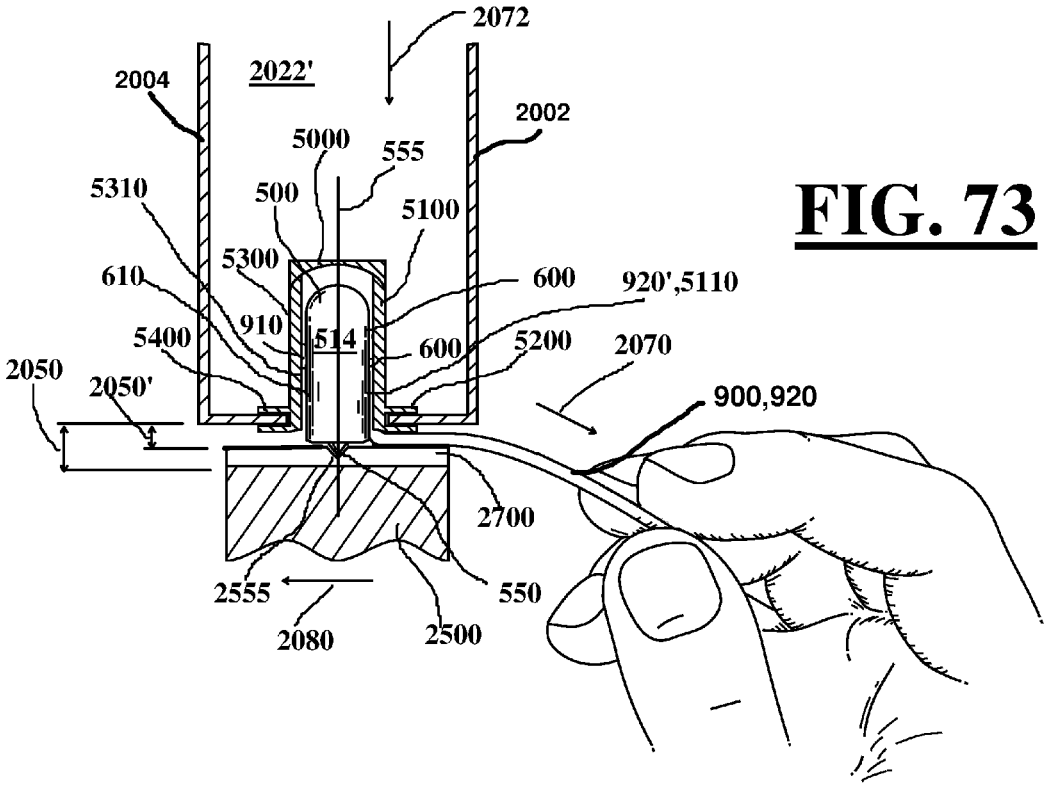
FIG. 73 is a side sectional view of the positioning member of FIG. 70 after force is applied to the pull cord, and while the door is in a closed position.

FIG. 73 is a side sectional view of positioning member 500 after force (schematically indicated by arrow 2070) is applied to pull cord 900 (via pulling on sections 910 and 920), and while the door 2500 is in a closed position. Pulling on pull cord 900 will cause the force to be transmitted to positioning member 500 via horizontal bore, causing positioning member to move downwardly (schematically indicated by arrow 2072) and towards door 2500. If desired door 2500 can be opened while force is applied to pull cord 900.

Figure 74:
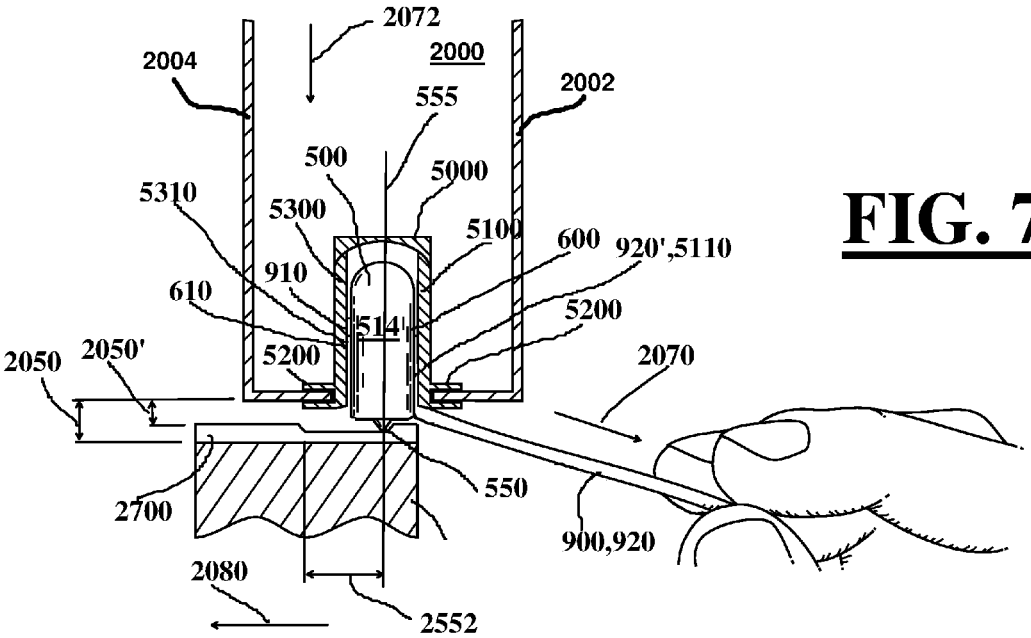
FIG. 74 is a side sectional view of the positioning member of FIG. 70 after force is applied to the pull cord, and while the door is being opened.

FIG. 74 is a side sectional view of the positioning member 500 after force is applied to the pull cord 900 (schematically indicated by arrow 2070), and while the door 2500 is being opened (schematically indicated by arrow 2080). In this manner a scratch, cut, scar 2552 from point mark 2550 can be made. FIG. 72 is a sectional view of a partially open door and frame while significant force is put on pull cord sections 910 and 920 so that the marking member 550 extends from the opening 2020 and makes a mark 2550 on the marking material 2700, and after the door 2500 has been partially opened while maintaining significant force which continued application of force in combination with opening the door 2500 causes the marking member to make an extended mark or scratch 2552 on the marking material 2700. In another embodiment mark 2550 and extended mark 2552 can be made directly on the door 2500 without the use of removable marking material 2700. Typically in these embodiments without removable marking material 2700 the door 2500 itself is sufficiently soft that marking member 550 can adequately make a mark 2550 without the necessity of using removable marking material 2700. In various embodiments markings 2720 can be made with pen, pencil, marker, crayon, felt tip marker, and other marking instruments.

Although not shown in a particular figure, it is envisioned that positioning member 500 can be inserted into a small diameter opening 2020 of frame 2000, with the pull cord 900 threaded into the upper and smaller horizontal opening 800' of the positioning member 500, and the end 910 of the pull cord 900 bent upwards into the longitudinal slot 610 of the positioning member 500, causing the pull cord 900 to make an "S" or "zigzag" shape about the positioning member 500, and the terminating bent end 910 of the pull cord 900 being contained in the longitudinal slot 610 of the positioning member 500 along with being contained in the interior wall of opening 2020. This threaded "S" embodiment of positioning member 500 can then be pulled downwardly as door 2500 is moved as discussed in other embodiments.

Manufacturer Specific Pre-Labeled Positioning Templates with Specific Mortising Perimeters Shown on Templates FIGS. 75-79 illustrate various pre-labeled positioning templates 2750 which include a removable translucent marking tape body portion 2754 and a removable liner 2751 (which can also be translucent). These pre-labeled positioning templates can be constructed substantially similar to the embodiment shown in FIGS. 38-39 (e.g., with adhesive) but with the perimeter labeling and indicia of the template being specific to a particular make and model number of a manufacturer's strike plate, deadbolt receiving plate, and/or electric strike.

Figure 75:
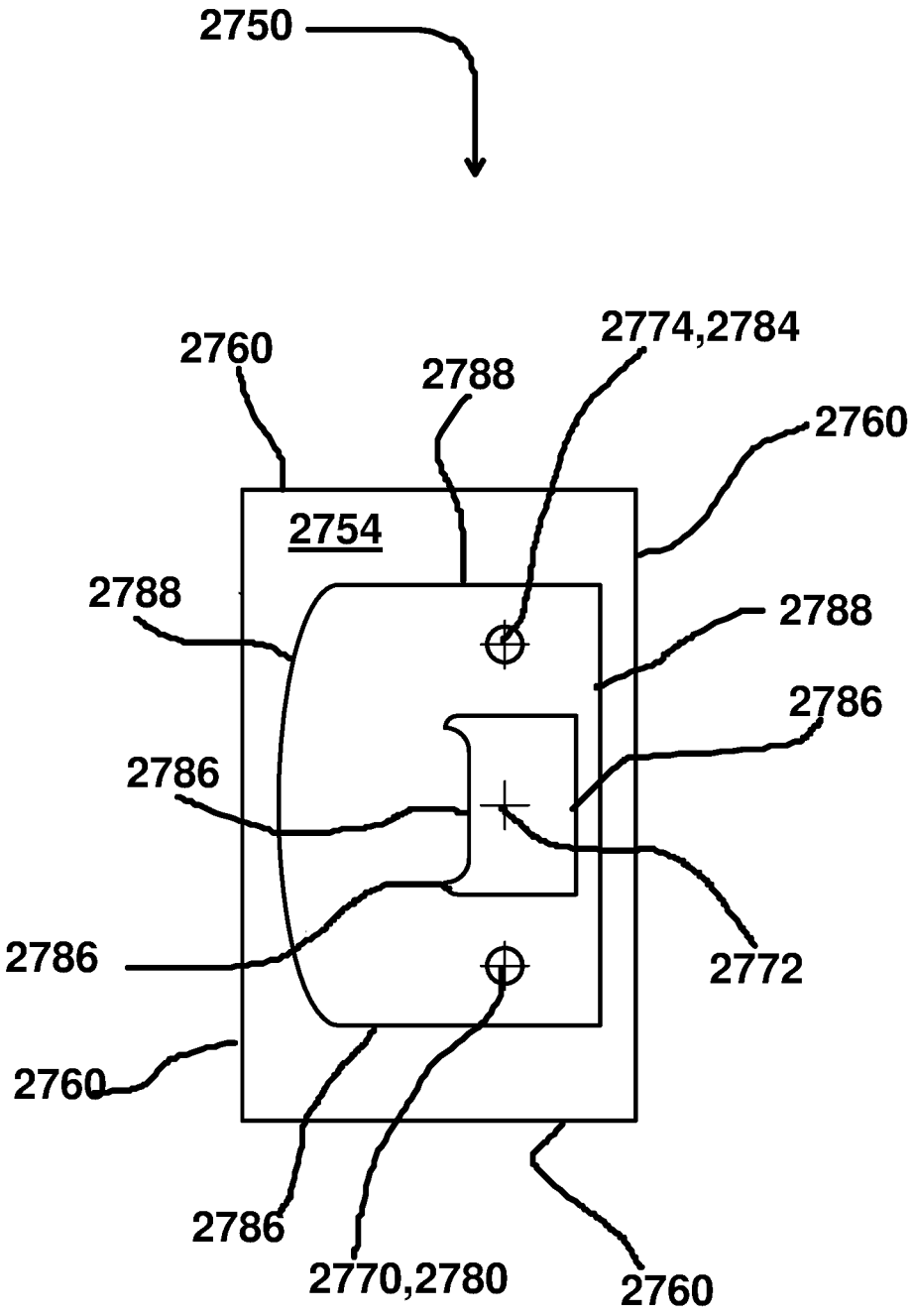
FIG. 75 schematically illustrates a pre-labeled positioning template which can be used in various embodiments for door installation to replace the step of positioning a strike plate on the door frame to draw the perimeter outline before mortising the door frame, in this embodiment the openings for the attachment screws of the strike plate align with the screw holes in the door for the strike assembly when the door is closed in the frame.

FIG. 75 schematically illustrates a pre-labeled positioning template 2750 which can be used in various embodiments for door 2500 installation to replace the step of positioning a strike plate 2200 on the door frame 2000 to draw the perimeter outline 2170 before mortising the door frame 2000 (see e.g., disclosure related to FIGS. 38-44), in this embodiment the openings 2252,2256 for the attachment screws of the strike plate 2200 align with the screw holes 2620,2630 in the door 2500 for the strike assembly when the door 2500 is closed in the frame 2000.

Figure 76:
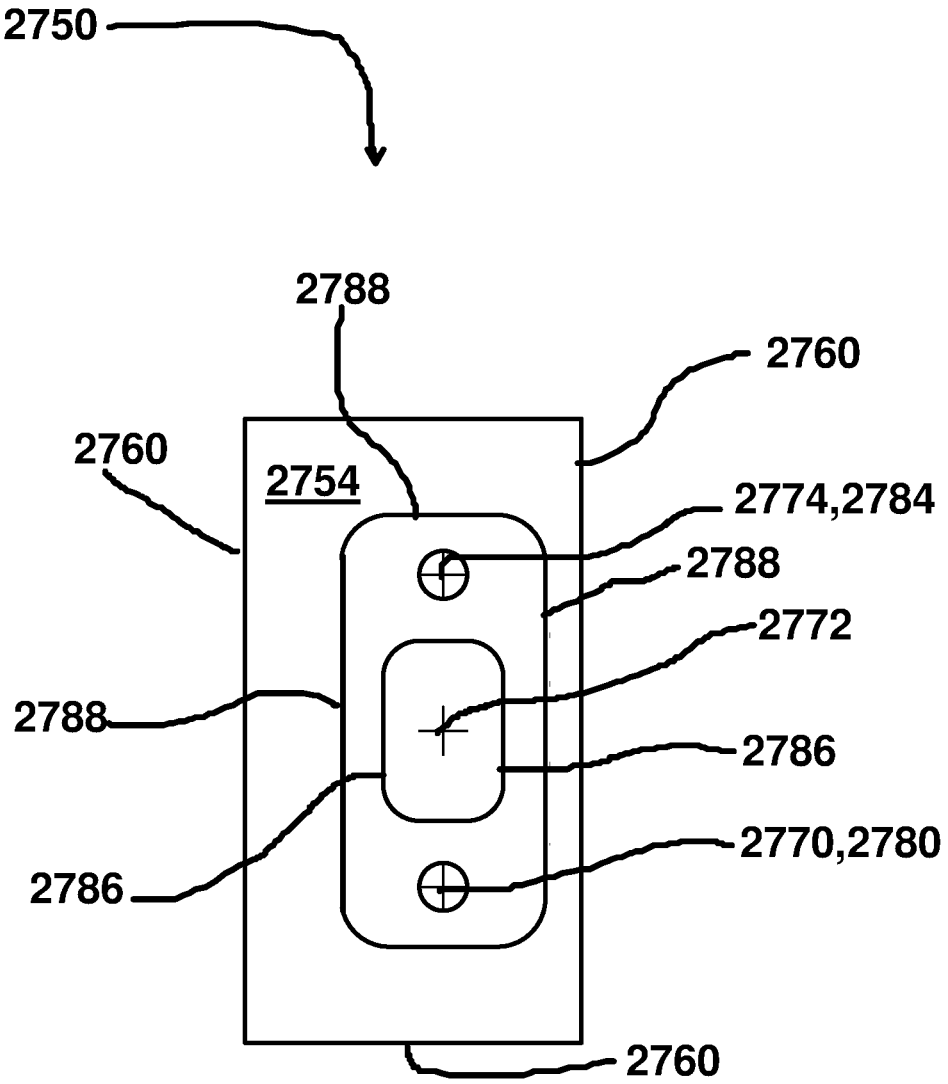
FIG. 76 schematically illustrates a pre-labeled positioning template which can be used in various embodiments for door installation to replace the step of positioning a deadbolt receiving plate on the door frame to draw the perimeter outline before mortising the door frame, in this embodiment the openings for the attachment screws of the deadbolt receiving plate align with the screw holes in the door for the deadbolt assembly when the door is closed in the frame.

FIG. 76 schematically illustrates a pre-labeled positioning template 2750 which can be used in various embodiments for door 2500 installation to replace the step of positioning a deadbolt receiving plate 2204 on the door frame 2000 to draw the perimeter outline 2170 before mortising the door frame 2000 (see e.g., disclosure related to FIGS. 29 and 30), in this embodiment the openings 2252, 2256 for the attachment screws of the deadbolt receiving plate 2204 align with the screw holes 2620,2630 in the door 2500 for the deadbolt assembly when the door 2500 is closed in the frame 2000.

Figure 77:
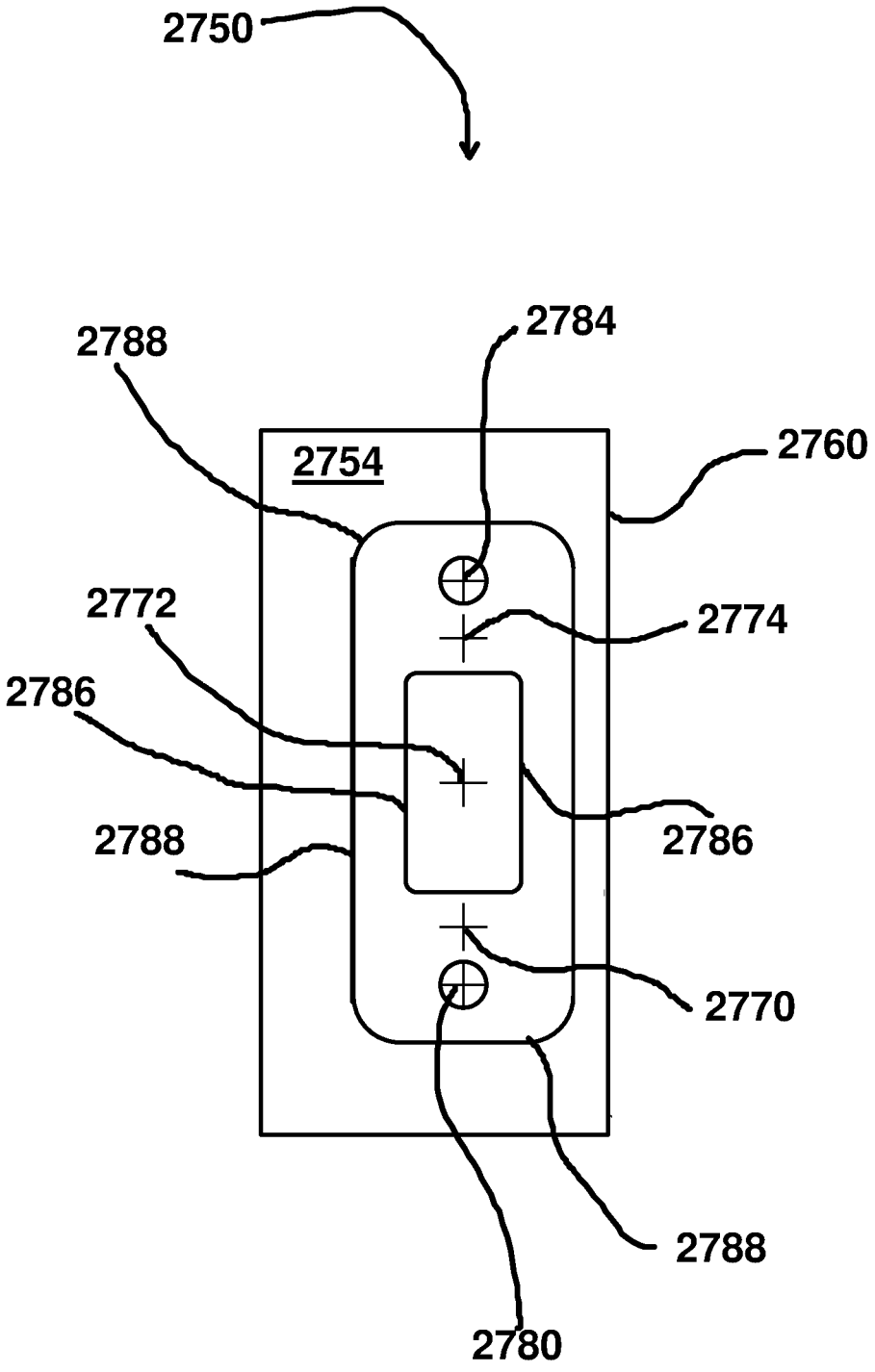
FIGS. 77 and 78 schematically illustrates pre-labeled positioning templates which can be used in various embodiments for door installation to replace the step of positioning a deadbolt receiving plate on the door frame to draw the perimeter outline before mortising the door frame, in this embodiment the openings for the attachment screws of the deadbolt receiving plates do not align with the screw holes in the door for the deadbolt assembly when the door is closed in the frame.
Figure 78:
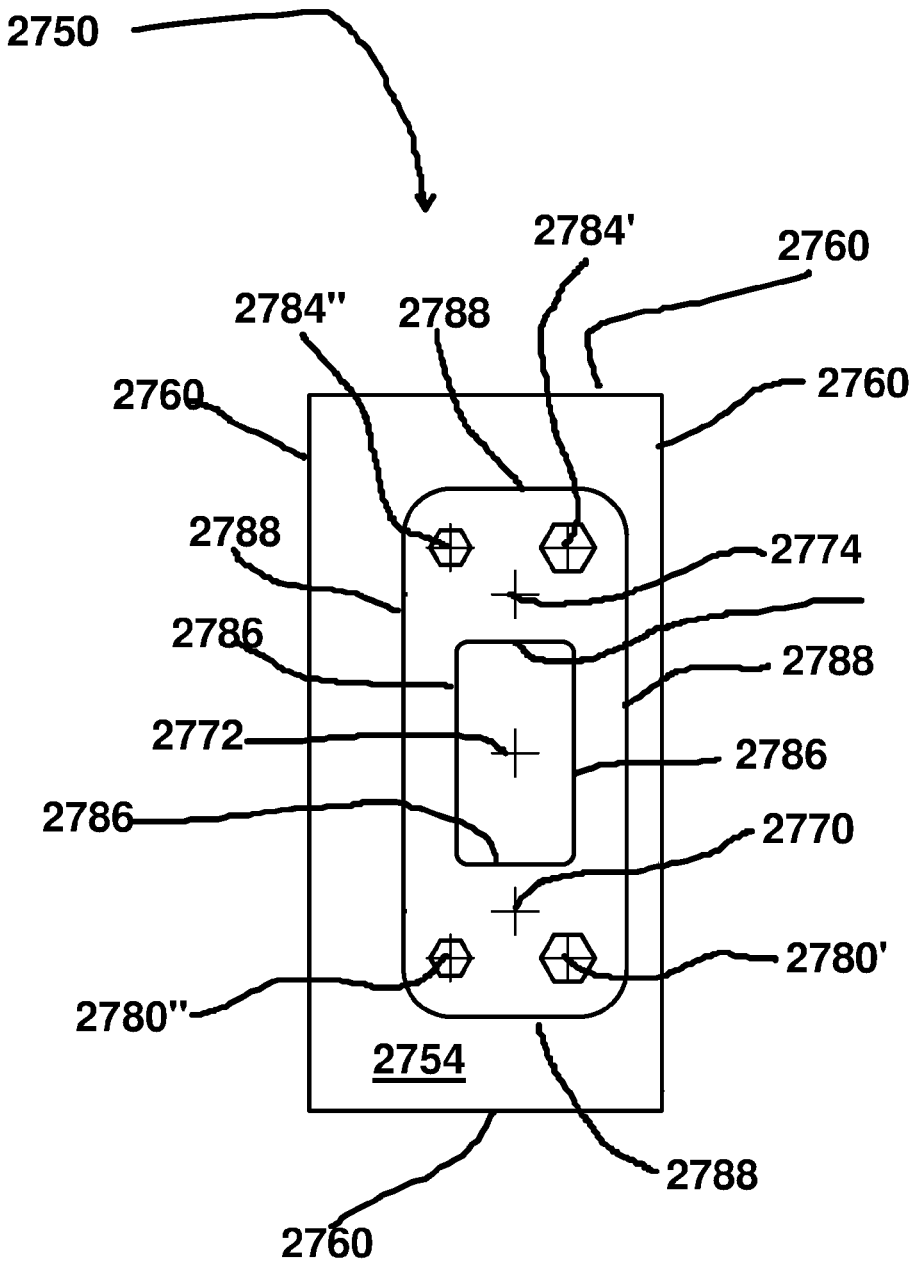

FIGS. 77 and 78 schematically illustrates pre-labeled positioning templates 2750 which can be used in various embodiments for door 2500 installation to replace the step of positioning a deadbolt receiving plate 2204 on the door frame 2000 to draw the perimeter outline 2170 before mortising the door frame 2000 (see e.g., disclosure related to FIGS. 29 and 30), in this embodiment the openings 2252, 2256 for the attachment screws of the deadbolt receiving plates 2204 do not align with the screw holes 2620,2630 in the door 2500 for the deadbolt assembly when the door 2500 is closed in the frame 2500.

Figure 79:
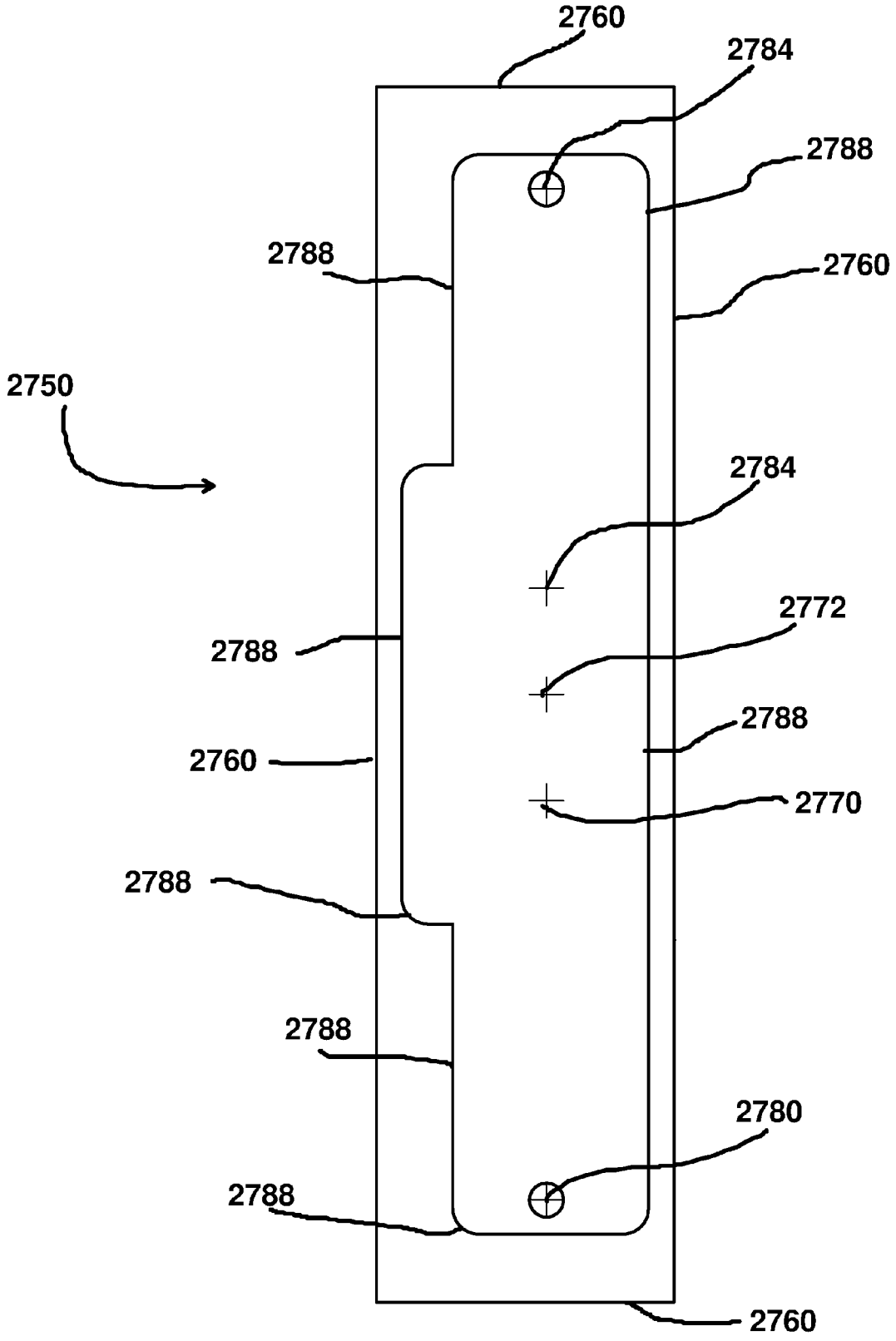
FIG. 79 schematically illustrates a pre-labeled positioning template which can be used in various embodiments for door installation to replace the step of positioning an electric strike on the door frame to draw the perimeter outline before mortising the door frame, in this embodiment the openings for the attachment screws of the electric strike do not align with the screw holes in the door for the lock assembly when the door is closed in the frame.

FIG. 79 schematically illustrates a pre-labeled positioning template 2750 which can be used in various embodiments for door installation to replace the step of positioning an electric strike 2206 on the door frame 2000 to draw the perimeter outline 2170 before mortising the door frame 2000, in this embodiment the openings 2252,2256 for the attachment screws of the electric strike do not align with the screw holes 2620, 2630 in the door 2500 for the lock assembly when the door 2500 is closed in the frame 2000.

In each of the positioning templates for FIGS. 75-79, the template can be aligned on the door frame 2000 by aligning and sticking the template positioning indicia 2770,2774 over positioning marks positioning marks 2150 and 2154 made on door frame and/or marking tape 2700 by positioning member 500 using one or more of the disclosed methods.

After being stuck on door frame 2000, the ultimate location for drilling screw holes 2124 and 2126 (at indicia 2780 and 2784) are shown in the templates—some template holes 2124,2126 being aligned (FIGS. 75 and 76), some not aligned (FIGS. 77-79).

Also, after being stuck on door frame 2000, the ultimate areas for mortising the door frame 2000 for the respective strike plate 2200, deadbolt receiving plate 2204, and electric strike 2206 are shown by the template 2750 indicia. By leaving the stuck template on the door frame 2000, the installer can mortise out around the perimeter indicia shown in the templates 2750.

For example in FIG. 75, while the template 2750 remains stuck to the frame 2000 the user can mortise directly through template 2750—interior to outer perimeter 2788 indicia to create a recessed area the strike plate 2200. The user can also directly mortise/bore through template 2750 and interior to inner perimeter 2786 indicia for the strike itself. Omitting the step of holding strike plate 2200 aligned with indicia 2780,2784 against the door frame 2000 as a template while tracing the perimeter areas of the strike plate provides a more accurate indicia for mortising—as the user may allow the strike plate 2200 to slip/move during the tracing step.

Similarly, the templates 2750 shown in FIGS. 76-79 allow the user to directly mortise/bore through the applied on template 2750 and interior to inner perimeter 2786 indicia for the strike, deadbolt receiving plate, or electric strike.

Omitting the step of holding these items on the door frame 2000 aligned with indicia 2780,2784 against the door frame 2000 as a template while tracing the perimeter areas of these items provides a more accurate indicia for mortising on the door frame 2000—as the user may allow these items to slip/move during the tracing step.

In one embodiment, the installer can mortise the door frame 2000 directly through the tape 2750 while the tape 2750 remains on the door frame 2000.

Alternatively, in one embodiment the installer can first score the door frame 2000 through the outer perimeter 2788 of the model specific strike plate indicia, deadbolt receiving plate indicia, or electric strike indicia. Scoring through tape 2750 and into the door frame 2000 can be accomplished using a razor knife, utility knife, exacto knife, or even using a chisel and hammer combination. To perform the scoring step, compared to scoring using a razor knife, some installers may find it easier to use a hammer/chisel combination to hammer the chisel through the outer indicia 2788 of the tape 2750 and into the door frame (as the markings will go deeper into the door frame 2000).

In one embodiment first scoring the door frame 2000, allows the installer to remove the portion of the tape 2750 located interior to the outer perimeter 2788 prior to mortising the door frame 2000. Scoring through the tape 2750 and into the underlying door frame 2000 also creates a non-movable marking on the door frame 2000 for the step of mortising of the door frame 2000, and addresses the risk that the tape 2750 actually moves and/or becomes dislodged from the door frame 2000 during the step of mortising.

In one embodiment, the installer can leave entire portion of tape 2750 after scoring and during the mortising step.

In one embodiment during the mortising step, at least a substantial portion of the tape 2750 located exterior to outer perimeter indicia 2788 of the model specific strike plate indicia, deadbolt receiving plate indicia, or electric strike indicia can remain on the door frame 2000 for the mortising step. For example, after the user scores into the door frame 2000 the outer perimeter indicia 2788, the portion of the tape 2750 located interior to the outer perimeter indicia 2788 can be removed from the door frame 2000. Removal of this interior portion, and leaving the exterior portion of the tape 2750 on door frame 2000 provides the installer with a template outlining the area to be mortised which is properly positioned on door frame 2000 to assist the installer in mortising the recessed area at the proper location in the door frame 2000 for the strike 2200, deadbolt receiving plate indicia 2204, and/or electric strike 2204.

Unlike the step of mortising, it is believed that the step of drilling pilot drill holes through tape 2750 located on door frame 2000 and into the door frame 2000 at the location of the screw hole openings of the strike plate indicia, deadbolt receiving plate, and/or electric strike does not create a substantial risk of moving and/or dislodging the tape 2750 from the door frame 2000. In various embodiments, before the step of scoring of the door frame 2000, the installer can first drill the pilot drill holes and/or the actual drill holes into the door frame 2000. In various embodiments, after the scoring step but before the mortising step, the installer can drill the pilot drill holes and/or the actual drill holes into the door frame 2000.

The following is a list of reference numerals suitable for use in the present invention.

REFERENCE NUMERAL LIST

| Reference Number | Description |
|---|---|
| 5 | tool |
| 7 | pen/pencil/stencil |
| 10 | door sensor |
| 12 | frame portion of sensor |
| 14 | door portion of sensor |
| 20 | wire |
| 21 | arrow |
| 22 | first wire |
| 24 | second wire |
| 26 | portion of wire insulation in horizontal hole |
| 100 | marking apparatus |
| 200 | handle |
| 300 | arm |
| 302 | top side |
| 304 | bottom side |
| 310 | first end |
| 320 | second end |
| 350 | opening |
| 355 | threaded area |
| 360 | notch or slot |
| 370 | bend or angle |
| 380 | covering |
| 500 | positioning member |
| 502 | arrow |
| 504 | diameter positioning surface |
| 505 | intermediate area |
| 506 | enlarged area |
| 510 | first end |
| 512 | arrow |
| 520 | second end |
| 522 | arrow |
| 524 | arrow |
| 526 | arrow |
| 530 | positioning surface |
| 532 | positioning surface |
| 534 | positioning surface |
| 540 | length |
| 542 | enlarged frustoconical length |
| 544 | intermediate length |
| 546 | base length |
| 550 | pointed area/marking point |
| 555 | longitudinal centerline |
| 560 | enlarged portion |
| 570 | frustoconical portion |
| 574 | first removed area |
| 575 | tapered portion |
| 578 | second removed area |
| 579 | tapered portion |
| 590 | intermediate enlarged area |
| 594 | frustoconical portion |
| 600 | groove |
| 601 | end |
| 602 | first section |
| 604 | second section |
| 606 | third section |
| 610 | groove |
| 611 | end |
| 612 | first section |
| 614 | second section |
| 616 | third section |
| 800 | opening |
| 810 | first end |
| 820 | second end |
| 900 | flexible member (e.g., cord/wire/string/rope/chain) |
| 910 | first end |
| 920 | second end |
| 1000 | positioning member |
| 1005 | bore (threaded) |
| 1010 | first end |
| 1020 | second end |
| 1030 | positioning surface |
| 1040 | rounded area |
| 1050 | fastener |
| 1051 | tip of fastener |
| 1070 | threaded area |
| 1100 | adjustable punch |

-continued

REFERENCE NUMERAL LIST

| Reference Number | Description |
|---|---|
| 1110 | first end |
| 1115 | notched end |
| 1120 | second end |
| 1150 | threaded portion |
| 1155 | tip |
| 2000 | door frame |
| 2001 | center line |
| 2002 | front or exterior of door frame |
| 2004 | rear or interior of door frame |
| 2006 | door jam |
| 2010 | header |
| 2020 | opening |
| 2050 | gap |
| 2052 | reduced gap |
| 2070 | arrow |
| 2072 | arrows |
| 2074 | plane |
| 2080 | arrow |
| 2084 | arrow |
| 2100 | side |
| 2110 | original strike plate recessed area |
| 2112 | bore in recessed area |
| 2114 | screw hole |
| 2116 | screw hole |
| 2120 | modified strike plate recessed area |
| 2122 | modified bore in recessed area |
| 2124 | repositioned location of screw hole |
| 2126 | repositioned location of screw hole |
| 2150 | mark |
| 2152 | elongated mark/scratch |
| 2154 | mark |
| 2158 | elongated mark/scratch |
| 2160 | recessed area for strike plate |
| 2165 | strike plate bore |
| 2170 | outline made from strike plate |
| 2200 | strike plate |
| 2204 | deadbolt receiving plate |
| 2206 | electric strike |
| 2210 | perimeter of strike plate |
| 2252 | mounting screw hole opening |
| 2256 | mounting screw hole opening |
| 2258 | spacing between mounting screw hole openings |
| 2260 | opening for deadbolt or door latch |
| 2262 | center point or center mark |
| 2268 | vertical center mark |
| 2500 | door |
| 2504 | door knob |
| 2510 | top |
| 2520 | opening |
| 2530 | opening |
| 2550 | mark |
| 2552 | elongated mark/scratch |
| 2555 | hole |
| 2560 | scar mark |
| 2562 | elongated mark/scratch |
| 2570 | longitudinal center line on door |
| 2570' | transposed longitudinal centerline from door |
| 2572 | angle of inclination |
| 2574 | horizontal shifting |
| 2576 | vertical shifting |
| 2600 | door locking member |
| 2610 | plate |
| 2620 | first opening |
| 2622 | longitudinal centerline |
| 2624 | first screw |
| 2630 | second opening |
| 2632 | longitudinal centerline |
| 2634 | second screw |
| 2700 | removable marking material |
| 2704 | gap reducer with adhesive |
| 2710 | thickness of marking material |
| 2720 | small markings |
| 2730 | first section/layer of marking material/gap reducer |
| 2732 | first side |

-continued

REFERENCE NUMERAL LIST

| Reference Number | Description |
|---|---|
| 2734 | second side |
| 2736 | thickness |
| 2738 | removable/removed portion |
| 2740 | second section/layer of marking material/gap reducer |
| 2742 | first side |
| 2744 | second side |
| 2746 | thickness |
| 2748 | removable/removed portion |
| 2750 | pre-labeled positioning template |
| 2751 | body layer |
| 2752 | thickness |
| 2753 | adhesive |
| 2754 | translucent pre labeled positioning template |
| 2760 | perimeter |
| 2770 | first indicia of first set of indicia |
| 2772 | middle indicia for first set of indicia |
| 2774 | second indicia of first set of indicia |
| 2780 | first indicia of transposed set of indicia |
| 2784 | second indicia of transposed set of indicia |
| 2786 | perimeter outline for inner opening |
| 2788 | perimeter outline for outer portion of item being positioned and mortised |
| 2790 | support pad |
| 2791 | thickness |
| 2792 | liner |
| 2800 | drill |
| 2810 | drill bit |
| 3000 | opening |
| 3010 | arrow |
| 4000 | mapping tape |
| 4005 | translucent body |
| 4100 | longitudinal line |
| 4110 | orthogonal centerline |
| 4111 | spacing |
| 4112 | spacing |
| 4114 | spacing |
| 4120 | plurality of orthogonal positioning lines |
| 4121 | spacing |
| 4130 | predefined spacing |
| 4300 | secondary positioning mark |
| 4310 | secondary positioning mark |
| 4400 | gap |
| 4404 | gap |
| 4600 | hole punch tool |
| 4700 | backing |
| 5000 | adapter member |
| 5002 | arrow schematically indicating positioning of adapter member |
| 5010 | base |
| 5022 | arch |
| 5100 | arm |
| 5110 | recessed area |
| 5200 | foot |
| 5210 | recessed area |
| 5300 | arm |
| 5310 | recessed area |
| 5400 | foot |
| 5410 | recessed area |

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

The invention claimed is:

1. A method of installing a latch or door plate on a door frame attached to a door, comprising the steps of:

(a) providing a positioning member, the positioning member having a longitudinal centerline, a bore which passes through the longitudinal centerline and a marking point, the marking point being aligned with the longitudinal centerline of the positioning member, and the positioning member including a pair of longitudinal grooves and lower open areas, the longitudinal grooves having a first width and the lower open areas having a second width, the second width being larger than the first width, and a flexible member having first and second ends and passing the flexible member through the bore such that the flexible member is at least partly contained in the longitudinal grooves;

(b) partially opening the door;

(c) placing the positioning member in a hole in the door;

(d) while the positioning member is in the hole, closing the door in the door frame, and while the door is closed in the door frame, applying force on the flexible member by pulling on the flexible member, which force is transferred to the bore and then to the positioning member to cause the marking point of the positioning member to make a positioning mark on the frame, and continuing to apply force on the flexible member by pulling while at least partially opening the door causing the marking point of the positioning member to enlarge the positioning mark on the frame;

(e) after step "d", opening the door and removing the positioning member from the hole in the door; and (f) after step "d", using the mark made in step "d" as a basis for installing the latch or door plate on the frame.

2. The method of claim 1, wherein before step "d" a marking material is placed on the door frame to assist in seeing, and during step "d" the positioning mark is made on the marking material.

3. The method of claim 2, wherein in step "d" the flexible member is selected from the group consisting of a rope, wire, chain, cord, or string.

4. The method of claim 2, wherein the marking material is tape.

5. The method of claim 2, wherein the marking material is comprised of a different material from the door frame.

6. The method of claim 1, wherein in step "c" the hole in the door is one of a plurality of holes for receiving screws which will be used to connect a door locking member to the door.

7. The method of claim 6, wherein the positioning member has a diameter and the diameter is less than the diameter of the screws used to attach the door locking member to the door.

8. The method of claim 1, wherein the positioning member has top and bottom portions, and an enlarged area, and the enlarged area extends from the bore to the bottom portion.

* * * * *